US011169455B2

(12) United States Patent
Iwasaki et al.

(10) Patent No.: US 11,169,455 B2
(45) Date of Patent: Nov. 9, 2021

(54) ELECTROPHOTOGRAPHIC PHOTORECEPTOR, PROCESS CARTRIDGE, AND IMAGE FORMING APPARATUS

(71) Applicant: FUJIFILM Business Innovation Corp., Tokyo (JP)

(72) Inventors: Masahiro Iwasaki, Kanagawa (JP); Wataru Yamada, Kanagawa (JP); Kenji Kajiwara, Kanagawa (JP); Kota Maki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/926,754

(22) Filed: Jul. 12, 2020

(65) Prior Publication Data

US 2020/0341392 A1 Oct. 29, 2020

Related U.S. Application Data

(62) Division of application No. 16/264,692, filed on Feb. 1, 2019, now Pat. No. 10,754,266.

(30) Foreign Application Priority Data

Sep. 21, 2018 (JP) ..... JP2018-177634
Sep. 21, 2018 (JP) ..... JP2018-177635
Sep. 21, 2018 (JP) ..... JP2018-177636

(51) Int. Cl.
*G03G 5/00* (2006.01)
*G03G 5/14* (2006.01)
(Continued)

(52) U.S. Cl.
CPC ..... *G03G 5/144* (2013.01); *G03G 5/0532* (2013.01); *G03G 5/0542* (2013.01);
(Continued)

(58) Field of Classification Search
CPC .... G03G 5/0532; G03G 5/0546; G03G 5/142; G03G 5/144
See application file for complete search history.

(56) References Cited

U.S. PATENT DOCUMENTS 3,879,200 A * 4/1975 Regensburger ..... G03G 5/047 430/58.6
4,835,079 A * 5/1989 Fujimura ..... G03G 5/047 430/133
(Continued)

FOREIGN PATENT DOCUMENTS

JP 2000321800 A * 11/2000

OTHER PUBLICATIONS

Borsenberger, P.M.; Weiss, D. Organic Photoreceptors for Imaging Systems, pp. 6-9, 289-293 (Year: 1993).*
(Continued)

*Primary Examiner* — Mark A Chapman
(74) *Attorney, Agent, or Firm* — JCIPRNET

(57) ABSTRACT

An electrophotographic photoreceptor includes a conductive substrate, an undercoating layer, and a photosensitive layer. The undercoating layer that is provided on the conductive substrate and includes a binder resin and a charge transporting material. The binder resin includes a resin obtained by polymerizing a diallyl phthalate compound. The photosensitive layer that is provided on the undercoating layer.

14 Claims, 2 Drawing Sheets

(51) Int. Cl.
*G03G 5/05* (2006.01)
*G03G 5/06* (2006.01)

(52) U.S. Cl.
CPC ..... *G03G 5/0546* (2013.01); *G03G 5/0575* (2013.01); *G03G 5/0659* (2013.01); *G03G 5/142* (2013.01)

(56) References Cited

U.S. PATENT DOCUMENTS

| | | | | | |
|---|---|---|---|---|---|
| 4,968,579 | A * | 11/1990 | Kimoto | G03G 5/047 | 430/134 |
| 5,213,927 | A * | 5/1993 | Kan | C08G 73/10 | 430/57.2 |
| 5,516,610 | A * | 5/1996 | Nguyen | G03G 5/047 | 430/58.05 |
| 8,632,931 | B2 * | 1/2014 | Sekido | G03G 5/0535 | 430/60 |
| 2003/0039907 | A1 * | 2/2003 | Uchida | G03G 5/142 | 430/60 |

OTHER PUBLICATIONS

English language machine translation JP 2000-321800 (Year: 2000).*
Diallyl Phthalate Resin | Products; Osaka Soda, [retrieved May 11, 2021], Retrieved from the Internet. <URL: www.osaka-soda.co.jp/en/prd/synthetic/dially_phthalate.html>. (Year: 2021).*
Chemical Abstracts Registry # 25035-78-3: 1,3-Benzenedicarboxylicacid, 1,3-di-2-propen-1-yl ester, homopolymer. (Year: 2021).*

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is a divisional application of and claims the priority benefit of U.S. patent application Ser. No. 16/264,692, filed on Feb. 1, 2019, now allowed, the entirety of which is incorporated by reference herein, and is further based on and claims priority under 35 USC 119 from Japanese Patent Application No. 2018-177634 filed on Sep. 21, 2018, Japanese Patent Application No. 2018-177635 filed on Sep. 21, 2018, and Japanese Patent Application No. 2018-177636 filed on Sep. 21, 2018.

BACKGROUND

(i) Technical Field

The present invention relates to an electrophotographic photoreceptor, a process cartridge, and an image forming apparatus.

(ii) Related Art

In the related art, as an electrophotographic image forming apparatus, an apparatus that sequentially performs steps such as charging, forming an electrostatic latent image, developing, transferring, and cleaning, by using an electrophotographic photoreceptor is widely known.

As the electrophotographic photoreceptor, there is known a function-separated photoreceptor in which a charge generation layer that generates charge and a charge transport layer that transports the charge are stacked on a substrate having conductivity such as aluminum or a singlelayer photo receptor in which a singlelayer plays a function of generating charge and a function of transporting charge.

Patent Document 1 discloses an electrophotographic photoreceptor in which an intermediate layer and a photosensitive layer are provided in this order on a conductive support and the intermediate layer contains a polyolefin resin and a benzimidazole compound.

Patent Document 2 discloses an electrophotographic photoreceptor including an intermediate layer and a photosensitive layer in this order on a support, in which the intermediate layer contains an electron transport substance selected from a naphthalene amidine imide compound, a perylene amidine imide compound, and an imide resin.

Patent document 3 discloses an electrophotographic photoreceptor including an intermediate layer and a photosensitive layer in this order on a support, in which the intermediate layer contains an electron transport substance selected from a naphthalene amidine imide compound and a perylene amidine imide compound.

Patent Document 4 discloses a benzimidazole compound as an electron transport substance used for an undercoating layer of an electrophotographic photoreceptor.

Patent Document 5 discloses an electrophotographic photoreceptor including a support, an undercoating layer, and a photosensitive layer, in which the undercoating layer includes metal oxide particles which are subjected to a surface treatment with a silane coupling agent, a binder resin, and an organic acid salt of metal selected from bismuth, zinc, cobalt, iron, nickel, and copper.

Patent Document 6 discloses an electrophotographic photoreceptor including at least an undercoating layer and a photosensitive layer on a conductive substrate, in which the undercoating layer includes metal oxide fine particles to which at least one acceptor compound selected from a hydroxyanthraquinone compound and an aminohydroxyanthraquinone compound is attached.

In addition, Patent Document 1 discloses an electrophotographic photoreceptor in which an intermediate layer and a photosensitive layer are provided in this order on a conductive support, the intermediate layer contains a polyolefin resin and an organic electron transport substance, and the organic electron transport substance is a compound selected from the group consisting of an imide compound, a benzimidazole compound, a quinone compound, a cyclopentadienylidene compound, an azo compound, and derivatives thereof.

Patent Document 7 discloses an electrophotographic photoreceptor in which an undercoating layer and a protective layer in this order on a conductive support, the undercoating layer includes an olefin resin containing, as a constituent component, a compound having at least one of a carboxylic acid group and a carboxylic acid anhydride group, and an organic electron transporting material.

[Patent Document 1] JP-A-2011-095665
[Patent Document 2] Japanese Patent No. 3958154
[Patent Document 3] Japanese Patent No. 3958155
[Patent Document 4] JP-A-2015-026067
[Patent Document 5] JP-A-2014-186296
[Patent Document 6] Japanese Patent No. 4456955
[Patent Document 7] JP-A-2009-288621

SUMMARY

Aspects of non-limiting embodiments of the present disclosure relate to an electrophotographic photoreceptor (first electrophotographic photoreceptor) which is excellent in charge retention characteristic, as compared with a case where an undercoating layer contains a perinone compound and polyamide or polycarbonate without containing polyurethane.

Aspects of non-limiting embodiments of the present disclosure relate to an electrophotographic photoreceptor (second electrophotographic photoreceptor) which prevents deterioration of photosensitivity when images are repeatedly formed, as compared with a case where an undercoating layer contains at least one of compounds represented by Formula (1) or (2) to be described later and as an acceptor compound, only a compound (18-1) or (18-2) to be described later.

In addition, when repeated images are formed with an electrophotographic photoreceptor including an undercoating layer, there are some cases where a rise in a residual potential is caused. Accordingly, aspects of non-limiting embodiments of the present disclosure relate to an electrophotographic photoreceptor (third electrophotographic photoreceptor) which prevents the residual potential from rising when repeated images are formed, as compared with a case of an electrophotographic photoreceptor including a conductive substrate, a photosensitive layer provided on the conductive substrate, in which an undercoating layer that is provided between the conductive substrate and the photosensitive layer and contains a charge transporting material and a binder resin including only a polyamide resin.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

As the first electrophotographic photoreceptor according to a first aspect of the present disclosure, there is provided an electrophotographic photoreceptor including:

a conductive substrate;

an undercoating layer that is disposed on the conductive substrate; and a photosensitive layer that is disposed on the undercoating layer, in which the undercoating layer contains at least one perinone compound selected from the group consisting of a compound represented by Formula (1) and a compound represented by Formula (2) shown below, and polyurethane.

Formula (1)

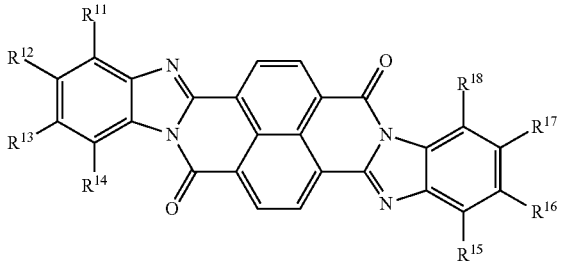

Formula (2)

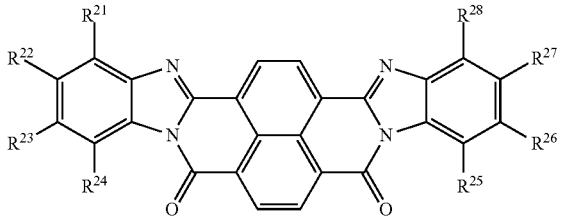

In Formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom, $R^{11}$ and $R^{12}$ may be linked to each other to form a ring, $R^{12}$ and $R^{13}$ may be linked to each other to form a ring, $R^{13}$ and $R^{14}$ may be linked to each other to form a ring, $R^{15}$ and $R^{16}$ may be linked to each other to form a ring, $R^{16}$ and $R^{17}$ may be linked to each other to form a ring, and $R^{17}$ and $R^{18}$ may be linked to each other to form a ring.

In Formula (2), $R^{21}$, $R^{22}$, $R^{23}$, $R^{24}$, $R^{25}$, $R^{26}$, $R^{27}$, and $R^{28}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom, $R^{21}$ and $R^{22}$ may be linked to each other to form a ring, $R^{22}$ and $R^{23}$ may be linked to each other to form a ring, $R^{23}$ and $R^{24}$ may be linked to each other to form a ring, $R^{25}$ and $R^{26}$ may be linked to each other to form a ring, $R^{26}$ and $R^{27}$ may be linked to each other to form a ring, and $R^{27}$ and $R^{28}$ may be linked to each other to form a ring.

As the second electrophotographic photoreceptor according to a second aspect of the present disclosure, there is provided an electrophotographic photoreceptor including:

a conductive substrate;

an undercoating layer that is disposed on the conductive substrate; and a photosensitive layer that is disposed on the undercoating layer, in which the undercoating layer contains at least one perinone compound selected from the group consisting of a compound represented by Formula (1) and a compound represented by Formula (2) to be described later, and at least one acceptor compound selected from the group consisting of a compound represented by Formula (3), a compound represented by Formula (4), a compound represented by Formula (5), a compound represented by Formula (6), a compound represented by Formula (7), a compound represented by Formula (8), a compound represented by Formula (9), a compound represented by Formula (10), a compound represented by Formula (11), a compound represented by Formula (12), a compound represented by Formula (13), a compound represented by Formula (14), and a compound represented by Formula (15) to be described later.

As the third electrophotographic photoreceptor according to a third aspect of the present disclosure, there is provided an electrophotographic photoreceptor including:

a conductive substrate;

an undercoating layer that is provided on the conductive substrate and contains a binder resin and a charge transporting material, the binder resin containing a resin obtained by polymerizing a diallyl phthalate compound; and a photosensitive layer that is provided on the undercoating layer.

BRIEF DESCRIPTION OF THE DRAWINGS

Exemplary embodiments of the present invention will be described in detail based on the following figures, wherein.

DETAILED DESCRIPTION

Figure 1:
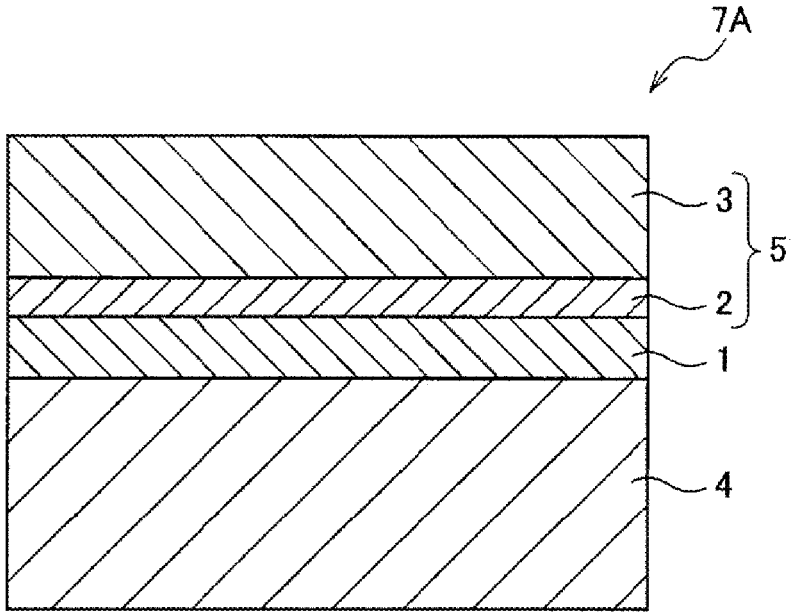
FIG. 1 is a schematic partial sectional view illustrating an example of a layer configuration of an electrophotographic photoreceptor according to an exemplary embodiment.

Hereinafter, exemplary embodiments of the present disclosure will be described. These descriptions and examples are illustrative of exemplary embodiments and do not limit the scope of the exemplary embodiment.

In the present disclosure, a numerical range indicated by "to" indicates a range including numerical values described before and after the "to" as the minimum value and the maximum value, respectively.

In the numerical ranges described in stages in the present disclosure, an upper limit value or a lower limit value described in one numerical range may be replaced by an upper limit value or a lower limit value of a numerical range described in another stage. In addition, the numerical range described in the present disclosure, the upper limit value or the lower limit value of the numerical range may be replaced by a value shown in examples.

In the present disclosure, the term "step" includes not only an independent step, but also a case of not clearly distinguishable from other steps as long as an intended object of the step is achieved.

In the present disclosure, each component may include plural applicable substances. In the present disclosure, when referring to the amount of each component in a composition, in a case where plural kinds of substances corresponding to each component are present in the composition, unless otherwise specified, the amount of each component means a total amount of the plural kinds of the substances.

In the present disclosure, a major component means a principal component. The major component refers to, in a mixture of plural kinds of components, a component which occupies 30% by weight or more of a total weight of the mixture.

In the present disclosure, an electrophotographic photoreceptor is simply referred to as a photoreceptor.

<First Electrophotographic Photoreceptor>

A first photoreceptor according to the exemplary embodiment includes a conductive substrate, an undercoating layer that is disposed on the conductive substrate, and a photosensitive layer that is disposed on the undercoating layer, in which the undercoating layer contains at least one perinone compound selected from the group consisting of a compound represented by Formula (1) and a compound represented by Formula (2), and polyurethane.

In the present disclosure, the compound represented by Formula (1) is also referred to as a perinone compound (1), and the compound represented by Formula (2) is also referred to as a perinone compound (2).

Since the first photoreceptor contains at least one of the perinone compound (1) and the perinone compound (2), and the polyurethane, it is excellent in charge retention characteristic. As the reason, the following mechanism is presumed.

A photoreceptor including an undercoating layer containing at least one of the perinone compound (1) and the perinone compound (2) as a major electron transporting material is excellent in electric characteristics and leak resistance, for example, as compared with a photoreceptor including an undercoating layer containing an imide compound (A), an imide compound (B), or an imide compound (C), which is described later, as a major electron transporting material. However, when at least one of the perinone compound (1) and the perinone compound (2) is used as the major electron transporting material of the undercoating layer, the charge retention characteristic is not sufficient. As a mechanism in which the charge retention characteristic is not sufficient, it is considered that since hole blocking property is low at the time of charging, hole diffusion migration occurs from the perinone compound (1) or the perinone compound (2) contained in the undercoat layer to the charge generation material (for example, a phthalocyanine pigment) contained in the photosensitive layer, finally, a potential of a surface of the photoreceptor is attenuated.

On the contrary, when using the polyurethane as a binder resin along with at least one of the perinone compound (1) and the perinone compound (2), the photoreceptor is excellent in charge retention characteristic, as compared with a case of using other kinds of binder resin. As the mechanism thereof, it is considered that, since the polyurethane has high effect of preventing (blocking effect) an internal charge (dark carrier) of the perinone compound (1) or the perinone compound (2) contained in the undercoating layer from being injected into the charge generation material, the potential of the surface of the photoreceptor is unlikely to be attenuated.

<Second Electrophotographic Photoreceptor>

A second photoreceptor according to the exemplary embodiment includes a conductive substrate, an undercoating layer that is disposed on the conductive substrate, and a photosensitive layer that is disposed on the undercoating layer, in which the undercoating layer contains at least one perinone compound selected from the group consisting of a compound represented by Formula (1) and a compound represented by Formula (2) to be described later, and at least one acceptor compound selected from the group consisting of a compound represented by Formula (3), a compound represented by Formula (4), a compound represented by Formula (5), a compound represented by Formula (6), a compound represented by Formula (7), a compound represented by Formula (8), a compound represented by Formula (9), a compound represented by Formula (10), a compound represented by Formula (11), a compound represented by Formula (12), a compound represented by Formula (13), a compound represented by Formula (14), and a compound represented by Formula (15) to be described later.

In the present disclosure, the compound represented by Formula (1) is also referred to as a perinone compound (1), and the compound represented by Formula (2) is also referred to as a perinone compound (2).

In a photoreceptor including at least any one of the perinone compound (1) and the perinone compound (2), although detailed mechanism is not clear, there are some cases where photosensitivity deteriorates when images are repeatedly formed.

As a result of study conducted by the present inventors, it is found that, in a photoreceptor including the undercoating layer containing at least any one of the perinone compound (1) and the perinone compound (2) and at least one acceptor compound selected from the compound represented by any one of Formulas (3) to (15), the photosensitivity is unlikely to deteriorate even when images are repeatedly formed.

In addition, it is found that, in the photoreceptor including the undercoating layer containing at least any one of the perinone compound (1) and the perinone compound (2) and at least one acceptor compound selected from the compound represented by any one of Formulas (3) to (15), the residual potential is unlikely to rise even when images are repeatedly formed.

Third Electrophotographic Photoreceptor A third electrophotographic photoreceptor according to the exemplary embodiment includes a conductive substrate, an undercoating layer that is provided on the conductive substrate and contains a binder resin containing a resin obtained by polymerizing a diallyl phthalate compound, and a charge transporting material, and a photosensitive layer that is provided on the undercoating layer.

In the related art, when using an electrophotographic photoreceptor including a conductive substrate, a photosensitive layer that is provided on the conductive substrate, and an undercoating layer that is provided between the conductive substrate and the photosensitive layer and contains a charge transporting material and a binder resin including only a polyamide resin, the residual potential may rise when repeated images are formed.

On the other hand, since the third electrophotographic photoreceptor has the configuration described above, the residual potential is prevented from rising when repeated images are formed. Factors by which the residual potential is prevented from rising are not always clear, but may be considered as follows.

The third electrophotographic photoreceptor includes a resin obtained by polymerizing the diallyl phthalate compound in the undercoating layer. The diallyl phthalate compound is in a liquid state and does not require a solvent when performing polymerization. In addition, since a polymerization reaction of the diallyl phthalate compound is a radical polymerization reaction, water or the like is not by-produced in a polymerization reaction system. Therefore, in a case where the liquid of the diallyl phthalate compound in which the charge transporting material is dispersed is used as the binder resin by the polymerization reaction, the undercoating layer is formed without removing the solvent and by-products by heating or the like. As a result, dispersibility of the charge transporting material in the undercoating layer tends to increase. It is considered that, when the dispersibility of the charge transporting material in the undercoating layer is high, it is easy to prevent charge transportability in the undercoating layer from locally deteriorating and the residual potential is prevented from rising even when repeated images are formed.

Hereinafter, the first to third photoreceptors according to the exemplary embodiments will be described with reference to the drawings.

FIG. 1 schematically shows an example of a layer configuration of a photoreceptor according to the exemplary embodiment. A photoreceptor 7A shown in FIG. 1 has a structure in which an undercoating layer 1, a charge generation layer 2, and a charge transport layer 3 are stacked in this order on a conductive substrate 4. The charge generation layer 2 and the charge transport layer 3 form the photosensitive layer 5. The photoreceptor 7A may have a layer configuration in which a protective layer is further provided on the charge transport layer 3.

The photoreceptor according to the exemplary embodiment may be a function-separated type in which the charge generation layer 2 and the charge transport layer 3 are present separatedly as the photoreceptor 7A shown in FIG. 1, and may also be a singlelayer type photosensitive layer in which the charge generation layer 2 and the charge transport layer 3 are integrated.

Hereinafter, the undercoating layer of the first photoreceptor is described in detail.

[Undercoating Layer]

The undercoating layer contains at least one selected from the group consisting of the perinone compound (1) and the perinone compound (2), and polyurethane. The undercoating layer may contain inorganic particles and other additives.

Perinone Compound (1) and Perinone Compound (2)

The undercoating layer contains at least one selected from the group consisting of the perinone compound (1) and the perinone compound (2), and polyurethane. The perinone compound (1) is a compound represented by Formula (1) shown below. The perinone compound (2) is a compound represented by Formula (2) shown below.

Formula (1)

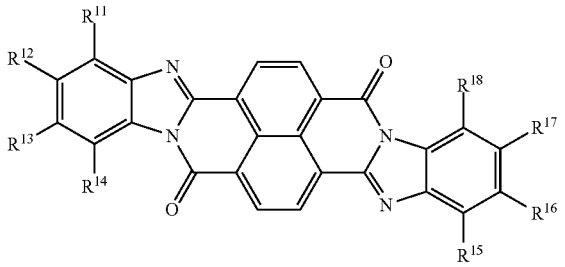

-continued

Formula (2)

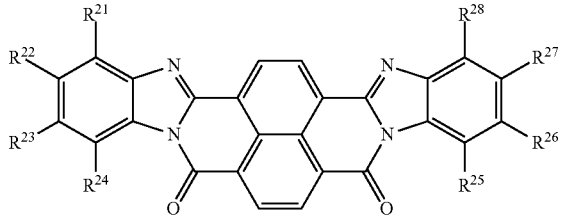

In Formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom. $R^{11}$ and $R^{12}$ may be linked to each other to form a ring, $R^{12}$ and $R^{13}$ may be linked to each other to form a ring, $R^{13}$ and $R^{14}$ may be linked to each other to form a ring. $R^{15}$ and $R^{16}$ may be linked to each other to form a ring, $R^{16}$ and $R^{17}$ may be linked to each other to form a ring, and $R^{17}$ and $R^{18}$ may be linked to each other to form a ring.

In Formula (2), $R^{21}$, $R^{22}$, $R^{23}$, $R^{24}$, $R^{25}$, $R^{26}$, $R^{27}$, $R^{28}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom. $R^{21}$ and $R^{22}$ may be linked to each other to form a ring, $R^{22}$ and $R^{23}$ may be linked to each other to form a ring, $R^{23}$ and $R^{24}$ may be linked to each other to form a ring. $R^{25}$ and $R^{26}$ may be linked to each other to form a ring, $R^{26}$ and $R^{27}$ may be linked to each other to form a ring, and $R^{27}$ and $R^{28}$ may be linked to each other to form a ring.

Examples of the alkyl groups represented by $R^{11}$ to $R^{18}$ in Formula (1) include a substituted or unsubstituted alkyl group.

Examples of the unsubstituted alkyl groups represented by $R^{11}$ to $R^{18}$ in Formula (1) include a linear alkyl group having 1 to 20 carbon atoms (preferably having 1 to 10 carbon atoms and more preferably having 1 to 6 carbon atoms), a branched alkyl group having 3 to 20 carbon atoms (preferably having 3 to 10 carbon atoms), and a cyclic alkyl group having 3 to 20 carbon atoms (preferably having 3 to 10 carbon atoms).

Examples of the linear alkyl group having 1 to 20 include a methyl group, an ethyl group, a n-propyl group, a n-butyl group, a n-pentyl group, a n-hexyl group, a n-heptyl group, a n-octyl group, a n-nonyl group, a n-decyl group, a n-undecyl group, a n-dodecyl group, a tridecyl group, a n-tetradecyl group, a n-pentadecyl group, a n-heptadecyl group, a n-octadecyl group, n-nonadecyl group, and a n-icosyl group.

Examples of the branched alkyl group having 3 to 20 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isododecyl group, a sec-dodecyl group, a tert-dodecyl group, a tert-tetradecyl group, and a tert-pentadecyl group.

Examples of the cyclic alkyl group having 3 to 20 carbon atoms include a cyclopropyl group, a cyclobutyl group, a cyclopentyl group, a cyclohexyl group, a cycloheptyl group, a cyclooctyl group, a cyclononyl group, and a cyclodecyl group, and a polycyclic (for example, bicyclic, tricyclic, or spirocyclic) alkyl group in which these monocyclic alkyl groups are linked.

Among the above groups, as the unsubstituted alkyl group, linear alkyl groups such as the methyl group and the ethyl group are preferable.

Examples of a substituent which the alkyl group may have include an alkoxy group, a hydroxy group, a carboxy group, a nitro group, and a halogen atom (such as a fluorine atom, a bromine atom, and an iodine atom).

Examples of the alkoxy group which substitutes a hydrogen atom contained in the alkyl group include the same groups as the unsubstituted alkoxy groups represented by $R^{11}$ to $R^{18}$ in Formula (1).

Examples of the alkyl groups represented by $R^{11}$ to $R^{18}$ in Formula (1) include a substituted or unsubstituted alkoxy group.

Examples of the unsubstituted alkoxy groups represented by $R^{11}$ to $R^{18}$ in Formula (1) include a linear, branched, or cyclic alkyl group having 1 to 10 (preferably 1 to 6 and more preferably 1 to 4) carbon atoms.

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, and a n-decyloxy group. Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Specific examples of the cyclic alkoxy group include a cyclopropoxy group, a cyclobutoxy group, a cyclopentyloxy group, a cyclohexyloxy group, a cycloheptyloxy group, a cyclooctyloxy group, a cyclononyloxy group, and a cyclodecyloxy group.

Among these groups, as the unsubstituted alkoxy group, the linear alkoxy group is preferable.

Examples of a substituent which the alkoxy group may have include an aryl group, an alkoxycarbonyl group, an aryloxycarbonyl group, a hydroxyl group, a carboxy group, a nitro group, and a halogen atom (such as a fluorine atom, a bromine atom, and an iodine atom).

Examples of the aryl group which substitutes a hydrogen atom contained in the alkoxy group include the same groups as the unsubstituted aryl groups represented by $R^{11}$ to $R^{18}$ in Formula (1).

Examples of the alkoxycarbonyl group which substitutes a hydrogen atom contained in the alkoxy group include the same groups as the unsubstituted alkoxycarbonyl groups represented by $R^{11}$ to $R^{18}$ in Formula (1).

Examples of the aryloxycarbonyl group which substitutes a hydrogen atom contained in the alkoxy group include the same groups as the unsubstituted aryloxycarbonyl groups represented by $R^{11}$ to $R^{18}$ in Formula (1).

Examples of the aralkyl groups represented by $R^{11}$ to $R^{18}$ in Formula (1) include a substituted or unsubstituted aralkyl group.

The unsubstituted aralkyl groups represented by $R^{11}$ to $R^{18}$ in Formula (1) are preferably an aralkyl group having 7 to 30 carbon atoms, more preferably an aralkyl group having 7 to 16 carbon atoms, and still more preferably an aralkyl group having 7 to 12 carbon atoms.

Examples of the unsubstituted aralkyl group having 7 to 30 carbon atoms include a benzyl group, a phenylethyl group, a phenylpropyl group, a 4-phenylbutyl group, a phenylpentyl group, a phenylhexyl group, a phenylheptyl group, a phenyloctyl group, a phenylnonyl group, a naphthylmethyl group, a naphthylethyl group, an anthrylmethyl group, and a phenyl-cyclopentylmethyl group.

Examples of a substituent which the aralkyl group may have include an alkoxy group, an alkoxycarbonyl group, an aryloxycarbonyl group, and a halogen atom (such as a fluorine atom, a bromine atom, and an iodine atom).

Examples of the alkoxy group which substitutes a hydrogen atom contained in the aralkyl group include the same groups as the unsubstituted alkoxy groups represented by $R^{11}$ to $R^{18}$ in Formula (1).

Examples of the alkoxycarbonyl group which substitutes a hydrogen atom contained in the aralkyl group include the same groups as the unsubstituted alkoxycarbonyl groups represented by $R^{11}$ to $R^{18}$ in Formula (1).

Examples of the aryloxycarbonyl group which substitutes a hydrogen atom contained in the aralkyl group include the same groups as the unsubstituted aryloxycarbonyl groups represented by $R^{11}$ to $R^{18}$ in Formula (1).

Examples of the aryl groups represented by $R^{11}$ to $R^{18}$ in Formula (1) include a substituted or unsubstituted aryl group.

The unsubstituted aryl groups represented by $R^{11}$ to $R^{18}$ in Formula (1) are preferably an aryl group having 6 to 30 carbon atoms, more preferably an aryl group having 6 to 14 carbon atoms, and still more preferably an aryl group having 6 to 10 carbon atoms.

Examples of the aryl group having 6 to 30 carbon atoms include a phenyl group, a biphenyl group, a 1-naphthyl group, a 2-naphthyl group, a 9-anthryl group, a 9-phenanthryl group, a 1-pyrenyl group, a 5-naphthacenyl group, a 1-indenyl group, a 2-azulenyl group, a 9-fluorenyl group, a biphenylenyl group, an indacenyl group, a fluoranthenyl group, an acenaphthylenyl group, an aceanthrylenyl group, a phenalenyl group, a fluorenyl group, an anthryl group, a bianthracenyl group, a teranthracenyl group, a quater anthracenyl group, an anthraquinolyl group, a phenanthryl group, a triphenylenyl group, a pyrenyl group, a chrysenyl group, a naphthacenyl group, a preadenyl group, a picenyl group, a perylenyl group, a pentaphenyl group, a pentacenyl group, a tetraphenylenyl group, a hexaphenyl group, a hexacenyl group, a rubicenyl group, and a coronenyl group. Among the above groups, a phenyl group is preferable.

Examples of a substituent which the aryl group may have include an alkyl group, an alkoxy group, an alkoxycarbonyl group, an aryloxycarbonyl group, and a halogen atom (such as a fluorine atom, a bromine atom, and an iodine atom).

Examples of the alkyl group which substitutes a hydrogen atom contained in the aryl group include the same groups as the unsubstituted alkyl groups represented by $R^{11}$ to $R^{18}$ in Formula (1).

Examples of the alkoxy group which substitutes a hydrogen atom contained in the aryl group include the same groups as the unsubstituted alkoxy groups represented by $R^{11}$ to $R^{18}$ in Formula (1).

Examples of the alkoxycarbonyl group which substitutes a hydrogen atom contained in the aryl group include the same groups as the unsubstituted alkoxycarbonyl groups represented by $R^{11}$ to $R^{18}$ in Formula (1).

Examples of the aryloxycarbonyl group which substitutes a hydrogen atom contained in the aryl group include the same groups as the unsubstituted aryloxycarbonyl groups represented by $R^{11}$ to $R^{18}$ in Formula (1).

Examples of the aryloxy groups (—O—Ar, where Ar represents an aryl group) represented by $R^{11}$ to $R^{18}$ in Formula (1) include a substituted or unsubstituted aryloxy group.

The unsubstituted aryloxy groups represented by $R^{11}$ to $R^{18}$ in Formula (1) are preferably an aryloxy group having 6 to 30 carbon atoms, more preferably an aryloxy group having 6 to 14 carbon atoms, and still more preferably an aryloxy group having 6 to 10 carbon atoms.

Examples of the aryloxy group having 6 to 30 carbon atoms include a phenyloxy group (a phenoxy group), a biphenyloxy group, a 1-naphthyloxy group, a 2-naphthyloxy group, a 9-anthryloxy group, a 9-phenanthryloxy group, a 1-pyrenyloxy group, a 5-naphthacenyloxy group, a 1-indenyloxy group, a 2-azulenyloxy group, a 9-fluorenyloxy group, a biphenylenyloxy group, an indacenyloxy group, a fluoranthenyloxy group, an acenaphthylenyloxy group, an aceanthrylenyloxy group, a phenalenyloxy group, a fluorenyloxy group, an anthryloxy group, a bianthracenyloxy group, a teranthracenyloxy group, a quateranthracenyloxy group, an anthraquinolyloxy group, a phenanthryloxy group, a triphenylenyloxy group, a pyrenyloxy group, a chrysenyloxy group, a naphthacenyloxy group, a preadenyloxy group, a picenyloxy group, a perylenyloxy group, a pentaphenyloxy group, a pentacenyloxy group, a tetraphenylenyloxy group, a hexaphenyloxy group, a hexacenyloxy group, a rubicenyloxy group, and a coronenyloxy group. Among the above groups, the phenyloxy group (phenoxy group) is preferable.

Examples of a substituent which the aryloxy group may have include an alkyl group, an alkoxycarbonyl group, an aryloxycarbonyl group, and a halogen atom (such as a fluorine atom, a bromine atom, and an iodine atom).

Examples of the alkyl group which substitutes a hydrogen atom contained in the aryloxy group include the same groups as the unsubstituted alkyl groups represented by $R^{11}$ to $R^{18}$ in Formula (1).

Examples of the alkoxycarbonyl group which substitutes a hydrogen atom contained in the aryloxy group include the same groups as the unsubstituted alkoxycarbonyl groups represented by $R^{11}$ to $R^{18}$ in Formula (1).

Examples of the aryloxycarbonyl group which substitutes a hydrogen atom contained in the aryloxy group include the same groups as the unsubstituted aryloxycarbonyl groups represented by $R^{11}$ to $R^{18}$ in Formula (1).

Examples of the alkoxycarbonyl groups (—CO—OR, where R represents an alkyl group) represented by $R^{11}$ to $R^{18}$ in Formula (1) include a substituted or unsubstituted alkoxycarbonyl group.

In the unsubstituted alkoxycarbonyl groups represented by to $R^{11}$ in Formula (1), the number of carbon atoms in an alkyl chain is preferably 1 to 20, more preferably 1 to 15, and still more preferably 1 to 10.

Examples of the alkoxycarbonyl group having 1 to 20 carbon atoms in an alkyl chain include a methoxycarbonyl group, an ethoxycarbonyl group, a propoxycarbonyl group, an isopropoxycarbonyl group, a n-butoxycarbonyl group, a sec-butoxybutylcarbonyl group, a tert-butoxycarbonyl group, a pentyloxycarbonyl group, a hexyloxycarbonyl group, a heptaoxycarbonyl group, an octaoxycarbonyl group, a nonaoxycarbonyl group, a decaoxycarbonyl group, a dodecaoxycarbonyl group, a tridecaoxycarbonyl group, a tetradecaoxycarbonyl group, a pentadecaoxycarbonyl group, a hexadecaoxycarbonyl group, a heptadecaoxycarbonyl group, an octadecaoxycarbonyl group, a nonadecaoxycarbonyl group, and an eicosaoxycarbonyl group.

Examples of a substituent which the alkoxycarbonyl group may have include an aryl group, a hydroxy group, and a halogen atom (such as a fluorine atom, a bromine atom, and an iodine atom).

Examples of the aryl group which substitutes a hydrogen atom contained in the alkoxycarbonyl group include the same groups as the unsubstituted aryl groups represented by $R^{11}$ to $R^{18}$ in Formula (1).

Examples of the aryloxycarbonyl groups (—CO—OAr, where Ar represents an aryl group) represented by $R^{11}$ to $R^{18}$ in Formula (1) include a substituted or unsubstituted aryloxycarbonyl group.

In the unsubstituted aryloxycarbonyl groups represented by $R^{11}$ to $R^{18}$ in Formula (1), the number of carbon atoms of the aryl group is preferably 6 to 30, more preferably 6 to 14, and still more preferably 6 to 10.

Examples of the aryloxycarbonyl group including an aryl group having 6 to 30 carbon atoms include a phenoxycarbonyl group, a biphenyloxycarbonyl group, a 1-naphthyloxycarbonyl group, a 2-naphthyloxycarbonyl group, a 9-anthryloxycarbonyl group, a 9-phenanthryloxycarbonyl group, a 1-pyrenyloxycarbonyl group, a 5-naphthacenyloxycarbonyl group, a 1-indenyloxycarbonyl group, a 2-azulenyloxycarbonyl group, a 9-fluorenyloxycarbonyl group, a biphenylenyloxycarbonyl group, an indacenyloxycarbonyl group, a fluoranthenyloxycarbonyl group, an acenaphthylenyloxycarbonyl group, an aceanthrylenyloxycarbonyl group, a phenalenyloxycarbonyl group, a fluorenyloxycarbonyl group, an anthryloxycarbonyl group, a bianthracenyloxycarbonyl group, a teranthracenyloxycarbonyl group, a quateranthracenyloxycarbonyl group, an anthraquinolyloxycarbonyl group, a phenanthryloxycarbonyl group, a triphenylenyloxycarbonyl group, a pyrenyloxycarbonyl group, a chrysenyloxycarbonyl group, a naphthacenyloxycarbonyl group, a preadenyloxycarbonyl group, a picenyloxycarbonyl group, a perylenyloxycarbonyl group, a pentaphenyloxycarbonyl group, a pentacenyloxy carbonyl group, a tetraphenylenyloxycarbonyl group, a hexaphenyloxycarbonyl group, a hexacenyloxycarbonyl group, a rubicenyloxycarbonyl group, and a coronenyloxycarbonyl group. Among the above groups, the phenoxycarbonyl group is preferable.

Examples of a substituent which the aryloxycarbonyl group may have include an alkyl group, a hydroxy group, and a halogen atom (such as a fluorine atom, a bromine atom, and an iodine atom).

Examples of the alkyl group which substitutes a hydrogen atom contained in the aryloxycarbonyl group include the same groups as the unsubstituted alkyl groups represented by $R^{11}$ to $R^{18}$ in Formula (1).

Examples of the alkoxycarbonyl alkyl groups (—($C_nH_{2n}$)—CO—OR, where R represents an alkyl group and n represents an integer of 1 or more) represented by $R^{11}$ to $R^{18}$ in Formula (1) include a substituted or unsubstituted alkoxycarbonyl alkyl group.

Examples of the alkoxycarbonyl group (—CO—OR) in the unsubstituted alkoxycarbonyl alkyl group represented by $R^{11}$ to $R^{18}$ in Formula (1) include the same groups as the alkoxycarbonyl groups represented by $R^{11}$ to $R^{18}$ in Formula (1).

Examples of an alkylene chain (—$C_nH_{2n}$) in the unsubstituted alkoxycarbonyl alkyl group represented by $R^{11}$ to $R^{18}$ in Formula (1) include a linear alkylene chain having 1 to 20 carbon atoms (preferably having 1 to 10 carbon atoms and more preferably having 1 to 6 carbon atoms), a branched alkylene chain having 3 to 20 carbon atoms (preferably having 3 to 10 carbon atoms), and a cyclic alkylene chain having 3 to 20 carbon atoms (preferably having 3 to 10 carbon atoms).

Examples of the linear alkylene chain having 1 to 20 carbon atoms include a methylene group, an ethylene group, a n-propylene group, a n-butylene group, a n-pentylene group, a n-hexylene group, a n-heptylene group, a n-octylene group, a n-nonylene group, a n-decylene group, a n-undecylene group, a n-dodecylene group, a tridecylene group, a n-tetradecylene group, a n-pentadecylene group, a n-heptadecylene group, a n-octadecylene group, n-nonadecylene group, and a n-icosylene group.

Examples of the branched alkylene chain having 3 to 20 carbon atoms include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isododecylene group, sec-dodecylene group, a tert-dodecylene group, a tert-tetradecylene group, and a tert-pentadecylene group.

Examples of the cyclic alkylene group having 3 to 20 carbon atoms include a cyclopropylene group, a cyclobutylene group, a cyclopentylene group, a cyclohexylene group, a cycloheptylene group, a cyclooctylene group, a cyclononylene group, and a cyclodecylene group.

Examples of a substituent which the alkoxycarbonyl alkyl group may have include an aryl group, a hydroxy group, and a halogen atom (such as a fluorine atom, a bromine atom, and an iodine atom).

Examples of the aryl group which substitutes a hydrogen atom contained in the alkoxycarbonyl alkyl group include the same groups as the unsubstituted aryl groups represented by $R^{11}$ to $R^{18}$ in Formula (1).

Examples of the aryloxycarbonyl alkyl groups (—$(C_nH_{2n})$—CO—OAr, where Ar represents an aryl group and n represents an integer of 1 or more) represented by $R^{11}$ to $R^{18}$ in Formula (1) include a substituted or unsubstituted aryloxycarbonyl alkyl group.

Examples of the aryloxycarbonyl group (—CO—OAr, where Ar represents an aryl group) in the unsubstituted aryloxycarbonyl alkyl group represented by $R^{11}$ to $R^{18}$ in Formula (1) include the same groups as the aryloxycarbonyl groups represented by $R^{11}$ to $R^{18}$ in Formula (1).

Examples of the alkylene chain (—$C_nH_{2n}$—) in the unsubstituted aryloxycarbonyl alkyl group represented by $R^{11}$ to $R^{18}$ in Formula (1) include the same groups as the alkylene chains in the alkoxycarbonyl alkyl groups represented by $R^{11}$ to $R^{18}$ in Formula (1).

Examples of a substituent which the aryloxycarbonyl alkyl group may have include an alkyl group, a hydroxy group, and a halogen atom (such as a fluorine atom, a bromine atom, and an iodine atom).

Examples of the alkyl group which substitutes a hydrogen atom contained in the aryloxycarbonyl alkyl group include the same groups as the unsubstituted alkyl groups represented by $R^{11}$ to $R^{18}$ in Formula (1).

Examples of the halogen atom represented by $R^{11}$ to $R^{18}$ in Formula (1) include a fluorine atom, a chlorine atom, a bromine atom, and an iodine atom.

Examples of a ring, that $R^{11}$ and $R^{12}$, $R^{12}$ and $R^{13}$, $R^{13}$ and $R^{14}$, $R^{15}$ and $R^{16}$, $R^{16}$ and $R^{17}$, or $R^{17}$ and $R^{18}$ in Formula (1) are linked to each other to form, include a benzene ring and a condensed ring having 10 to 18 carbon atoms (such as a naphthalene ring, an anthracene ring, a phenanthrene ring, a chrysene ring (a benzo [α] phenanthrene ring), a tetracene ring, a tetraphene ring (a benzo [α] anthracene ring), and a triphenylene ring). Among the above structures, as the structure of the ring to be formed, the benzene ring is preferable.

Examples of the alkyl groups represented by $R^{21}$ to $R^{28}$ in Formula (2) include the same groups as the alkyl groups represented by $R^{11}$ to $R^{18}$ in Formula (1).

Examples of the alkoxy groups represented by $R^{21}$ to $R^{28}$ in Formula (2) include the same groups as the alkoxy groups represented by $R^{11}$ to $R^{18}$ in Formula (1).

Examples of the aralkyl groups represented by $R^{21}$ to $R^{28}$ in Formula (2) include the same groups as the aralkyl groups represented by $R^{11}$ to $R^{18}$ in Formula (1).

Examples of the aryl groups represented by $R^{21}$ to $R^{28}$ in Formula (2) include the same groups as the aryl groups represented by $R^{11}$ to $R^{18}$ in Formula (1).

Examples of the aryloxy groups represented by $R^{21}$ to $R^{28}$ in Formula (2) include the same groups as the aryloxy groups represented by $R^{11}$ to $R^{18}$ in Formula (1).

Examples of the alkoxycarbonyl groups represented by $R^{21}$ to $R^{28}$ in Formula (2) include the same groups as the alkoxycarbonyl groups represented by $R^{11}$ to $R^{18}$ in Formula (1).

Examples of the aryloxycarbonyl groups represented by $R^{21}$ to $R^{28}$ in Formula (2) include the same groups as the aryloxycarbonyl groups represented by $R^{11}$ to $R^{18}$ in Formula (1).

Examples of the alkoxycarbonyl alkyl groups represented by $R^{21}$ to $R^{28}$ in Formula (2) include the same groups as the alkoxycarbonyl alkyl groups represented by $R^{11}$ to $R^{18}$ in Formula (1).

Examples of the aryloxycarbonyl alkyl groups represented by $R^{21}$ to $R^{28}$ in Formula (2) include the same groups as the aryloxycarbonyl alkyl groups represented by $R^{1}$ to $R^{18}$ in Formula (1).

Examples of the halogen atoms represented by $R^{21}$ to $R^{28}$ in Formula (2) include the same atoms as the halogen atom represented by $R^{11}$ to $R^{18}$ in Formula (1).

Examples of a ring, that $R^{21}$ and $R^{22}$, $R^{22}$ and $R^{23}$, $R^{23}$ and $R^{24}$, $R^{25}$ and $R^{26}$, $R^{26}$ and $R^{27}$, or $R^{27}$ and $R^{28}$ in Formula (2) are linked to each other to form, include a benzene ring and a condensed ring having 10 to 18 carbon atoms (such as a naphthalene ring, an anthracene ring, a phenanthrene ring, a chrysene ring (a benzo [α] phenanthrene ring), a tetracene ring, a tetraphene ring (a benzo [α] anthracene ring), and a triphenylene ring). Among the above structures, as the structure of the ring to be formed, the benzene ring is preferable.

From the viewpoint of preventing the deterioration of the photosensitivity and the rise in the residual potential when images are repeatedly formed, $R^{11}$, $R^{12}$, $R^{13}$, $R^{14}$, $R^{15}$, $R^{16}$, $R^{17}$ and $R^{18}$ in Formula (1) are each independently preferably a hydrogen atom, an alkyl group, an alkoxycarbonyl group, an aryloxycarbonyl group, an alkoxycarbonyl alkyl group, or an aryloxycarbonyl alkyl group.

From the viewpoint of preventing the deterioration of the photosensitivity and the rise of the residual potential, which occur when images are repeatedly formed, $R^{21}$, $R^{22}$, $R^{23}$, $R^{24}$, $R^{25}$, $R^{26}$, $R^{27}$, and $R^{28}$ in Formula (2) are each independently preferably a hydrogen atom, an alkyl group, an alkoxycarbonyl group, an aryloxycarbonyl group, an alkoxycarbonyl alkyl group, or an aryloxycarbonyl alkyl group.
Hereinafter, specific examples of the perinone compound (1) and the perinone compound (2) are shown, but are not limited thereto. In formulas shown below, Ph represents a phenyl group.
1-1
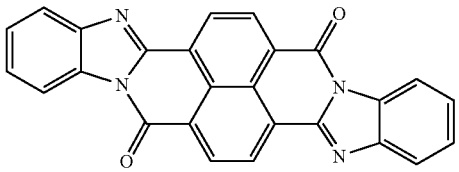
1-2
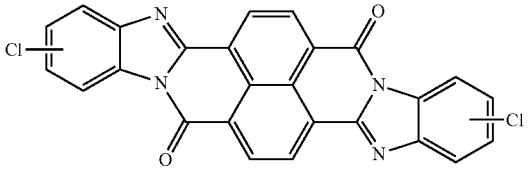
1-3
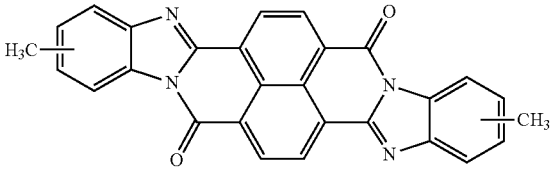
1-4
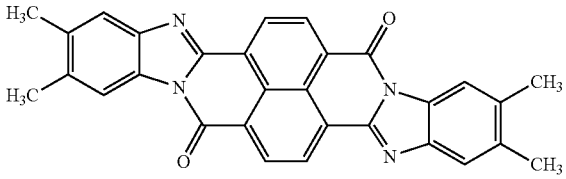
1-5
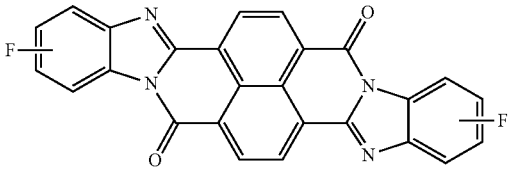
1-6
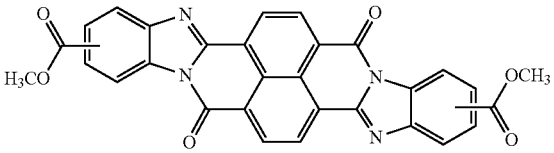
1-7
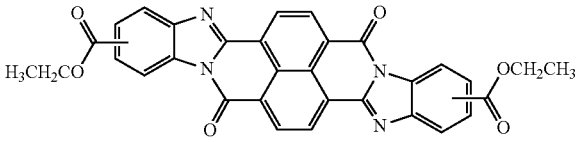
-continued
1-8
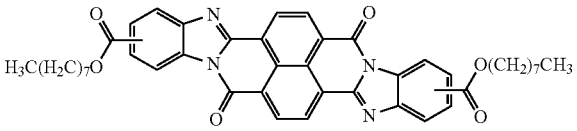
1-9
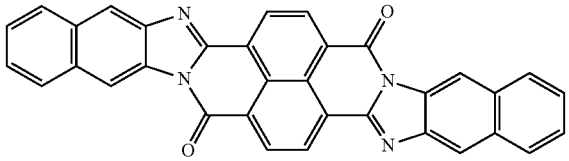
1-10
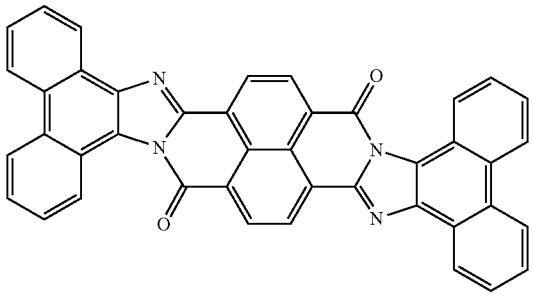
1-11
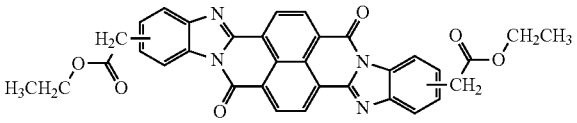
1-12
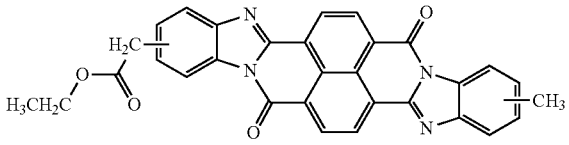
1-13
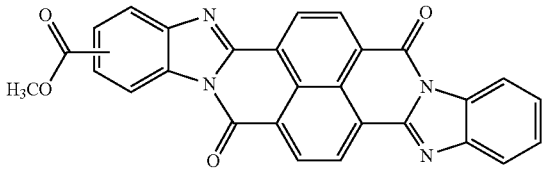
1-14
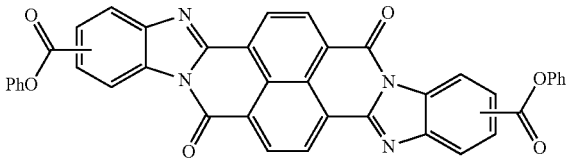
1-15
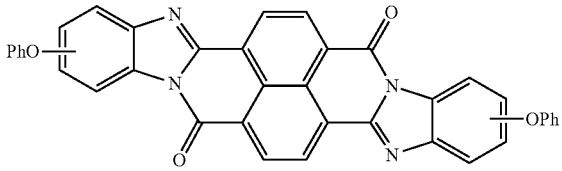

-continued
1-16
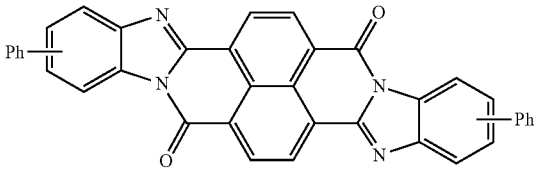
1-17
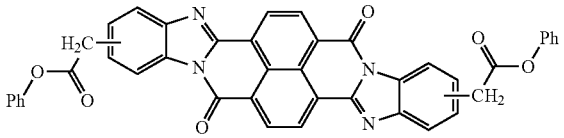
1-18
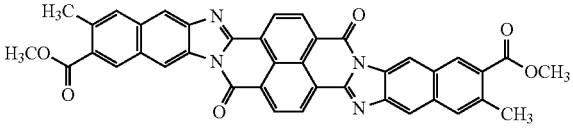
2-1
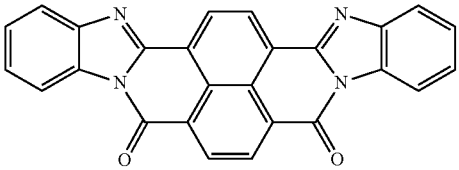
2-2
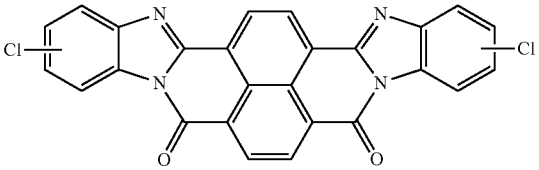
2-3
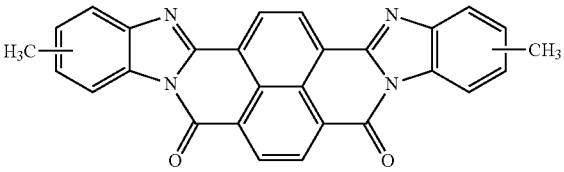
2-4
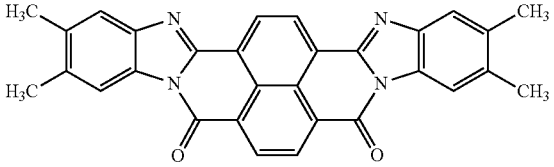
2-5
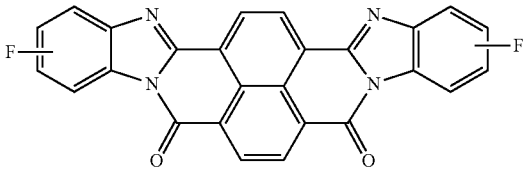
-continued
2-6
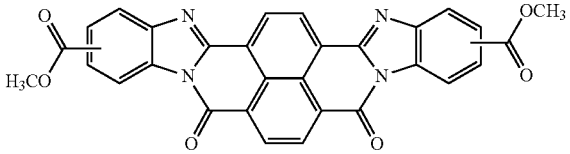
2-7
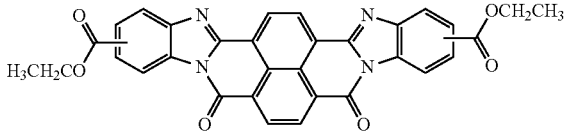
2-8
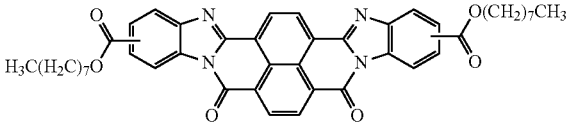
2-9
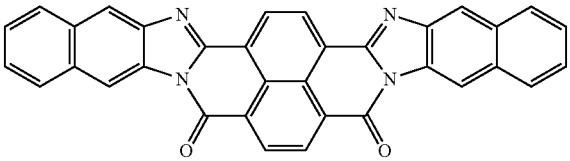
2-10
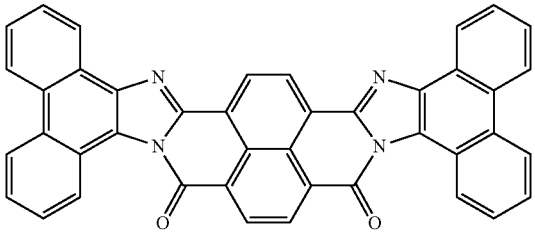
2-11
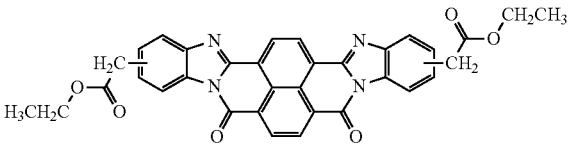
2-12
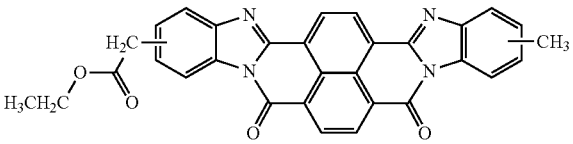
2-13
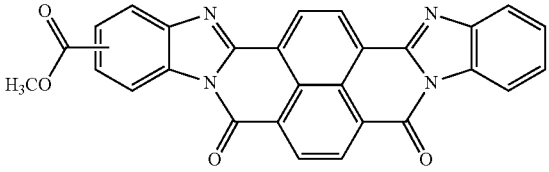

-continued 2-14

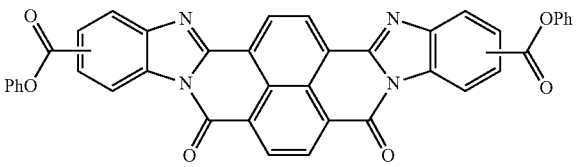

2-15

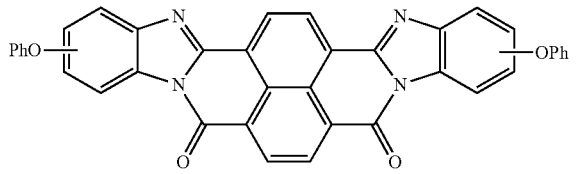

2-16

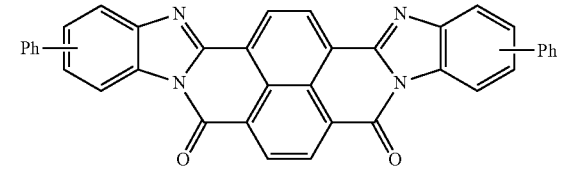

2-17

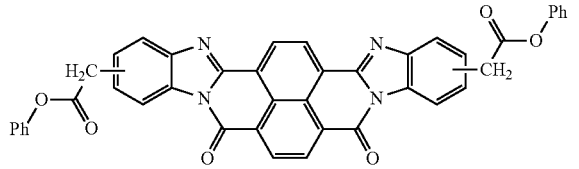

2-18

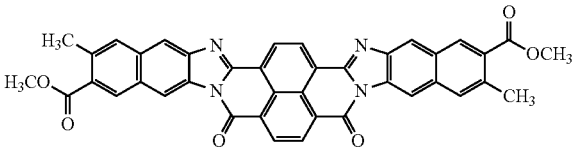

The perinone compound (1-1) and the perinone compound (2-1) are in the relationship of isomers (relationship between a cis form and a trans form). Therefore, in accordance with a synthesis method, a mixture of both compounds tends to be obtained, and a mixing ratio thereof is usually 1:1. With respect to the mixture of the perinone compound (1-1) and the perinone compound (2-1), one of the compounds may be purified from the mixture according to a known purification method. Other perinone compounds in the relationship between the cis form and the trans form have the same relationship as above.

From the viewpoints of controlling volume resistivity of the undercoating layer so as to provide a volume resistivity falling within the preferable range described later and obtaining film formability, a total content of the perinone compound (1) and the perinone compound (2) with respect to the total solid content of the undercoating layer is preferably from 30% by weight to 90% by weight, more preferably from 40% by weight to 80% by weight, and still more preferably from 50% by weight to 70% by weight.

Polyurethane

In general, polyurethane is synthesized by a polyaddition reaction of polyfunctional isocyanate and polyol.

Examples of the polyfunctional isocyanate include diisocyanate such as methylene diisocyanate, ethylene diisocyanate, isophorone diisocyanate, hexamethylene diisocyanate, 1,4-cyclohexane diisocyanate, 2,4-toluene diisocyanate, 2,6-toluene diisocyanate, 1,3-xylylene diisocyanate, 1,5-naphthalene diisocyanate, m-phenylene diisocyanate, p-phenylene diisocyanate, 3,3'-dimethyl-4,4'-diphenylmethane diisocyanate, 3,3'-dimethylbiphenylene diisocyanate, 4,4'-biphenylene diisocyanate, dicyclohexylmethane diisocyanate, and methylene bis (4-cyclohexyl isocyanate); isocyanurate obtained by trimerizing the isocyanates; and blocked isocyanate obtained by blocking isocyanate groups of the diisocyanate with a blocking agent. One kind of the polyfunctional isocyanates may be used alone and two or more kinds thereof may be used in combination.

Examples of the polyol include diols such as ethylene glycol, 1,2-propanediol, 1,3-propanediol, 1,2-butanediol, 1,3-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, tripropylene glycol, polyethylene glycol, polypropylene glycol, poly (oxytetramethylene) glycol, 4,4'-dihydroxy-diphenyl-2,2-propane, and 4,4'-dihydroxyphenyl sulfone.

Examples of the polyol further include polyester polyol, polycarbonate polyol, polycaprolactone polyol, polyether polyol, and polyvinyl butyral.

One kind of the polyols may be used alone and two or more kinds thereof may be used in combination.

The undercoating layer may further contain other resins, in addition to the polyurethane, as a binder resin.

Examples of the other resins include a polyvinyl alcohol resin, a polyvinyl acetal resin, a casein resin, a polyamide resin, a cellulose resin, a gelatin, polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, an alkyd resin, and an epoxy resin.

In the binder resin contained in the undercoating layer, a content of the polyurethane based on the total amount of the binder resins is preferably from 80% by weight to 100% by weight, more preferably from 90% by weight to 100% by weight, and still more preferably from 95% by weight to 100% by weight.

A weight ratio of the total content of the perinone compound (1) and the perinone compound (2) contained in the undercoating layer and the content of the polyurethane contained in the undercoating layer (Perinone compounds: Polyurethane) is preferably 40:60 to 80:20 and more preferably 50:50 to 70:30.

Organic Acid Metal Salt and Metallo-Organic Complex The undercoating layer may contain at least one of an organic acid metal salt and a metallo-organic complex. At least one of the organic acid metal salt and the metallo-organic complex contained in the undercoating layer may be organic acid metal salt or metallo-organic complex which acts as a urethane curing catalyst (that is, a catalyst for polyaddition reaction of a polyfunctional isocyanate and a polyol) when forming the undercoating layer.

Examples of metal forming the organic acid metal salt or the metallo-organic complex include bismuth, aluminum, zirconium, zinc, cobalt, iron, nickel, copper, tin, platinum, and palladium. An organic acid of the organic acid metal salt is preferably a monovalent carboxylic acid. As the monovalent carboxylic acid, octylic acid, naphthenic acid, or salicylic acid is preferable and octylic acid is more preferable.

From the viewpoint of preventing the rise in the residual potential when images are repeatedly formed, as the at least one of the organic acid metal salt and the metallo-organic complex contained in the undercoating layer, at least one of the organic acid metal salt and the metallo-organic complex each containing a metal selected from the group consisting of bismuth, aluminum, zirconium, zinc, cobalt, iron, nickel, and copper is preferable, and at least one of the organic acid metal salt and the metallo-organic complex each containing a metal selected from the group consisting of bismuth, aluminum, and zirconium is more preferable.

Examples of the organic acid metal salt or the metallo-organic complex containing bismuth include bismuth octylate, bismuth naphthenate, and bismuth salicylate; and K-KAT348, K-KAT XC-C227, K-KAT XK-628, and K-KAT XK-640 which are manufactured by King Industries, Inc.

Examples of the organic acid metal salt or the metallo-organic complex containing aluminum include aluminum octylate, aluminum naphthenate, and aluminum salicylate; and K-KAT 5218 manufactured by King Industries, Inc.

Examples of the organic acid metal salt or the metallo-organic complex containing zirconium include zirconium octylate, zirconium naphthenate, and zirconium salicylate; and K-KAT 4205, K-KAT 6212, and K-KAT A209 which are manufactured by King Industries, Inc.

Examples of the organic acid metal salt or the metallo-organic complex containing zinc include zinc octylate, zinc naphthenate, and zinc salicylate.

Examples of the organic acid metal salt or the metallo-organic complex containing cobalt include cobalt octylate, cobalt naphthenate, and cobalt salicylate.

Examples of the organic acid metal salt or the metallo-organic complex containing iron include iron octylate, iron naphthenate, and iron salicylate.

Examples of the organic acid metal salt or the metallo-organic complex containing nickel include nickel octylate, nickel naphthenate, and nickel salicylate.

Examples of the organic acid metal salt or the metallo-organic complex containing copper include copper octylate, copper naphthenate, and copper salicylate.

Only one kind of the organic acid metal salt or the metallo-organic complex may be used alone and two or more kinds thereof may be used in combination.

In a case where the undercoating layer contains at least one of the organic acid metal salt and the metallo-organic complex, the total content of the organic acid metal salt and the metallo-organic complex with respect to the total solid content of the undercoating layer is preferably from 0.001% by weight to 3% by weight, more preferably from 0.003% by weight to 2% by weight, still more preferably from 0.01% by weight to 1% by weight, and still further preferably from 0.05% by weight to 0.5% by weight.

Metal Oxide Particles

From the viewpoint of preventing leakage attributable to sticking of foreign matter to the photoreceptor, the undercoating layer preferably contains metal oxide particles. Examples of the metal oxide particles include zinc oxide particles, titanium oxide particles, tin oxide particles, and zirconium oxide particles, and zinc oxide particles, the titanium oxide particles, or the tin oxide particles are preferable.

A volume average particle diameter of the metal oxide particles is preferably from 10 nm to 2,000 nm, more preferably from 50 nm to 1,000 nm, and still more preferably from 60 nm to 500 nm.

A specific surface area of the metal oxide particles by a BET method is preferably 10 $m^2/g$ or more.

The metal oxide particles may be subjected to a surface treatment. Examples of a surface treatment agent for the metal oxide particles include a silane coupling agent, a titanate coupling agent, an aluminum coupling agent, and a surfactant. Two or more kinds of the metal oxide particles, which are different kinds, are subjected to different surface treatments, or have different particle diameters, may be mixed to be used.

In a case where the undercoating layer contains the metal oxide particles for the purpose of preventing leakage attributable to sticking of foreign matter to the photoreceptor, a content of the metal oxide particles with respect to the total solid content of the undercoating layer is preferably 1% by weight or more and less than 30% by weight, more preferably from 5% by weight to 25% by weight, and still more preferably from 10% by weight to 20% by weight.

The undercoating layer may contain various additives for improving electrical properties, environmental stability, and image quality.

Examples of the additives include known materials such as an electron transporting pigment such as polycyclic condensation type and azo type, a zirconium chelate compound, a titanium chelate compound, an aluminum chelate compound, a titanium alkoxide compound, an organic titanium compound, and a silane coupling agent. The silane coupling agent is used for a surface treatment of the metal oxide particles as described above, but may be further added to the undercoating layer as an additive.

Examples of the silane coupling agent as the additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, and 3-chloropropyltrimethoxysilane.

Examples of the zirconium chelate compound include zirconium butoxide, zirconium ethyl acetoacetate, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, and polyhydroxy titanium stearate.

Examples of the aluminum chelate compound include aluminum isopropylate, monobutoxy aluminum diisopropylate, aluminum butyrate, diethyl acetoacetate aluminum diisopropylate, and aluminum tris(ethyl acetoacetate).

These additives may be used alone, or as a mixture or polycondensate of plural compounds.

From the viewpoint of leak resistance, a film thickness of the undercoating layer is preferably 3 μm or more and more preferably 5 μm or more. From the viewpoint of preventing the residual potential from rising when used repeatedly, the film thickness of the undercoating layer is preferably 50 μm or less, more preferably 40 μm or less, and still more preferably 30 μm or less.

The volume resistivity of the undercoating layer is preferably from $1\times10^{10}\Omega\cdot$cm to $1\times10^{12}\Omega\cdot$cm.

The undercoating layer suitably has a Vickers hardness of 35 or higher.

In order to prevent a moire fringe, surface roughness (ten-point average roughness) of the undercoating layer may be adjusted from 1/(4n) (n is a refractive index of an upper layer) of the exposure laser wavelength λ to ½ thereof.

In order to adjust the surface roughness, resin particles or the like may be added to the undercoating layer. Examples of the resin particles include silicone resin particles and crosslinked polymethylmethacrylate resin particles. Further, in order to adjust the surface roughness, the surface of the undercoating layer may be polished. Examples of a polishing method include buffing, sandblasting treatment, wet honing, and grinding treatment.

Formation of the undercoating layer is not particularly limited and a known forming method is used. For example, a coating film of an undercoating layer forming coating liquid obtained by adding the above components to a solvent is formed, and the coating film is dried to form the undercoating layer, if desired, by heating.

Examples of the solvent for preparing the undercoating layer forming coating liquid include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Since the perinone compound (1) and the perinone compound (2) are unlikely to dissolve in an organic solvent, it is preferable to disperse the perinone compound (1) and the perinone compound (2) in the organic solvent. Examples of the dispersing method include known methods such as a roll mill, a ball mill, a vibration ball mill, an attritor, a sand mill, a colloid mill, and a paint shaker. In a case where the metal oxide particles are mixed in the undercoating layer, it is preferable to disperse the metal oxide particles in the organic solvent by the same dispersing method.

Examples of a method for applying the undercoating layer forming coating liquid onto the conductive substrate include normal methods such as a blade coating method, a wire bar coating method, a spray coating method, a dipping coating method, a bead coating method, an air knife coating method, and a curtain coating method.

Hereinafter, an undercoating layer of the second photoreceptor is described in detail.

[Undercoating Layer]

The undercoating layer includes at least one perinone compound selected from the group consisting of a compound represented by Formula (1) (a perinone compound (1)) and a compound represented by Formula (2) (a perinone compound (2)), and at least one acceptor compound selected from the group consisting of compounds represented by any one of Formulas (3) to (15). The undercoating layer may further contain a binder resin, inorganic particles, and the like.

The compound represented by Formula (1) and the compound represented by Formula (2) which are used for the second photoreceptor are the same as the compound represented by Formula (1) and the compound represented by Formula (2) which are used for the first photoreceptor described above. The description on the compound represented by Formula (1) and the compound represented by Formula (2) which are used for the first photoreceptor described above may also be applied to the compound represented by Formula (1) and the compound represented by Formula (2) which are used for the second photoreceptor.

Here, from the viewpoint of controlling volume resistivity of the undercoating layer to provide a volume resistivity falling within the preferable range, a total content of the perinone compound (1) and the perinone compound (2) with respect to the total solid content of the undercoating layer is preferably from 50% by weight to 90% by weight, more preferably from 55% by weight to 80% by weight, and still more preferably from 60% by weight to 70% by weight.

Acceptor Compound

The undercoating layer contains at least one acceptor compound selected from the group consisting of a compound represented by Formula (3), a compound represented by Formula (4), a compound represented by Formula (5), a compound represented by Formula (6), a compound represented by Formula (7), a compound represented by Formula (8), a compound represented by Formula (9), a compound represented by Formula (10), a compound represented by Formula (11), a compound represented by Formula (12), a compound represented by Formula (13), a compound represented by Formula (14), and a compound represented by Formula (15) shown below.

Formula (3)

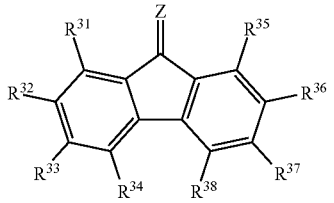

In Formula (3), Z represents $C(COOR_{k1})_2$ (where $R_{k1}$ is a hydrogen atom or an alkyl group), $C(CN)_2$, O (an oxygen atom), or N—CN, $R^{31}$, $R^{32}$, $R^{33}$, $R^{34}$, $R^{35}$, $R^{36}$, $R^{37}$, and $R^{38}$ each independently represent a hydrogen atom, a halogen atom, an alkyl group, an alkoxy group, an aralkyl group, an aryl group, an aryloxy group, a carboxy group, an alkylcarbonyl group, an arylcarbonyl group, an alkoxycarbonyl group, an aryloxycarbonyl group, a nitro group, or a group represented by $—CR_{k2}=CR_{k3}R_{k4}$ (where $R_{k2}$ represents a hydrogen atom or an alkyl group, and $R_{k3}$ and $R_{k4}$ each independently represent a hydrogen atom or a phenyl group, provided that at least one of $R_{k3}$ and $R_{k4}$ represents a phenyl group.).

In $C(COOR_{k1})_2$ in Formula (3), in a case where $R_{k1}$ is an alkyl group, examples of $R_{k1}$ include a linear, branched, or cyclic alkyl group having 1 to 10 (preferably 1 to 6 and more preferably 1 to 4) carbon atoms. Two $R_{k1}$'s in one molecule may be the same as or different from each other. As $R_{k1}$, a hydrogen atom is preferable.

Examples of the halogen atom in Formula (3) include a fluorine atom, a chlorine atom, a bromine atom, and an iodine atom.

Examples of the alkyl group in Formula (3) include a linear, branched, or cyclic alkyl group having 1 to 10 (preferably 1 to 6 and more preferably 1 to 4) carbon atoms. The alkyl group in Formula (3) may also be substituted with a substituent such as a hydroxy group, a carboxy group, a nitro group, and a halogen atom (for example, a fluorine atom, a chlorine atom, a bromine atom, and an iodine atom).

Examples of the alkoxy group in Formula (3) include a linear, branched, or cyclic alkoxy group having 1 to 10 (preferably 1 to 6 and more preferably 1 to 4) carbon atoms. The alkoxy group in Formula (3) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (3) include an aralkyl group having 7 to 20 (preferably 7 to 15 and more preferably 7 to 12) carbon atoms, and specific examples thereof include a benzyl group and a phenethyl group. The aralkyl group in Formula (3) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (3) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (3) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (3) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (3) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the alkylcarbonyl group (—CO—R, where R represents an alkyl group) in Formula (3) include an alkylcarbonyl group that has an alkyl group having 1 to 10 (preferably 1 to 6 and more preferably 1 to 4) carbon atoms. The alkyl group in the alkylcarbonyl group may be linear or branched. The alkyl group in the alkylcarbonyl group may also be substituted with a substituent such as a hydroxy group, a carboxy group, a nitro group, an aryl group, and a halogen atom (for example, a fluorine atom, a chlorine atom, a bromine atom, and an iodine atom).

Examples of the arylcarbonyl group (—CO—Ar, where Ar represents an aryl group) in Formula (3) include an arylcarbonyl group that has an aryl group having 6 to 20 (preferably 6 to 14 and more preferably 6 to 12) carbon atoms. Specific examples of the aryl group in the arylcarbonyl group include a phenyl group, a biphenyl group, a 1-naphthyl group, and a 2-naphthyl group. The aryl group in the arylcarbonyl group may also be substituted with a substituent such as a hydroxy group, a carboxy group, a nitro group, an alkyl group, and a halogen atom (for example, a fluorine atom, a chlorine atom, a bromine atom, and an iodine atom).

Examples of the alkoxycarbonyl group (—CO—OR, where R represents an alkyl group) in Formula (3) include an alkoxycarbonyl group that has an alkyl group having 1 to 10 (preferably 1 to 6 and more preferably 1 to 4) carbon atoms. The alkyl group in the alkoxycarbonyl group may be linear or branched. The alkyl group in the alkoxycarbonyl group may also be substituted with a substituent such as a hydroxy group, a carboxy group, a nitro group, an aryl group, and a halogen atom (for example, a fluorine atom, a chlorine atom, a bromine atom, and an iodine atom).

Examples of the aryloxycarbonyl group (—CO—OAr, where Ar represents an aryl group) in Formula (3) include an aryloxycarbonyl group that has an aryl group having 6 to 20 (preferably 6 to 14 and more preferably 6 to 12) carbon atoms. Specific examples of the aryl group in the aryloxycarbonyl group include a phenyl group, a biphenyl group, a 1-naphthyl group, and a 2-naphthyl group. The aryl group in the aryloxycarbonyl group may also be substituted with a substituent such as a hydroxy group, a carboxy group, a nitro group, an alkyl group, and a halogen atom (for example, a fluorine atom, a chlorine atom, a bromine atom, and an iodine atom).

In the group represented by $—CR_{k2}=CR_{k3}R_{k4}$ in Formula (3), in a case where $R_{k2}$ is an alkyl group, examples of $R_k2$ include a linear, branched, or cyclic alkyl group having 1 to 10 (preferably 1 to 6 and more preferably 1 to 4) carbon atoms.

In Formula (3), Z is preferably $C(CN)_2$ or $C(COOR_{k1})_2$, more preferably $C(CN)_2$ or $C(COOH)_2$, and still more preferably $C(CN)_2$.

In Formula (3), each of $R^{31}$ and $R^{35}$ is preferably a hydrogen atom, a halogen atom, or an alkyl group, and more preferably a hydrogen atom.

In Formula (3), each of $R^{32}$ and $R^{36}$ is preferably a hydrogen atom, a halogen atom, an alkyl group, or a nitro group.

In Formula (3), each of $R^{33}$, $R^{34}$, $R^{37}$, and $R^{38}$ is preferably a hydrogen atom, a halogen atom, an alkyl group, a carboxy group, an alkoxycarbonyl group, or an aryloxycarbonyl group, and at least one of $R^{33}$, $R^{34}$, $R^{37}$, and $R^{38}$ is preferably a carboxy group or an alkoxycarbonyl group.

Acceptor compounds (3-1) to (3-10) are shown below as specific examples of the compound represented by Formula (3), but the examples are not limited thereto.

3-1

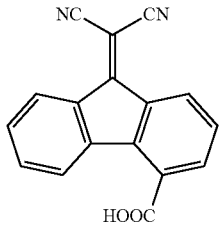

3-2

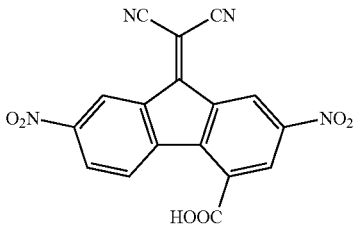

-continued 3-3

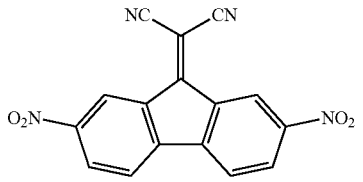

3-4

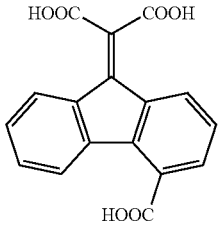

3-5

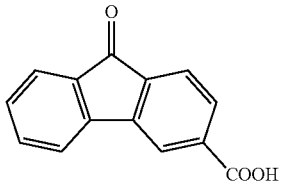

3-6

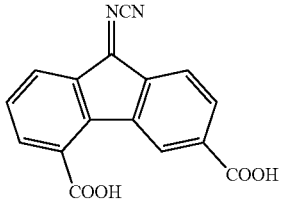

3-7

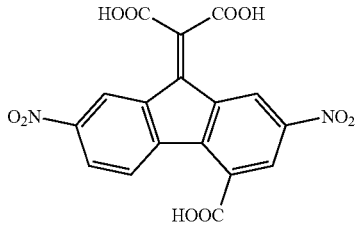

3-8

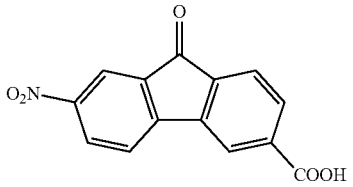

3-9

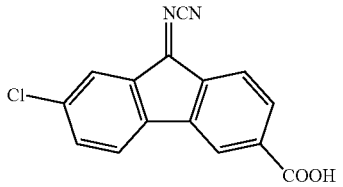

-continued 3-10

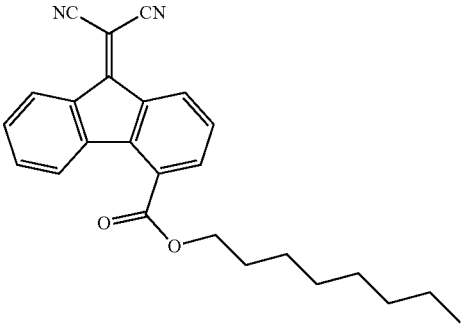

Formula (4)

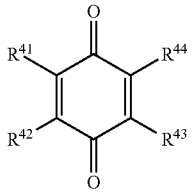

In Formula (4), $R^{41}$, $R^{42}$, $R^{43}$, and $R^{44}$ each independently represent a hydrogen atom, a halogen atom, an alkyl group, an alkoxy group, an aralkyl group, an aryl group, an aryloxy group, a nitro group, a carboxy group, or a hydroxy group.

Examples of the halogen atom in Formula (4) include a fluorine atom, a chlorine atom, a bromine atom, and an iodine atom.

Examples of the alkyl group in Formula (4) include a linear, branched, or cyclic alkyl group having 1 to 10 (preferably 1 to 6 and more preferably 1 to 4) carbon atoms. The alkyl group in Formula (4) may also be substituted with a substituent such as a hydroxy group, a carboxy group, a nitro group, and a halogen atom (for example, a fluorine atom, a chlorine atom, a bromine atom, and an iodine atom).

Examples of the alkoxy group in Formula (4) include a linear, branched, or cyclic alkoxy group having 1 to 10 (preferably 1 to 6 and more preferably 1 to 4) carbon atoms. The alkoxy group in Formula (4) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (4) include an aralkyl group having 7 to 20 (preferably 7 to 15 and more preferably 7 to 12) carbon atoms, and specific examples thereof include a benzyl group and a phenethyl group. The aralkyl group in Formula (4) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (4) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (4) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (4) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (4) may also be substituted with a substituent such as a hydroxy group, a carboxy group, a nitro group, an alkyl group, and a halogen atom (for example, a fluorine atom, a chlorine atom, a bromine atom, and an iodine atom).

Among $R^{41}$, $R^{42}$, $R^{43}$, and $R^{44}$ in Formula (4), it is preferable that two or three groups are hydrogen atoms, and it is more preferable that two groups are hydrogen atoms.

Acceptor compounds (4-1) to (4-10) are shown below as specific examples of the compound represented by Formula (4), but the examples are not limited thereto.

4-1

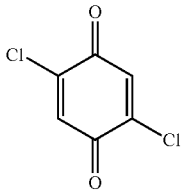

4-2

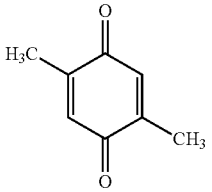

4-3

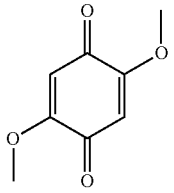

4-4

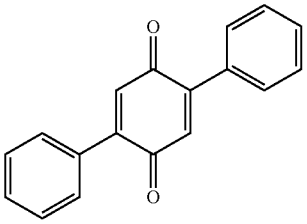

4-5

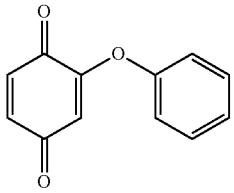

4-6

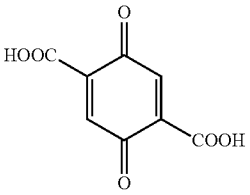

-continued 4-7

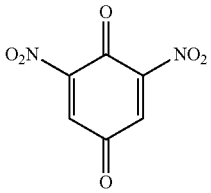

4-8

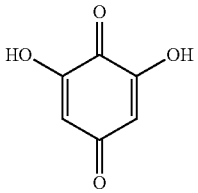

4-9

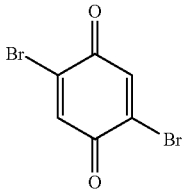

4-10

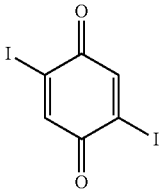

Formula (5)

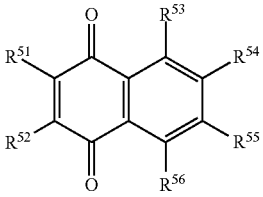

In Formula (5), $R^{51}$, $R^{52}$, $R^{53}$, $R^{54}$, $R^{55}$, and $R^{56}$ each independently represent a hydrogen atom, a halogen atom, an alkyl group, an alkoxy group, an aralkyl group, an aryl group, an aryloxy group, a nitro group, a carboxy group, or a hydroxy group.

Examples of the halogen atom in Formula (5) include a fluorine atom, a chlorine atom, a bromine atom, and an iodine atom.

Examples of the alkyl group in Formula (5) include a linear, branched, or cyclic alkyl group having 1 to 10 (preferably 1 to 6 and more preferably 1 to 4) carbon atoms. The alkyl group in Formula (5) may also be substituted with a substituent such as a hydroxy group, a carboxy group, a nitro group, and a halogen atom (for example, a fluorine atom, a chlorine atom, a bromine atom, and an iodine atom).

Examples of the alkoxy group in Formula (5) include a linear, branched, or cyclic alkoxy group having 1 to 10 (preferably 1 to 6 and more preferably 1 to 4) carbon atoms. The alkoxy group in Formula (5) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (5) include an aralkyl group having 7 to 20 (preferably 7 to 15 and more preferably 7 to 12) carbon atoms, and specific examples thereof include a benzyl group and a phenethyl group. The aralkyl group in Formula (5) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (5) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (5) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (5) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (5) may also be substituted with a substituent such as a hydroxy group, a carboxy group, a nitro group, an alkyl group, and a halogen atom (for example, a fluorine atom, a chlorine atom, a bromine atom, and an iodine atom).

In Formula (5), each of $R^{51}$ and $R^{52}$ is preferably a hydrogen atom, a halogen atom, an alkyl group, an alkoxy group, an aryl group, an aryloxy group, a nitro group, a carboxy group, or a hydroxy group.

In Formula (5), each of $R^{53}$ and $R^{56}$ is preferably a hydrogen atom, a halogen atom, or an alkyl group, and more preferably a hydrogen atom.

In Formula (5), each of $R^{54}$ and $R^{55}$ is preferably a hydrogen atom, a halogen atom, an alkyl group, or a carboxy group.

Acceptor compounds (5-1) to (5-10) are shown below as specific examples of the compound represented by Formula (5), but the examples are not limited thereto.

5-1

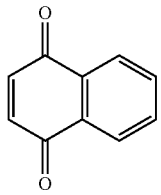

5-2

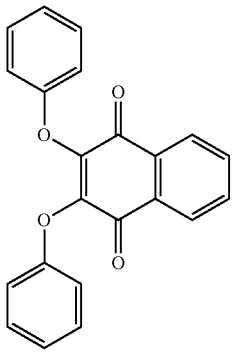

-continued 5-3

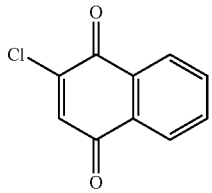

5-4

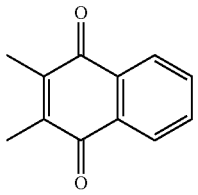

5-5

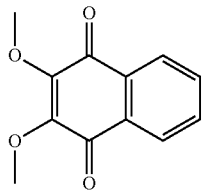

5-6

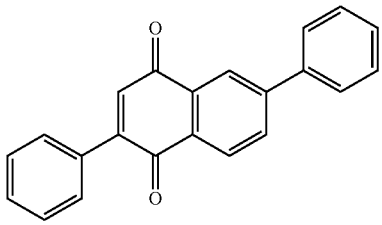

5-7

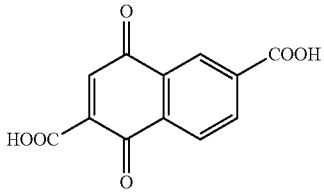

5-8

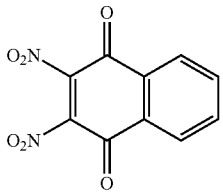

5-9

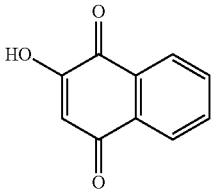

-continued 5-10

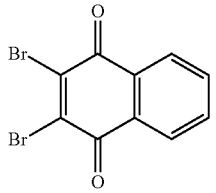

Formula (6)

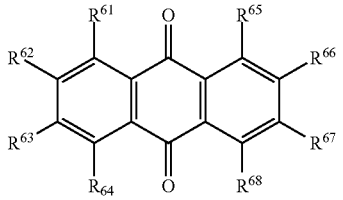

In Formula (6), $R^{61}$, $R^{62}$, $R^{63}$, $R^{64}$, $R^{65}$, $R^{66}$, $R^{67}$, and $R^{68}$ each independently represent a hydrogen atom, a halogen atom, an alkyl group, an alkoxy group, an aralkyl group, an aryl group, an aryloxy group, a nitro group, a carboxy group, or a hydroxy group.

Examples of the halogen atom in Formula (6) include a fluorine atom, a chlorine atom, a bromine atom, and an iodine atom.

Examples of the alkyl group in Formula (6) include a linear, branched, or cyclic alkyl group having 1 to 10 (preferably 1 to 6 and more preferably 1 to 4) carbon atoms. The alkyl group in Formula (6) may also be substituted with a substituent such as a hydroxy group, a carboxy group, a nitro group, and a halogen atom (for example, a fluorine atom, a chlorine atom, a bromine atom, and an iodine atom).

Examples of the alkoxy group in Formula (6) include a linear, branched, or cyclic alkoxy group having 1 to 10 (preferably 1 to 6 and more preferably 1 to 4) carbon atoms. The alkoxy group in Formula (6) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (6) include an aralkyl group having 7 to 20 (preferably 7 to 15 and more preferably 7 to 12) carbon atoms, and specific examples thereof include a benzyl group and a phenethyl group. The aralkyl group in Formula (6) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (6) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (6) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (6) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (6) may also be substituted with a substituent such as a hydroxy group, a carboxy group, a nitro group, an alkyl group, and a halogen atom (for example, a fluorine atom, a chlorine atom, a bromine atom, and an iodine atom).

The compound represented by Formula (6) preferably has one or two total of at least one group selected from an alkyl group, an alkoxy group, a hydroxy group, a carboxy group, and a nitro group, in the molecule, and more preferably has one or two alkyl groups, one or two alkoxy groups, one or two hydroxy groups, or one or two carboxy groups. The alkyl group is preferably a linear or branched alkyl group having 1 to 4 carbon atoms, and more preferably a methyl group or an ethyl group. The alkoxy group is preferably a linear or branched alkoxy group having 1 to 4 carbon atoms, and more preferably a methoxy group or an ethoxy group.

Acceptor compounds (6-1) to (6-10) are shown below as specific examples of the compound represented by Formula (6), but the examples are not limited thereto.

6-1

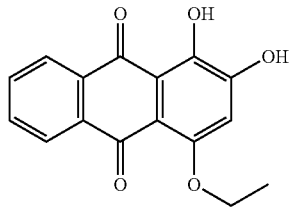

6-2

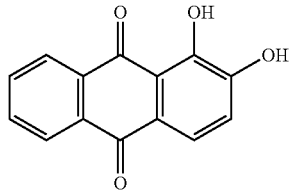

6-3

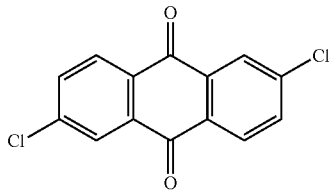

6-4

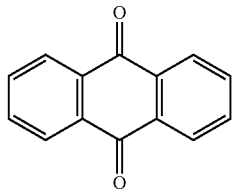

6-5

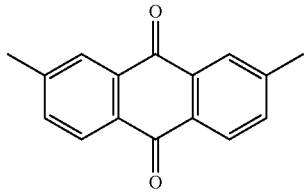

-continued 6-6

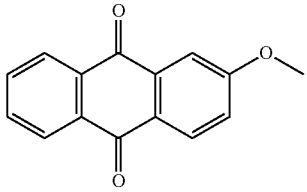

6-7

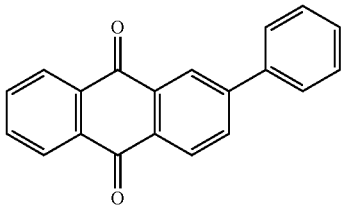

6-8

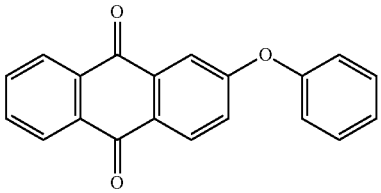

6-9

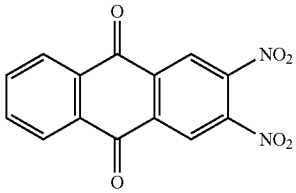

6-10

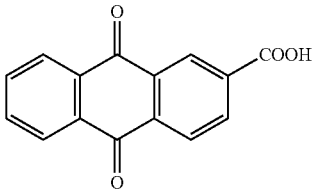

Formula (7)

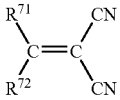

In Formula (7), $R^{71}$ and $R^{72}$ each independently represent a hydrogen atom, a cyano group, or a monovalent organic group having an aromatic ring, and $R^{71}$ and $R^{72}$ may be linked to each other to form a ring.

In a case where $R^{71}$ and $R^{72}$ are linked to each other to form a ring, examples of a structure of the ring to be formed include an aromatic ring and an alicyclic ring, and specific examples thereof include benzene, naphthalene, phenanthrene, cyclopentane, cyclohexane, cycloheptane, 3,5-dimethylcyclohexane, 3,5-diethyleyclohexane, 3,5-diisopropylcyclohexane, 3,3,5-trimethylcyclohexane, and 3,3,5,5-tetramethylcyclohexane.

Examples of the aromatic ring in the monovalent organic group having an aromatic ring include benzene, naphthalene, anthracene, and phenanthrene, and the benzene is preferable.

The monovalent organic group having an aromatic ring is preferably an organic group represented by Formula (7-1) shown below.

Formula (7-1)

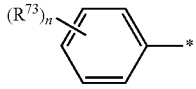

In Formula (7-1), $R^{73}$ represents a halogen atom, an alkyl group, a nitro group, a carboxy group, or a hydroxy group, n represents an integer of 0 to 5, and *represents a linking position to a carbon atom.

Examples of the halogen atom in Formula (7-1) include a fluorine atom, a chlorine atom, a bromine atom, and an iodine atom.

Examples of the alkyl group in Formula (7-1) include a linear, branched, or cyclic alkyl group having 1 to 10 (preferably 1 to 6 and more preferably 1 to 4) carbon atoms. The alkyl group in Formula (7-1) may also be substituted with a substituent such as a hydroxy group, a carboxy group, a nitro group, and a halogen atom (for example, a fluorine atom, a chlorine atom, a bromine atom, and an iodine atom).

In Formula (7-1), n represents an integer of 0 to 5, and is preferably an integer of 1 to 3, more preferably 1 or 2, and still more preferably 1.

The compound represented by Formula (7) is preferably a compound in which at least one of $R^{71}$ and $R^{72}$ is a monovalent organic group having an aromatic ring, and more preferably a compound in which one of $R^{71}$ and $R^{72}$ is a monovalent organic group having an aromatic ring and the other is a hydrogen atom or a cyano group.

Acceptor compounds (7-1) to (7-10) are shown below as specific examples of the compound represented by Formula (7), but the examples are not limited thereto.

7-1

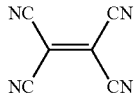

7-2

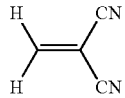

7-3

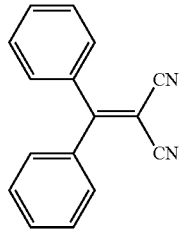

7-4

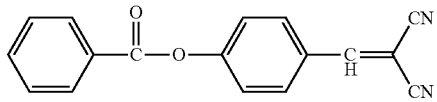

7-5

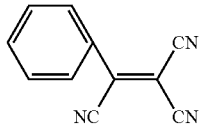

7-6

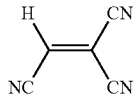

-continued 7-7

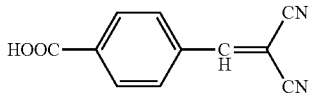

7-8

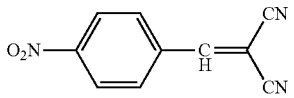

7-9

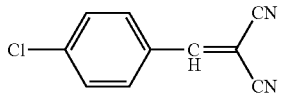

7-10

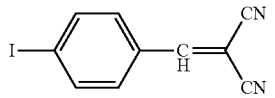

Formula (8)

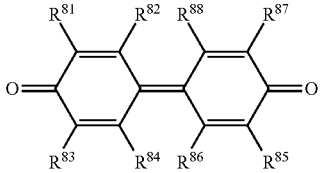

In Formula (8), $R^{81}$, $R^{82}$, $R^{83}$, $R^{84}$, $R^{85}$, $R^{86}$, $R^{87}$, and $R^{88}$ each independently represent a hydrogen atom, a halogen atom, an alkyl group, an alkoxy group, an aralkyl group, an aryl group, an aryloxy group, a nitro group, a carboxy group, or a hydroxy group, $R^{81}$ and $R^{82}$ may be linked to each other to form a ring, $R^{83}$ and $R^{84}$ may be linked to each other to form a ring, $R^{85}$ and $R^{86}$ may be linked to each other to form a ring, and $R^{87}$ and $R^{88}$ may be linked to each other to form a ring.

In a case where $R^{81}$ and $R^{82}$, $R^{83}$ and $R^{84}$, $R^{85}$ and $R^{86}$, or $R^{87}$ and $R^{88}$ are linked to each other to form a ring, examples of a structure of the ring to be formed include an aromatic ring and an alicyclic ring, and specific examples thereof include benzene, naphthalene, phenanthrene, cyclopentane, cyclohexane, cycloheptane, 3,5-dimethylcyclohexane, 3,5-diethylcyclohexane, 3,5-diisopropylcyclohexane, 3,3,5-trimethylcyclohexane, and 3,3,5,5-tetramethylcyclohexane.

Examples of the halogen atom in Formula (8) include a fluorine atom, a chlorine atom, a bromine atom, and an iodine atom.

Examples of the alkyl group in Formula (8) include a linear, branched, or cyclic alkyl group having 1 to 10 (preferably 1 to 6 and more preferably 1 to 4) carbon atoms. The alkyl group in Formula (8) may also be substituted with a substituent such as a hydroxy group, a carboxy group, a nitro group, and a halogen atom (for example, a fluorine atom, a chlorine atom, a bromine atom, and an iodine atom). The alkyl group in Formula (8) is preferably a branched alkyl group, and the branched alkyl group may be substituted with a carboxy group.

Examples of the alkoxy group in Formula (8) include a linear, branched, or cyclic alkoxy group having 1 to 10 (preferably 1 to 6 and more preferably 1 to 4) carbon atoms. The alkoxy group in Formula (8) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (8) include an aralkyl group having 7 to 20 (preferably 7 to 15 and more preferably 7 to 12) carbon atoms, and specific examples thereof include a benzyl group and a phenethyl group. The aralkyl group in Formula (8) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (8) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (8) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (8) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (8) may also be substituted with a substituent such as a hydroxy group, a carboxy group, a nitro group, an alkyl group, and a halogen atom (for example, a fluorine atom, a chlorine atom, a bromine atom, and an iodine atom).

In Formula (8), each of $R^{81}$, $R^{82}$, $R^{83}$, $R^{84}$, $R^{85}$, $R^{86}$, $R^{87}$, and $R^{88}$ preferably represents a hydrogen atom, a halogen atom, or an alkyl group, and it is also preferable that adjacent groups thereof are linked to each other to form a benzene ring.

Acceptor compounds (8-1) to (8-10) are shown below as specific examples of the compound represented by Formula (8), but the examples are not limited thereto.

8-1

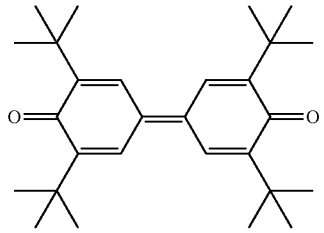

8-2

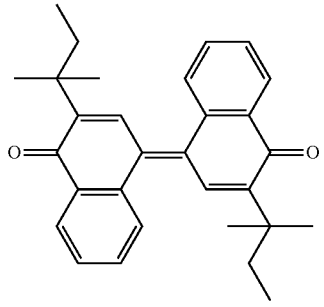

8-3

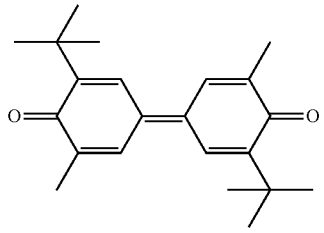

-continued 8-4

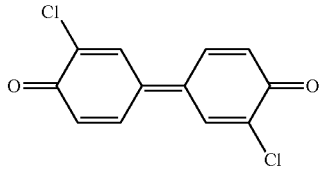

8-5

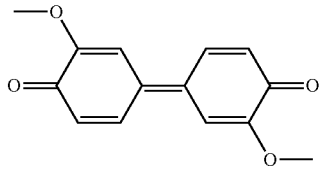

8-6

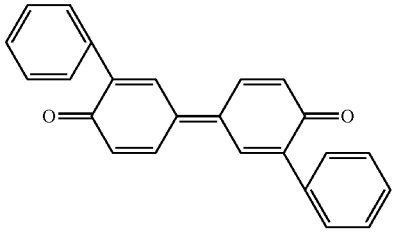

8-7

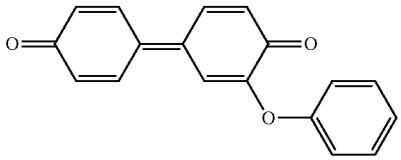

8-8

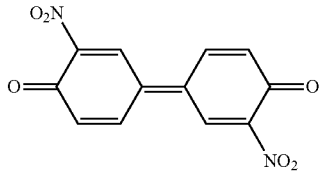

8-9

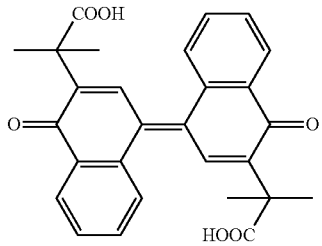

8-10

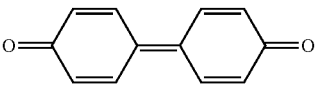

Formula (9)

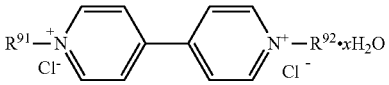

In Formula (9), $R^{91}$ and $R^{92}$ each independently represent a hydrogen atom, an alkyl group, an aralkyl group, or an aryl group, and x represents an integer.

Examples of the alkyl group in Formula (9) include a linear, branched, or cyclic alkyl group having 1 to 10 (preferably 1 to 6 and more preferably 1 to 4) carbon atoms. The alkyl group in Formula (9) may also be substituted with a substituent such as a hydroxy group, a carboxy group, a nitro group, and a halogen atom (for example, a fluorine atom, a chlorine atom, a bromine atom, and an iodine atom). The alkyl group in Formula (9) is preferably a linear alkyl group.

Examples of the aralkyl group in Formula (9) include an aralkyl group having 7 to 20 (preferably 7 to 15 and more preferably 7 to 12) carbon atoms, and specific examples thereof include a benzyl group and a phenethyl group. The aralkyl group in Formula (9) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (9) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (9) may also be substituted with a substituent such as a hydroxy group, a carboxy group, a nitro group, an alkyl group, and a halogen atom (for example, a fluorine atom, a chlorine atom, a bromine atom, and an iodine atom).

Acceptor compounds (9-1) to (9-10) are shown below as specific examples of the compound represented by Formula (9), but the examples are not limited thereto.

9-1

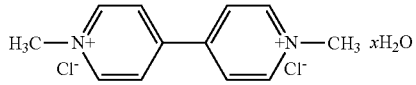

9-2

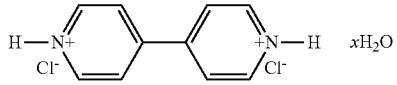

9-3

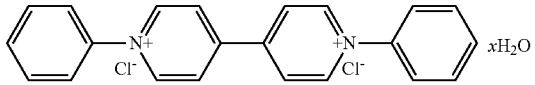

9-4

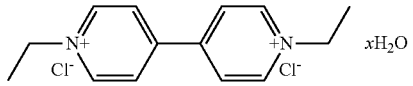

9-5

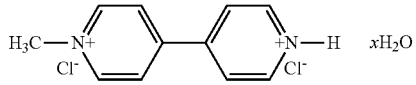

9-6

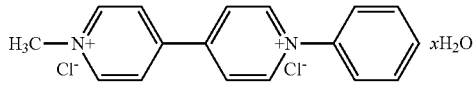

9-7

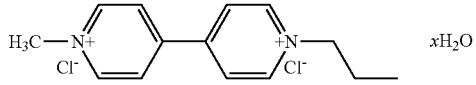

9-8

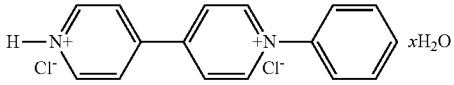

9-9

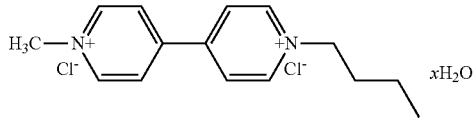

-continued 9-10

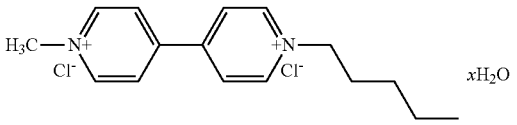

Formula (10)

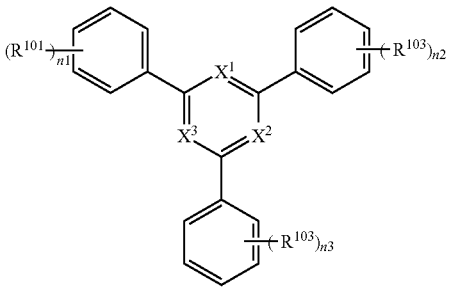

In Formula (10), $X^1$, $X^2$, and $X^3$ each independently represent a CH or a nitrogen atom, $R^{101}$, $R^{102}$, and $R^{103}$ each independently represent a halogen atom, an alkyl group, an alkoxy group, an aralkyl group, an aryl group, an aryloxy group, a nitro group, a carboxy group, or a hydroxy group, and $n_1$, $n_2$, and $n_3$ each independently represent an integer of 0 to 5.

When $n_1$ is 2 or more, plural $R^{101}$'s present in one molecule may be the same as or different from each other.

When $n_2$ is 2 or more, plural $R^{102}$'s present in one molecule may be the same as or different from each other.

When $n_3$ is 2 or more, plural $R^{103}$'s present in one molecule may be the same as or different from each other.

In Formula (10), $X^1$, $X^2$, and $X^3$ each independently represent CH or a nitrogen atom, and $X^1$, $X^2$, and $X^3$ are preferably all nitrogen atoms.

Examples of the halogen atom in Formula (10) include a fluorine atom, a chlorine atom, a bromine atom, and an iodine atom.

Examples of the alkyl group in Formula (10) include a linear, branched, or cyclic alkyl group having 1 to 10 (preferably 1 to 6 and more preferably 1 to 4) carbon atoms. The alkyl group in Formula (10) may also be substituted with a substituent such as a hydroxy group, a carboxy group, a nitro group, and a halogen atom (for example, a fluorine atom, a chlorine atom, a bromine atom, and an iodine atom).

Examples of the alkoxy group in Formula (10) include a linear, branched, or cyclic alkoxy group having 1 to 10 (preferably 1 to 6 and more preferably 1 to 4) carbon atoms. The alkoxy group in Formula (10) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (10) include an aralkyl group having 7 to 20 (preferably 7 to 15 and more preferably 7 to 12) carbon atoms, and specific examples thereof include a benzyl group and a phenethyl group. The aralkyl group in Formula (10) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (10) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (10) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (10) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (10) may also be substituted with a substituent such as a hydroxy group, a carboxy group, a nitro group, an alkyl group, and a halogen atom (for example, a fluorine atom, a chlorine atom, a bromine atom, and an iodine atom).

In Formula (10), each of $n_1$, $n_2$, and $n_3$ independently represents an integer of 0 to 5, and is preferably an integer of 1 to 3, more preferably 1 or 2, and still more preferably 1.

Acceptor compounds (10-1) to (10-10) are shown below as specific examples of the compound represented by Formula (10), but the examples are not limited thereto.

10-1

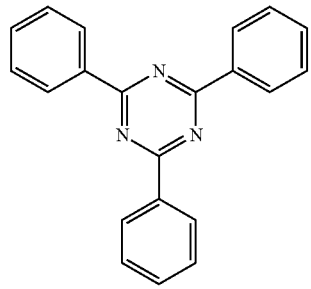

10-2

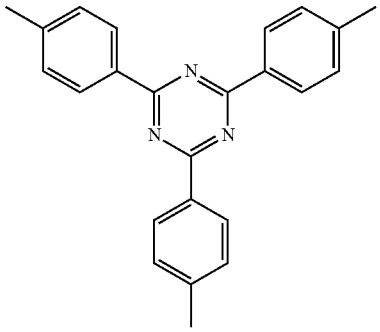

10-3

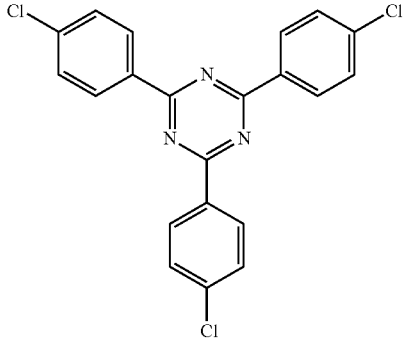

-continued 10-4

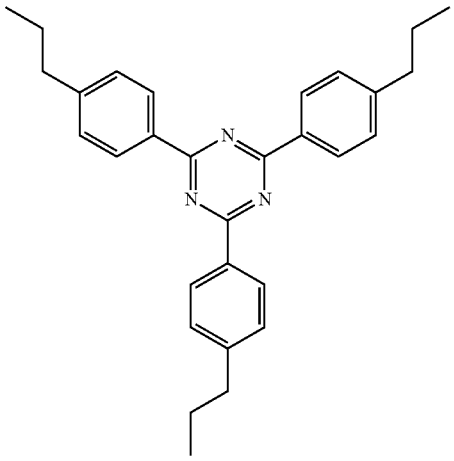

10-5

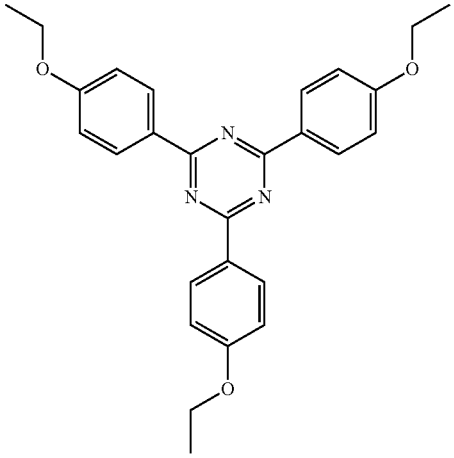

10-6

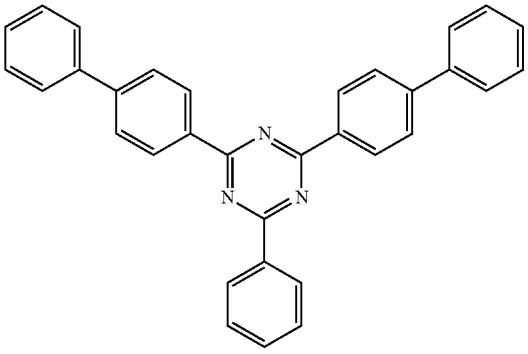

10-7

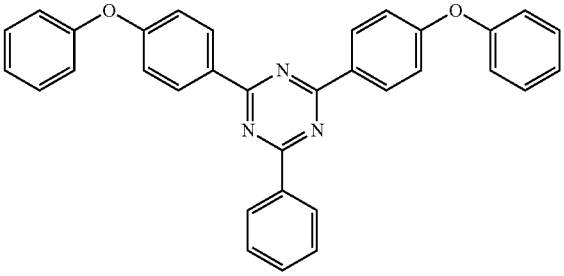

-continued 10-8

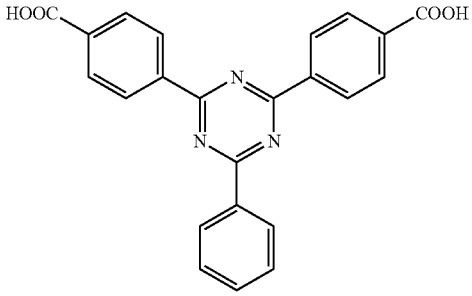

10-9

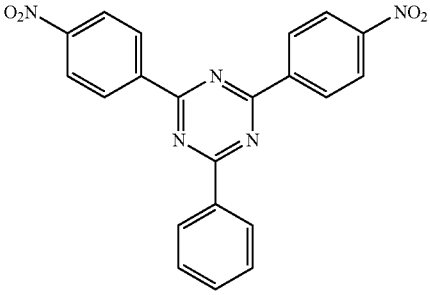

10-10

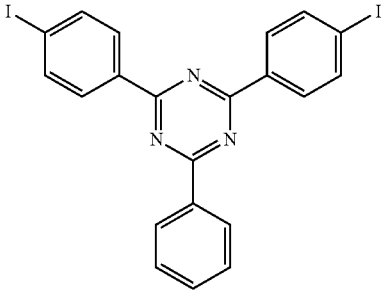

Formula (11)

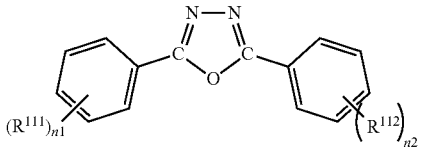

In Formula (11), $R^{111}$ and $R^{112}$ each independently represent a halogen atom, an alkyl group, an alkoxy group, an aralkyl group, an aryl group, an aryloxy group, a nitro group, a carboxy group, or a hydroxy group, and $n_1$ and $n_2$ each independently represent an integer of 0 to 5.

When $n_1$ is 2 or more, plural $R^{111}$'s present in one molecule may be the same as or different from each other.

When $n_2$ is 2 or more, plural $R^{112}$'s present in one molecule may be the same as or different from each other.

Examples of the halogen atom in Formula (11) include a fluorine atom, a chlorine atom, a bromine atom, and an iodine atom.

Examples of the alkyl group in Formula (11) include a linear, branched, or cyclic alkyl group having 1 to 10 (preferably 1 to 6 and more preferably 1 to 4) carbon atoms. The alkyl group in Formula (11) may also be substituted with a substituent such as a hydroxy group, a carboxy group, a nitro group, and a halogen atom (for example, a fluorine atom, a chlorine atom, a bromine atom, and an iodine atom).

Examples of the alkoxy group in Formula (11) include a linear, branched, or cyclic alkoxy group having 1 to 10

(preferably 1 to 6 and more preferably 1 to 4) carbon atoms. The alkoxy group in Formula (11) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (11) include an aralkyl group having 7 to 20 (preferably 7 to 15 and more preferably 7 to 12) carbon atoms, and specific examples thereof include a benzyl group and a phenethyl group. The aralkyl group in Formula (11) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (11) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (11) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (11) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (11) may also be substituted with a substituent such as a hydroxy group, a carboxy group, a nitro group, an alkyl group, and a halogen atom (for example, a fluorine atom, a chlorine atom, a bromine atom, and an iodine atom).

In Formula (11), each of $n_1$ and $n_2$ independently represents an integer of 0 to 5, and is preferably an integer of 1 to 3, more preferably 1 or 2, and still more preferably 1.

Acceptor compounds (11-1) to (11-10) are shown below as specific examples of the compound represented by Formula (11), but the examples are not limited thereto.

11-1

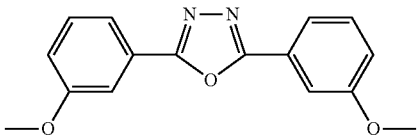

11-2

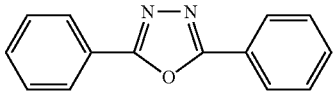

11-3

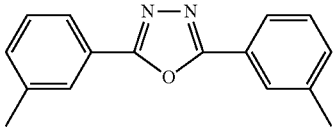

11-4

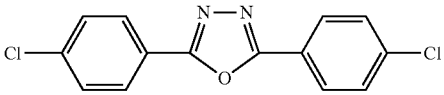

11-5

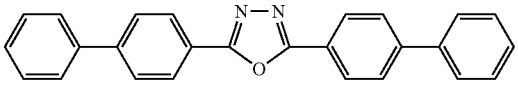

-continued 11-6

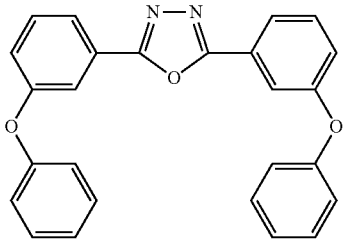

11-7

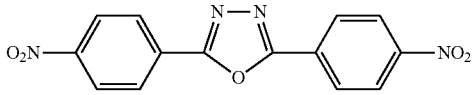

11-8

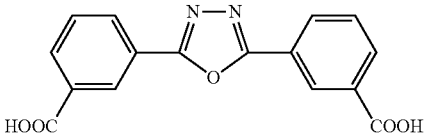

11-9

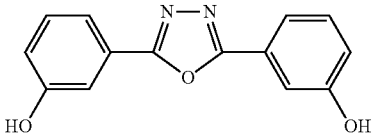

11-10

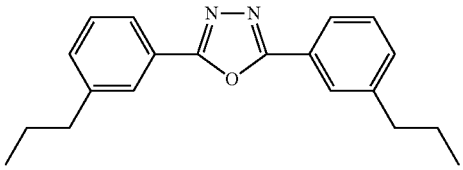

Formula (12)

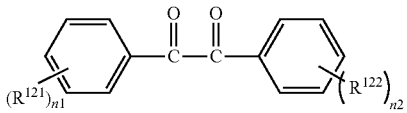

In Formula (12), $R^{121}$ and $R^{122}$ each independently represent a halogen atom, an alkyl group, an alkoxy group, an aralkyl group, an aryl group, an aryloxy group, a nitro group, a carboxy group, or a hydroxy group, and $n_1$ and $n_2$ each independently represent an integer of 0 to 5.

When $n_1$ is 2 or more, plural $R^{121}$'s present in one molecule may be the same as or different from each other.

When $n_2$ is 2 or more, plural $R^{122}$'s present in one molecule may be the same as or different from each other.

Examples of the halogen atom in Formula (12) include a fluorine atom, a chlorine atom, a bromine atom, and an iodine atom.

Examples of the alkyl group in Formula (12) include a linear, branched, or cyclic alkyl group having 1 to 10 (preferably 1 to 6 and more preferably 1 to 4) carbon atoms. The alkyl group in Formula (12) may also be substituted with a substituent such as a hydroxy group, a carboxy group, a nitro group, and a halogen atom (for example, a fluorine atom, a chlorine atom, a bromine atom, and an iodine atom).

Examples of the alkoxy group in Formula (12) include a linear, branched, or cyclic alkoxy group having 1 to 10 (preferably 1 to 6 and more preferably 1 to 4) carbon atoms. The alkoxy group in Formula (12) may also be substituted with a substituent such as a hydroxy group, a carboxy group, a nitro group, and a halogen atom (for example, a fluorine atom, a chlorine atom, a bromine atom, and an iodine atom).

Examples of the aralkyl group in Formula (12) include an aralkyl group having 7 to 20 (preferably 7 to 15 and more preferably 7 to 12) carbon atoms, and specific examples thereof include a benzyl group and a phenethyl group. The aralkyl group in Formula (12) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryl group in Formula (12) include an aryl group having 6 to 20 (preferably 6 to 14 and more preferably 6 to 12) carbon atoms, and specific examples thereof include a phenyl group, a biphenyl group, a 1-naphthyl group, and a 2-naphthyl group. The aryl group in Formula (12) may also be substituted with a substituent such as a hydroxy group, a carboxy group, a nitro group, an alkyl group, and a halogen atom (for example, a fluorine atom, a chlorine atom, a bromine atom, and an iodine atom).

Examples of the aryloxy group in Formula (12) include an aryloxy group having 6 to 20 (preferably 6 to 14 and more preferably 6 to 12) carbon atoms, and specific examples thereof include a phenyloxy group, a biphenyloxy group, a 1-naphthyloxy group, and a 2-naphthyloxy group. The aryloxy group in Formula (12) may also be substituted with a substituent such as a hydroxy group, a carboxy group, a nitro group, an alkyl group, and a halogen atom (for example, a fluorine atom, a chlorine atom, a bromine atom, and an iodine atom).

In Formula (12), each of $n_1$ and $n_2$ independently represents an integer of 0 to 5, and is preferably an integer of 1 to 3, more preferably 1 or 2, and still more preferably 1.

Acceptor compounds (12-1) to (12-10) are shown below as specific examples of the compound represented by Formula (12), but the examples are not limited thereto.

12-1

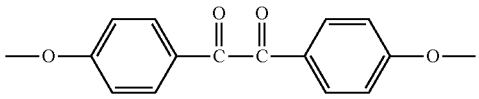

12-2

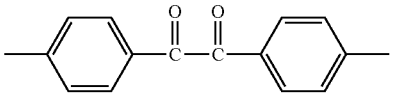

12-3

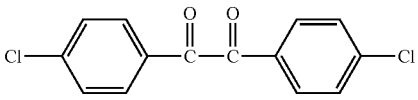

12-4

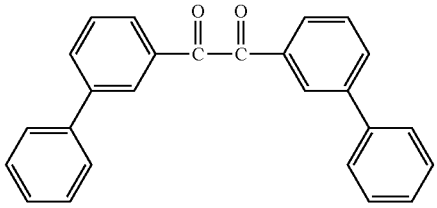

12-5

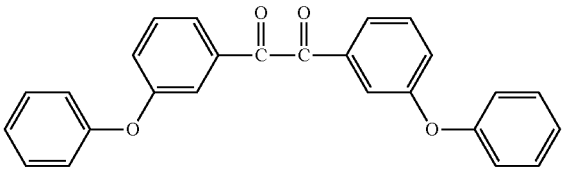

-continued 12-6

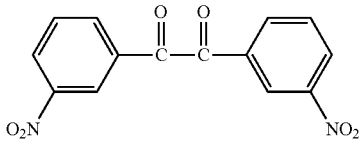

12-7

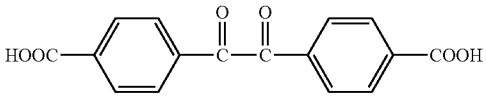

12-8

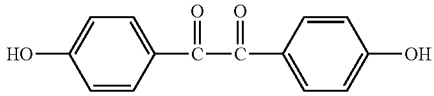

12-9

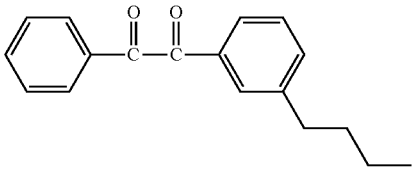

12-10

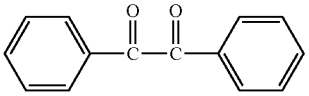

Formula (13)

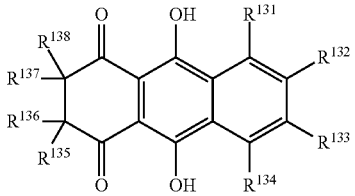

In Formula (13), $R^{131}$, $R^{132}$, $R^{133}$, $R^{134}$, $R^{135}$, $R^{136}$, $R^{137}$, and $R^{138}$ each independently represent a hydrogen atom, a halogen atom, an alkyl group, a carboxy group, or a hydroxy group.

Examples of the halogen atom in Formula (13) include a fluorine atom, a chlorine atom, a bromine atom, and an iodine atom.

Examples of the alkyl group in Formula (13) include a linear, branched, or cyclic alkyl group having 1 to 10 (preferably 1 to 6 and more preferably 1 to 4) carbon atoms. The alkyl group in Formula (13) may also be substituted with a substituent such as a hydroxy group, a carboxy group, and a halogen atom (for example, a fluorine atom, a chlorine atom, a bromine atom, and an iodine atom).

In Formula (13), each of $R^{131}$ and $R^{134}$ is preferably a hydrogen atom, a halogen atom, an alkyl group, or a hydroxy group, and more preferably a hydrogen atom or a halogen atom, and still more preferably a hydrogen atom.

In Formula (13), each of $R^{132}$ and $R^{133}$ is preferably a hydrogen atom, an alkyl group, a carboxy group, or a hydroxy group.

In Formula (13), each of $R^{135}$ and $R^{138}$ is preferably a hydrogen atom, an alkyl group, a carboxy group, or a hydroxy group.

In Formula (13), each of $R^{136}$ and $R^{137}$ is preferably a hydrogen atom, a halogen atom, or an alkyl group, and more preferably a hydrogen atom or a halogen atom, and still more preferably a hydrogen atom.

Acceptor compounds (13-1) to (13-10) are shown below as specific examples of the compound represented by Formula (13), but the examples are not limited thereto.

13-1

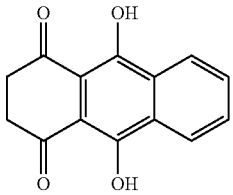

13-2

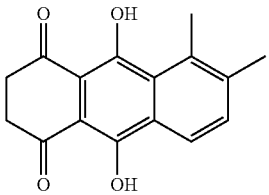

13-3

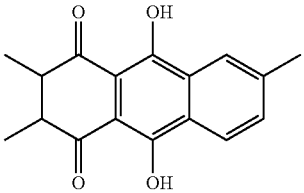

13-4

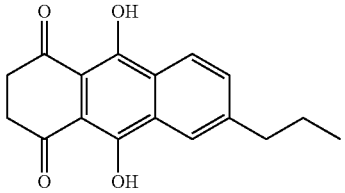

13-5

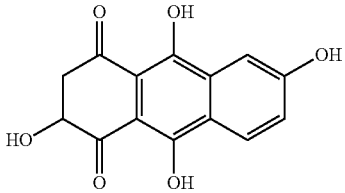

13-6

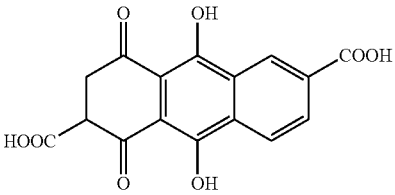

13-7

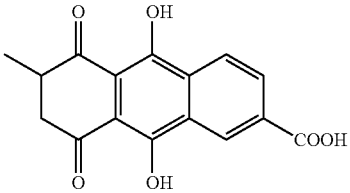

13-8

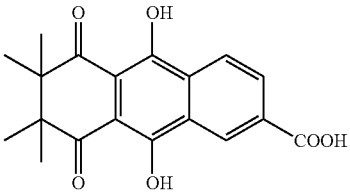

-continued 13-9

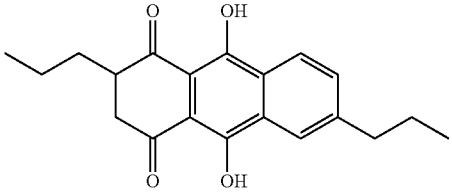

13-10

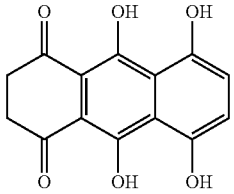

Formula (14)

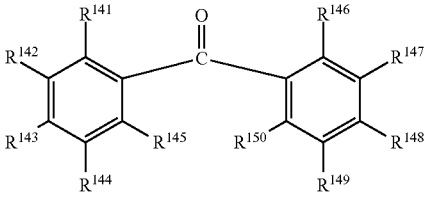

In Formula (14), $R^{141}$, $R^{142}$, $R^{143}$, $R^{144}$, $R^{145}$, $R^{146}$, $R^{147}$, $R^{148}$, $R^{149}$, and $R^{150}$ each independently represent a hydrogen atom, a halogen atom, an alkyl group, alkoxy group, a carboxy group, or a hydroxy group, provided that at least one of $R^{141}$, $R^{142}$, $R^{143}$, $R^{144}$, $R^{145}$, $R^{146}$, $R^{147}$, $R^{148}$, $R^{149}$, and $R^{150}$ represents a carboxy group.

Examples of the halogen atom in Formula (14) include a fluorine atom, a chlorine atom, a bromine atom, and an iodine atom.

Examples of the alkyl group in Formula (14) include a linear, branched, or cyclic alkyl group having 1 to 10 (preferably 1 to 6 and more preferably 1 to 4) carbon atoms. The alkyl group in Formula (14) may also be substituted with a substituent such as a hydroxy group, a carboxy group, and a halogen atom (for example, a fluorine atom, a chlorine atom, a bromine atom, and an iodine atom).

Examples of the alkoxy group in Formula (14) include a linear, branched, or cyclic alkoxy group having 1 to 10 (preferably 1 to 6 and more preferably 1 to 4) carbon atoms. The alkoxy group in Formula (14) may also be substituted with a substituent such as a hydroxy group, a carboxy group, and a halogen atom (for example, a fluorine atom, a chlorine atom, a bromine atom, and an iodine atom).

The compound represented by Formula (14) has at least one carboxy group in a molecule. The number of carboxy groups in the compound represented by Formula (14) is preferably from 1 to 4 and more preferably 1 or 2 per molecule. The carboxy group in the compound represented by Formula (14) is preferably $R^{142}$, $R^{143}$, $R^{147}$, or $R^{148}$, and more preferably $R^{142}$ or $R^{147}$.

Acceptor compounds (14-1) to (14-10) are shown below as specific examples of the compound represented by Formula (14), but the examples are not limited thereto.

14-1

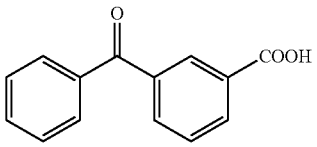

14-2

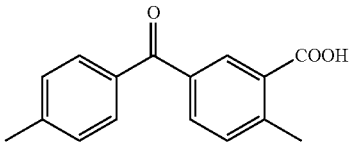

14-3

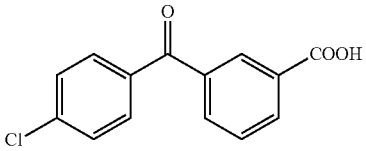

14-4

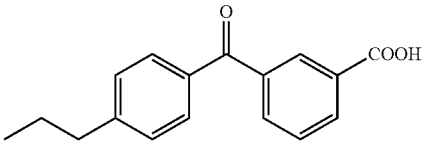

14-5

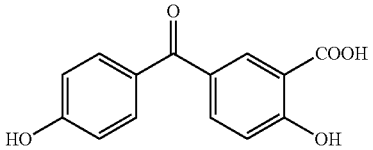

14-6

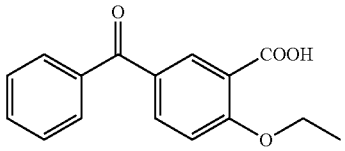

14-7

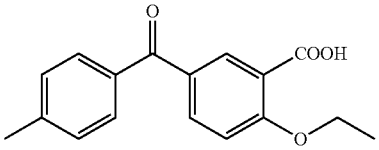

14-8

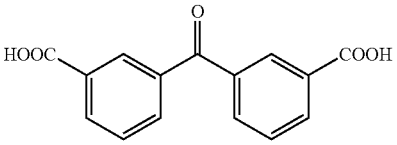

14-9

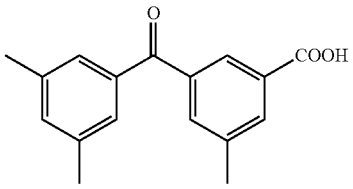

-continued 14-10

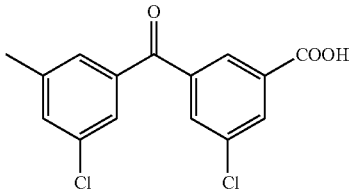

Formula (15)

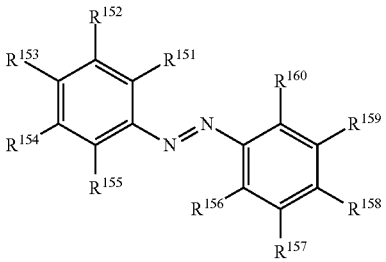

In Formula (15), $R^{151}$, $R^{152}$, $R^{153}$, $R^{154}$, $R^{155}$, $R^{156}$, $R^{157}$, $R^{158}$, $R^{159}$, and $R^{160}$ each independently represent a hydrogen atom, a halogen atom, an alkyl group, a carboxy group, or a hydroxy group, and adjacent groups may be linked to each other to form a ring, provided that at least one of $R^{151}$, $R^{152}$, $R^{153}$, $R^{154}$, $R^{155}$, $R^{156}$, $R^{157}$, $R^{158}$, $R^{159}$, and $R^{160}$ represents a carboxy group or a hydroxy group.

In a case where adjacent groups in Formula (15) are linked to each other to form a ring, examples of a structure of the ring to be formed include an aromatic ring and an alicyclic ring, and specific examples thereof include benzene, naphthalene, phenanthrene, cyclopentane, cyclohexane, cycloheptane, 3,5-dimethylcyclohexane, 3,5-diethylcyclohexane, 3,5-diisopropylcyclohexane, 3,3,5-trimethylcyclohexane, and 3,3,5,5-tetramethylcyclohexane.

Examples of the halogen atom in Formula (15) include a fluorine atom, a chlorine atom, a bromine atom, and an iodine atom.

Examples of the alkyl group in Formula (15) include a linear, branched, or cyclic alkyl group having 1 to 10 (preferably 1 to 6 and more preferably 1 to 4) carbon atoms. Among these, a methyl group, an ethyl group, a n-propyl group, an i-propyl group, and a cyclohexyl group are preferable. The alkyl group in Formula (15) may also be substituted with a substituent such as a hydroxy group, a carboxy group, and a halogen atom (for example, a fluorine atom, a chlorine atom, a bromine atom, and an iodine atom).

The compound represented by Formula (15) has at least one carboxy group or a hydroxy group in a molecule. The number of the carboxy groups or the hydroxy groups in the compound represented by Formula (15) is preferably from 1 to 4 and more preferably 1 or 2 per molecule, in total.

The carboxy group or the hydroxy group in the compound represented by Formula (15) is preferably $R^{153}$, $R^{154}$, $R^{158}$, or $R^{159}$, and more preferably $R^{154}$ or $R^{159}$.

Acceptor compounds (15-1) to (15-10) are shown below as specific examples of the compound represented by Formula (15), but the examples are not limited thereto.

15-1

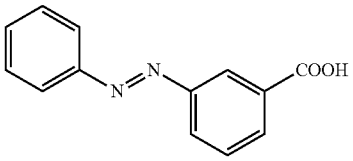

15-2

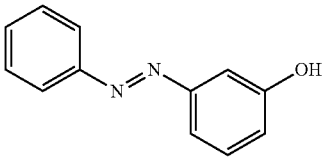

15-3

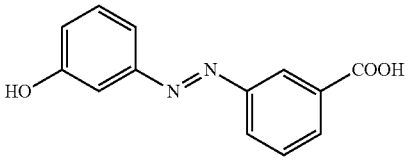

15-4

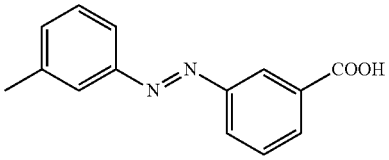

15-5

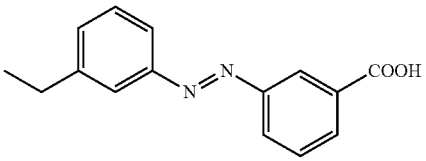

15-6

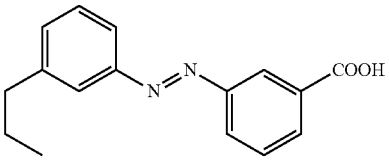

15-7

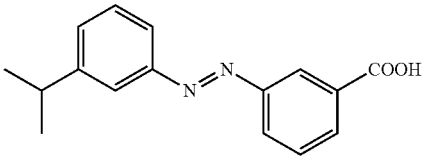

15-8

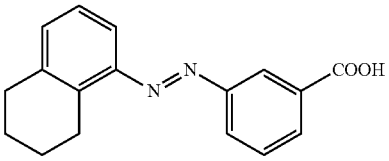

15-9

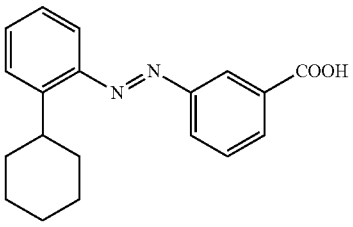

-continued 15-10

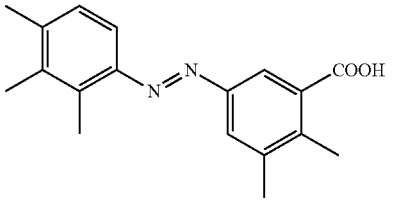

Specific examples of the alkyl group and the alkoxy group in Formulas (3), (4), (5), (6), (7), (8), (9), (10), (11), (12), (13), (14), and (15) include the following groups.

Examples of the linear alkyl group include a methyl group, an ethyl group, a n-propyl group, a n-butyl group, a n-pentyl group, a n-hexyl group, a n-heptyl group, a n-octyl group, a n-nonyl group, and a n-decyl group.

Examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Examples of the cyclic alkyl group include a cyclopropyl group, a cyclobutyl group, a cyclopentyl group, a cyclohexyl group, a cycloheptyl group, a cyclooctyl group, a cyclononyl group, and a cyclodecyl group, and a polycyclic (for example, bicyclic, tricyclic, or spirocyclic) alkyl group in which these monocyclic alkyl groups are linked.

Examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, and n-decyloxy group.

Examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Examples of the cyclic alkoxy group include a cyclopropoxy group, a cyclobutoxy group, a cyclopentyloxy group, a cyclohexyloxy group, a cycloheptyloxy group, a cyclooctyloxy group, a cyclononyloxy group, and a cyclodecyloxy group.

From the viewpoint of easily receiving electrons from the compound represented by Formula (1) or the compound represented by Formula (2), the acceptor compound is preferably the compound represented by Formula (6), the compound represented by Formula (13), the compound represented by Formula (14), or the compound represented by Formula (15).

From the viewpoint of preventing deterioration of photosensitivity when images are repeatedly formed, a total content of the acceptor compound contained in the undercoating layer is preferably from 2% by weight to 30% by weight, more preferably from 5% by weight to 25% by weight, and still more preferably 10% by weight to 20% by weight, with respect to the total content of the compound represented by Formula (1) and the compound represented by Formula (2) contained in the undercoating layer.

From the viewpoint of preventing deterioration of photosensitivity when images are repeatedly formed, the total content of the acceptor compound contained in the undercoating layer is preferably from 1% by weight to 25% by weight, more preferably from 5% by weight to 20% by weight, and still more preferably 10% by weight to 15% by weight, with respect to the total solid content of the undercoating layer.

Examples of the binder resin used for the undercoating layer include known materials, including known polymer compounds such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, a urethane resin, an alkyd resin, and an epoxy resin; a zirconium chelate compound; a titanium chelate compound; an aluminum chelate compound; a titanium alkoxide compound; an organic titanium compound; and a silane coupling agent.

Examples of the binder resin used for the undercoating layer also include a charge transporting resin having a charge transporting group and conductive resin (such as polyaniline).

Among these, as the binder resin used for the undercoating layer, a resin which is insoluble in a coating solvent for the upper layer is preferable. In particular, a resin obtained by the reaction between a curing agent and at least one selected from the group consisting of thermosetting resin such as a urea resin, a phenol resin, a phenol-formaldehyde resin, a melamine resin, a urethane resin, a unsaturated polyester resin, an alkyd resin, and an epoxy resin; a polyamide resin, a polyester resin, a polyether resin, a methacrylic resin, an acrylic resin, a polyvinyl alcohol resin, and a polyvinyl acetal resin is preferable.

In a case where two or more of these binder resins are used in combination, a mixing ratio thereof is set as needed.

In a case where the undercoating layer contains inorganic particles, examples of the inorganic particles include inorganic particles having a powder resistance (volume resistivity) of $1\times10^{2}$ (Ω·cm) to $1\times10^{11}$ (Ω·cm).

Among these, examples of the inorganic particles having the above resistance value may be metal oxide particles such as tin oxide particles, titanium oxide particles, zinc oxide particles, and zirconium oxide particles, and the zinc oxide particles are particularly preferable.

A specific surface area of the inorganic particles by a BET method may be, for example, 10 $m^2/g$ or more.

A volume average particle diameter of the inorganic particles may be, for example, from 50 nm to 2,000 nm (more preferably from 60 nm to 1,000 nm).

A content of the inorganic particles is preferably, for example, from 10% by weight to 80% by weight, and more preferably from 40% by weight to 80% by weight, with respect to the binder resin.

The inorganic particles may be subjected to a surface treatment. Two or more kinds of the inorganic particles, which are subjected to different surface treatments or have different particle diameters, may be mixed to be used.

Examples of a surface treatment agent include a silane coupling agent, a titanate coupling agent, an aluminum coupling agent, and a surfactant. In particular, the silane coupling agent is preferable.

The undercoating layer may contain various additives for improving electrical properties, environmental stability, and image quality.

Examples of the additives include known materials such as an electron transporting pigment such as polycyclic condensation type and azo type, a zirconium chelate compound, a titanium chelate compound, an aluminum chelate compound, a titanium alkoxide compound, an organic titanium compound, and a silane coupling agent. The silane coupling agent is used for a surface treatment of the metal oxide particles as described above, but may be further added to the undercoating layer as an additive.

Examples of the silane coupling agent as the additives include vinyltrimethoxysilane, 3-methacryloxypropy 1-tris (2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, and 3-chloropropyltrimethoxysilane.

Examples of the zirconium chelate compound include zirconium butoxide, zirconium ethyl acetoacetate, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, and polyhydroxy titanium stearate.

Examples of the aluminum chelate compound include aluminum isopropylate, monobutoxy aluminum diisopropylate, aluminum butyrate, diethyl acetoacetate aluminum diisopropylate, and aluminum tris(ethyl acetoacetate).

These additives may be used alone, or as a mixture or polycondensate of plural compounds.

The undercoating layer suitably has a Vickers hardness of 35 or higher.

In order to prevent a moire fringe, surface roughness (ten-point average roughness) of the undercoating layer may be adjusted from 1/(4n) (n is a refractive index of an upper layer) of the exposure laser wavelength λ to ½ thereof.

In order to adjust the surface roughness, resin particles or the like may be added to the undercoating layer. Examples of the resin particles include silicone resin particles and crosslinked polymethylmethacrylate resin particles. Further, in order to adjust the surface roughness, the surface of the undercoating layer may be polished. Examples of a polishing method include buffing, sandblasting treatment, wet honing, and grinding treatment.

Formation of the undercoating layer is not particularly limited and a known forming method is used. For example, a coating film of an undercoating layer forming coating liquid obtained by adding the above components to a solvent is formed, and the coating film is dried to form the undercoating layer by heating as needed.

Examples of the solvent for preparing the undercoating layer forming coating liquid include known organic solvents such as alcohol solvent, aromatic hydrocarbon solvent, halogenated hydrocarbon solvent, ketone solvent, ketone alcohol solvent, ether solvent, and ester solvent.

Specific examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the dispersing method of inorganic particles when preparing the undercoating layer forming coating liquid include known methods such as a roll mill, a ball mill, a vibration ball mill, an attritor, a sand mill, a colloid mill, and a paint shaker.

Examples of a method for applying the undercoating layer forming coating liquid onto the conductive substrate include normal methods such as a blade coating method, a wire bar coating method, a spray coating method, a dipping coating method, a bead coating method, an air knife coating method, and a curtain coating method.

A thickness of the undercoating layer is preferably from 5 μm to 50 μm, more preferably from 10 μm to 40 μm, and still more preferably from 15 μm to 30 μm.

The volume resistivity of the undercoating layer is preferably from $1\times10^4\Omega\cdot m$ to $1\times10^8\Omega\cdot m$.

Hereinafter, an undercoating layer of the third electrophotographic photoreceptor is described in detail. Descriptions are given without reference numerals.

[Undercoating Layer]

(Binder Resin Including Resin obtained by Polymerizing Diallyl Phthalate Compound)

A binder resin includes a resin obtained by polymerizing diallyl phthalate compound.

The diallyl phthalate compound represents a compound having a diallyl phthalate skeleton.

Examples of the compounds having a diallyl phthalate skeleton include o-diallyl phthalate, m-diallyl phthalate (diallyl isophthalate) and p-diallyl phthalate.

Among the compounds having a diallyl phthalate skeleton, the diallyl phthalate compound preferably includes a diallyl isophthalate compound.

If the diallyl phthalate compound includes the diallyl isophthalate compound, when the diallyl isophthalate compound is polymerized to prepare a binder resin, intermolecular crosslinking tends to be prevented. Therefore, the binder resin tends to be preferentially produced through polymerization between molecules, and the undercoating layer tends to be formed in a state where the charge transporting material is highly dispersed in a solution of the diallyl phthalate compound. As a result, the charge transport efficiency improves and a rise in the residual potential when repeated images are formed tends to be prevented.

Examples of the diallyl phthalate compound include a monomer of the compound having the diallyl phthalate skeleton, a prepolymer constituted from one or more of the monomers of the compound having the diallyl phthalate skeleton, and a mixture thereof.

Among the above examples, the diallyl phthalate compound preferably includes the monomer and the prepolymer of the diallyl phthalate compound.

When the diallyl phthalate compound includes the monomer and the prepolymer of the diallyl phthalate compound, curing degree of the binder resin, solubility of the binder resin in an organic solvent, a film thickness of the charge generation layer, and the like tends to be easily controlled.

A weight average molecular weight (Mw) of the prepolymer is preferably 200,000 or less, more preferably 100,000 or less, and still more preferably 50,000 or less.

When the weight average molecular weight of the prepolymer is 200,000 or less, film strength in the undercoating layer tends to improve while maintaining the dispersibility of the charge transporting material.

The weight average molecular weight of the prepolymer is a value obtained by measurement using gel permeation chromatography (GPC). The molecular weight measurement using the GPC is carried out, for example, using GPC-HLC-8120 (manufactured by Tosoh Corporation) and column TSKgel GMHHR-M+TSKgel GMHHR-M (7.8 mm I.D., 30 cm) (manufactured by Tosoh Corporation), as a measurement device, with chloroform solvent. From the measurement result, the molecular weight is calculated by using a molecular weight calibration curve prepared with a monodisperse polystyrene standard sample.

In a case where the monomer and prepolymer are used in combination, a weight ratio of monomer and prepolymer is preferably from 1/99 to 99/1, and more preferably from 80/20 to 20/80.

As long as the residual potential is prevented from rising when repeated images are formed, the binder resin may be a binder resin obtained by polymerizing a diallyl phthalate compound and a curable compound other than the diallyl phthalate compound.

Examples of the curable compound other than the diallyl phthalate compound include styrene monomer, (meth) acrylic monomer, a polymer thereof, or a mixture thereof. The expression "(meth)acrylic" in the present specification includes both "acrylic" and "methacrylic".

Examples of the styrene monomer include styrene, alkyl-substituted styrenes (such as a-methylstyrene, 2-methylstyrene, 3-methylstyrene, 4-methylstyrene, 2-ethylstyrene, 3-ethylstyrene, and 4-ethylstyrene), halogen-substituted styrenes (such as 2-chlorostyrene, 3-chlorostyrene, and 4-chlorostyrene), and vinylnaphthalene. Among these, as the styrene monomer, styrene is preferable from the viewpoints of ease of reaction, ease of reaction control, and availability. One kind of the styrene monomers may be used alone and two or more kinds thereof may be used in combination.

Examples of the (meth)acrylic monomer include (meth) acrylic acid and (meth)acrylic acid ester. Examples of the (meth)acrylic ester include (meth)acrylic acid alkyl ester (such as methyl (meth)acrylate, ethyl (meth)acrylate, n-propyl (meth)acrylate, n-butyl (meth)acrylate, n-pentyl (meth) acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, neopentyl (meth)acrylate, isohexyl (meth)acrylate, isoheptyl (meth) acrylate, isooctyl (meth)acrylate, 2-ethylhexyl (meth)acrylate, cyclohexyl (meth)acrylate, and t-butyl cyclohexyl (meth)acrylate), (meth)acrylic acid aryl ester (such as phenyl (meth)acrylate, biphenyl (meth)acrylate, diphenylethyl (meth)acrylate, t-butylphenyl (meth)acrylate, and terphenyl (meth)acrylate), methoxyethyl (meth)acrylate, 2-hydroxyethyl (meth)acrylate, and β-carboxyethyl (meth)acrylate. From the viewpoint of fixability, the (meth)acrylic monomer is preferably a (meth)acrylic ester having 2 to 14 (preferably 2 to 10 and more preferably 3 to 8) carbon atoms. One kind of the (meth)acrylic monomers may be used alone and two or more kinds thereof may be used in combination.

In a case where the binder resin contains a curable compound other than the diallyl phthalate compound, the binder resin may be a binder resin obtained by polymerizing diallyl phthalate compound and the (meth)acrylic monomer.

When the binder resin is the binder resin obtained by polymerizing the diallyl phthalate compound and the (meth) acrylic monomer, the film strength of the undercoating layer tends to improve. When the film strength of the undercoating layer is high, for example, in a case where needle-shaped foreign matter such as carbon fiber is contained in toner, even if the needle-shaped foreign matter causes cracks to occur in the electrophotographic photoreceptor, the cracks tend to hardly occur in the undercoating layer. As a result, leakage current tends to be prevented.

In a case where the binder resin contains a curable compound other than the diallyl phthalate compound, a content of the diallyl phthalate compound is preferably from 50 parts by weight to 99.5 parts by weight, and more preferably from 80 parts by weight to 99.5 parts by weight, with respect to 100 parts by weight of the total solid content of the binder resin.

Examples of a polymerization initiator used when polymerizing the diallyl phthalate compound include a thermal polymerization initiator and a photopolymerization initiator, and known polymerization initiator may be applied according to the diallyl phthalate compound to be selected or a thickness of the undercoating layer.

Examples of the thermal polymerization initiator include dicumyl peroxide, 2,5-dimethyl-2,5-bis(t-butylperoxy) hexane, t-butyl cumyl peroxide, di-t-butyl peroxide, bis(4-t-butylcyclohexyl) peroxycarbonate, 1,1,3,3-tetramethylbutylperoxy-2-ethylhexanoate, 2,5-dimethyl-2,5-bis(2-ethylhexanoylperoxy) hexane, 1-cyclohexyl-1-methylethylperoxy-2-ethylhexanoate, t-hexylperoxy-2-ethylhexanoate, t-butylperoxy-2-ethylhexanoate, t-hexylperoxyisopropyl monocarbonate, t-butyl peroxymaleic acid, t-butylperoxy-3,5,5-trimethylhexanoate, t-butyl peroxylaurate, 2,5-dimethyl-2,5-bis(m-toluoylperoxy) hexane, t-butyl peroxyisopropyl monocarbonate, t-butylperoxy-2-ethylhexyl monocarbonate, t-hexyl peroxybenzoate, 2,5-dimethyl-2,5-bis(benzoylperoxy) hexane, t-butylperoxy-m-toluoylbenzoate, t-butyl peroxybenzoate, and bis(t-butylperoxy) isophthalate.

Examples of the photopolymerization initiator include 2-methyl-[4-(methylthio)phenyl]-2-morpholinopropane-1-one, 2-chlorothioxanthone, 2,4-dimethylthioxanthone, 2,4-diethylthioxanthone, and 2,4-diisopropyl thioxanthone.

In a case where the thermal polymerization initiator is used as the polymerization initiator, a temperature at which the diallyl phthalate compound is polymerized and cured is preferably from a room temperature (23° C.) to 300° C., more preferably from 100° C. to 250° C., and still more preferably from 150° C. to 200° C.

An atmosphere under which the diallyl phthalate compound is polymerized and cured is not particularly limited, and may be an air atmosphere or a nitrogen atmosphere.

When the temperature at which the diallyl phthalate compound is polymerized and cured is the room temperature or higher, curing rate is prevented from lowering and a cured film tends to be efficiently formed. On the other hand, when the temperature at which the diallyl phthalate compound is polymerized and cured is 300° C. or less, oxidation decomposition or coloration of the charge transporting material tends to be prevented.

In the binder resin, a mixing ratio of the polymerization initiator and the diallyl phthalate compound (Polymerization initiator/Diallyl phthalate compound) is preferably from 1/100 to 1/1, and more preferably from 3/100 to 3/10.

When a mixing amount of the polymerization initiator is 1/100 or more of a mixing amount of the diallyl phthalate compound, residual of unreacted diallyl phthalate compound tends to be prevented from being formed. On the other hand, when the mixing amount of the polymerization initiator is 1/1 or less of the mixing amount of the diallyl phthalate compound, deterioration of electric properties due to decomposition of the charge transporting material and excess polymerization initiator remaining in the binder resin tends to be prevented.

A weight loss (hereinafter referred to as "extraction weight loss") of the resin obtained by polymerizing the diallyl phthalate compound, after the resin obtained by polymerizing the diallyl phthalate compound is extracted with the heated acetone is preferably 20% by weight or less, more preferably 15% by weight or less, and still more preferably 10% by weight or less, with respect to the total amount of the resin obtained by polymerizing the diallyl phthalate compound before the extraction with the heated acetone.

When the extraction weight loss of the resin obtained by polymerizing the diallyl phthalate compound is 20% by weight or less, dispersibility of the charge transporting material in the undercoating layer tends to increase and the film strength of the undercoating layer tends to improve.

The extraction weight loss of the resin obtained by polymerizing the diallyl phthalate compound is determined as follows.

(1) A layer (such as the photosensitive layer) formed on an outer circumferential surface of the undercoating layer in the electrophotographic photoreceptor is removed by removing with a cutter or by dissolving with a solvent or the like.

(2) The undercoating layer is cut, and the resultant is dissolved in a solvent etc. or subjected to filtration to remove the charge transporting material, so that the resin obtained by polymerizing the diallyl phthalate compound is isolated.

(3) The resin which is obtained by polymerizing the diallyl phthalate compound and isolated from the undercoating layer is finely crushed with a mortar or the like, and a certain amount thereof is weighed and put into a cylindrical filter paper. Next, the cylindrical filter paper containing the resin obtained by polymerizing the diallyl phthalate compound is put in a soxhlet extractor, refluxing is performed with acetone for 2 hours, so that the resin is extracted. Thereafter, the cylindrical filter paper is dried under reduced pressure, and further dried by standing for 1 hour in the atmosphere. The weight of the cylindrical filter paper containing the resin is weighed, and a value obtained by subtracting a weight of the filter paper from the obtained weight is taken as the extraction weight loss of the resin obtained by polymerizing the diallyl phthalate compound.

The binder resin may contain other resins in addition to the resin obtained by polymerizing the diallyl phthalate compound, as long as the effect of the exemplary embodiment is not impaired.

Examples of the other resins include a polycarbonate resin such as bisphenol A type and bisphenol Z type, an olefin resin, a methacrylic resin, an acrylic resin, a polyvinyl chloride resin, a polystyrene resin, a polyvinyl acetate resin, a styrene-butadiene copolymer resin, a vinylidene chloride-acrylonitrile copolymer resin, a vinyl chloride-vinyl acetate-maleic anhydride resin, a silicone resin, a silicone-alkyd resin, a phenol-formaldehyde resin, a styrene-alkyd resin, and poly-N-vinylcarbazole. One kind of these binder resins may be used alone and two or more kinds thereof may be used in combination. In this case, a content of the resin obtained by polymerizing the diallyl phthalate compound is preferably 90% by weight or more (more preferably 95% or more) with respect to the total amount of the binder resin contained in the undercoating layer, from the viewpoint of achieving the effect of the exemplary embodiment.

(Charge Transporting Material)

The undercoating layer contains charge transporting material.

Examples of the charge transporting material include is an electron transporting material and a hole transporting material.

Examples of the electron transporting material include electron transporting compounds such as a perinone compound, a quinone compound such as p-benzoquinone, chloranil, bromanil, and anthraquinone; a tetracyanoquinodimethane compound; a fluorenone compound such as 2,4,7-trinitrofluorenone; a xanthone compound; a benzophenone compound; a cyanovinyl compound; an ethylene compound; and a 9-dicyanomethylenefluorene compound.

These electron transporting materials may be used alone or in combination of two or more thereof, but are not limited thereto.

Examples of the hole transporting material include hole transporting compounds such as a benzidine compound, an arylalkane compound, an aryl-substituted ethylene compound, a stilbene compound, an anthracene compound, and a hydrazone compound.

These hole transporting materials may be used alone or in combination of two or more thereof, but are not limited thereto.

Among the above compounds, the charge transporting material preferably contains at least one perinone compound represented by Formulas (1) and (2), from the viewpoint of preventing the rise in the residual potential when repeated images are formed.

The compound represented by Formula (1) and the compound represented by Formula (2) are the same as the compound represented by Formula (1) and the compound represented by Formula (2) in the first photoreceptor described above. The description on the compound represented by Formula (1) and the compound represented by Formula (2) in the first photoreceptor described above may also be applied to the compound represented by Formula (1) and the compound represented by Formula (2) in the third photoreceptor.

From the viewpoint of preventing the rise in the residual potential when repeated images are formed, it is preferable that $R^{11}$, $R^{12}$, $R^{13}$, $R^{14}$, $R^{15}$, $R^{16}$, $R^{17}$, and $R^{18}$ in Formula (1) each independently represent a hydrogen atom, an alkyl group, an alkoxycarbonyl group, an aryloxycarbonyl group, an alkoxycarbonylalkyl group or an aryloxycarbonylalkyl group, and $R^{21}$, $R^{22}$, $R^{23}$, $R^{24}$, $R^{25}$, $R^{26}$, $R^{27}$, and $R^{28}$ in Formula (2) each independently represent a hydrogen atom, an alkyl group, an alkoxycarbonyl group, an aryloxycarbonyl group, an alkoxycarbonylalkyl group, or an aryloxycarbonylalkyl group.

A ratio of the perinone compound represented by Formulas (1) and (2) with respect to the charge transporting material is preferably from 90% by weight to 100% by weight, and more preferably from 98% by weight to 100% by weight.

A content of the charge transporting material with respect to the total solid content of the undercoating layer is preferably from 20% by weight to 80% by weight, from the viewpoint of preventing the rise in the residual potential when repeated images are formed, and more preferably from 40% by weight to 80% by weight, from the viewpoint of uniformity of a film during coating.

(Inorganic Particles)

The undercoating layer may further include inorganic particles.

Examples of the inorganic particles include inorganic particles having a powder resistance (volume resistivity) from $1.0\times10^{2}$ (Ω·cm) to $1.0\times10^{11}$ (Ω·cm).

Examples of the inorganic particles having the resistance value include metal oxide particles of zinc oxide, titanium oxide, tin oxide, aluminum oxide, indium oxide, silicon oxide, magnesium oxide, barium oxide, molybdenum oxide, or the like. These may be used alone and two or more kinds thereof may be used in combination.

Among the above particles, from the viewpoint of preventing residual potential from rising when repeated images are output, at least one or more selected from the group consisting of zinc oxide, titanium oxide, and tin oxide is preferable as the metal oxide particles.

A specific surface area of the inorganic particles by a BET method is preferably, for example, 10 $m^2/g$ or more. The BET specific surface area is measured using a nitrogen substitution method. Specifically, the BET specific surface area is measured by a three point method using an SA3100 specific surface area measuring apparatus (manufactured by Beckman Coulter, Inc.).

A volume average particle diameter of the inorganic particles is preferably, for example, from 50 nm to 2,000 nm (more preferably from 60 nm to 1,000 nm).

The volume average particle diameter is measured using a laser diffraction type particle size distribution measuring apparatus (LA-700: manufactured by Horiba, Ltd.). As a measuring method, 2 g of a measurement sample is added to 50 mL of a 5% aqueous solution of a surfactant, preferably sodium alkylbenzenesulfonate, and dispersed for 2 minutes with an ultrasonic disperser (1,000 Hz) to prepare a sample, and the sample is measured. The volume average particle diameter for each obtained channel is accumulated from the smaller one of the volume average particle diameter, and a point where the cumulative 50% is reached is taken as the volume average particle diameter.

From the viewpoint of preventing the residual potential from rising when repeated images are output, a content of the inorganic particles, specifically the metal oxide particles is preferably from 10% by weight to 80% by weight, and more preferably from 20% by weight to 70% by weight in the undercoating layer.

The inorganic particles may be subjected to a surface treatment. Two or more kinds of the inorganic particles, which are subjected to different surface treatments or have different particle diameters, may be mixed to be used.

Examples of a surface treatment agent include a silane coupling agent, a titanate coupling agent, an aluminum coupling agent, and a surfactant. In particular, the silane coupling agent is preferable.

Two or more kinds of the silane coupling agents may be mixed to be used.

Examples of the silane coupling agents include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, and 3-chloropropyltrimethoxysilane, but are not limited thereto.

The surface treatment method with the surface treatment agent may be any method as long as it is a known method, and either a dry method or a wet method may be used.

From the viewpoint of improving dispersibility, for example, the amount of the surface treatment agent for the treatment is preferably from 0.5% by weight to 10% by weight with respect to the inorganic particles.

From the viewpoint of improving long-term stability of electric characteristics and carrier blocking property, the undercoating layer may also contain an electron accepting compound (acceptor compound) together with the inorganic particles.

Examples of the electron accepting compound include electron transporting substances such as: quinone compounds such as chloranil and bromoanil; a tetracyanoquinodimethane compound; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole and 2,5-bis(4-naphthyl)-1,3,4-oxadiazole; a xanthone compound; a thiophene compound; and diphenoquinone compounds such as 3,3',5,5'-tetra-t-butyldiphenoquinone.

In particular, as the electron accepting compound, a compound having an anthraquinone structure is preferable. As the compound having an anthraquinone structure, for example, a hydroxyanthraquinone compound is preferable. Specifically, for example, anthraquinone, alizarin, quinizarin, antharufine, purpurin, and the like are preferable.

The electron accepting compound may be contained by being dispersed in the undercoating layer together with the inorganic particles or may be contained in a state of being attached to the surfaces of the inorganic particles.

Examples of a method of attaching the electron accepting compound to the surfaces of the inorganic particles include a dry method or a wet method.

The dry method is, for example, a method in which inorganic particles are stirred with a mixer or the like having a large shear force, and an electron accepting compound is dropped directly, an electron accepting compound dissolved in an organic solvent is dropped, or an electron accepting compound is sprayed together with dry air or nitrogen gas onto the inorganic particles being stirred, so as to attach the electron accepting compound to the surfaces of the inorganic particles. When dropping or spraying the electron accepting compound, the dropping or spraying the electron accepting compound may be carried out at a temperature equal to or lower than a boiling point of the solvent. After dropping or spraying the electron accepting compound, baking may further be carried out at 100° C. or higher. Baking is not particularly limited as long as the baking is carried out at a temperature and time at which electrophotographic characteristics are obtained.

The wet method is, for example, a method which includes dispersing inorganic particles in a solvent by stirring with ultrasonic wave, sand mill, attritor, ball mill, or the like, adding an electron accepting compound thereto, stirring or dispersing the resultant, and then removing the solvent to attach the electron accepting compound to the surfaces of the inorganic particles. In the solvent removal method, the solvent is removed, for example, by filtration or distillation. After removing the solvent, baking may further be carried out at 100° C. or higher. Baking is not particularly limited as long as the baking is carried out at a temperature and time at which electrophotographic characteristics are obtained. In the wet method, moisture contained in the inorganic particles may be removed before adding the electron accepting compound. Examples of this method include a method of removing the moisture while stirring and heating in a solvent, and a method of removing the moisture by azeotropic distillation with a solvent.

The attachment of the electron accepting compound may be carried out before or after the inorganic particles are subjected to the surface treatment with the surface treatment agent. Also, the attachment of the electron accepting compound and the surface treatment with the surface treatment agent may be carried out at the same time.

A content of the electron accepting compound may be, for example, from 0.01% by weight to 20% by weight, and is preferably from 0.01% by weight to 10% by weight with respect to the inorganic particles.

(Additives for Undercoating Layer)

The undercoating layer may also contain various additives.

As the additives, for example, binder resin particles may be added. Examples of the binder resin particles include known materials such as silicone binder resin particles and crosslinked polymethylmethacrylate (PMMA) binder resin particles.

(Properties of Undercoating Layer)

Hereinafter, the other properties of the undercoating layer are described.

From the viewpoint of preventing the rise in residual potential when repeated images are formed, a film thickness of the undercoating layer is preferably from 3 μm to 50 μm, more preferably from 3 μm to 30 μm, and still more preferably from 3 μm to 20 μm.

The film thickness of the undercoating layer is measured using an eddy current film thickness meter CTR-1500E manufactured by Sanko Denshi Co., Ltd.

From the viewpoint of preventing the residual potential from rising occurring when repeated images are formed, the volume resistivity of the undercoating layer is preferably from $1.0\times10^{4}$ (Ω·m) to $10\times10^{10}$ (Ω·m), more preferably from $1.0\times10^{6}$ (Ω·m) to $10\times10^{8}$ (Ω·m), and still more preferably from $1.0\times10^{6}$ (Ω·m) to $10\times10^{7}$ (Ω·m).

A method of preparing an undercoating layer sample to be used for measuring the volume resistivity, from an electrophotographic photoreceptor is as follows. For example, coating films such as a charge generation layer and a charge transport layer which cover the undercoating layer are removed using a solvent such as acetone, tetrahydrofuran, methanol, or ethanol, and a gold electrode is attached on the exposed undercoating layer by vacuum deposition method, a sputtering method, or the like to obtain an undercoating layer sample to be used for measuring the volume resistivity.

For measuring the volume resistivity by an alternating current impedance method, a SI 1287 electrochemical interface (manufactured by TOYO Corporation) as a power source, an SI 1260 impedance/gain phase analyzer (manufactured by TOYO Corporation) as an ammeter, and a 1296 dielectric interface (manufactured by Toyo Corporation) as a current amplifier are used.

Using an aluminum substrate in the AC impedance measurement sample as the cathode and the gold electrode as the anode, an AC voltage of 1 Vp-p is applied from the high frequency side in a frequency range from 1 MHz to 1 mHz, and the AC impedance of each sample is measured to calculate the volume resistivity by fitting the Cole-Cole plot graph obtained by the measurement to an RC parallel equivalent circuit.

The undercoating layer suitably has a Vickers hardness of 35 or higher.

In order to prevent a moire fringe, surface roughness (ten-point average roughness) of the undercoating layer may be adjusted from 1/(4n) (n is a refractive index of an upper layer) of the exposure laser wavelength λ to ½ thereof.

In order to adjust surface roughness, the binder resin particles or the like may be added to the undercoating layer. Examples of the binder resin particles include silicone binder resin particles and crosslinked polymethylmethacrylate binder resin particles. Further, in order to adjust the surface roughness, the surface of the undercoating layer may be polished.

Examples of a polishing method include buffing, sandblasting treatment, wet honing, and grinding treatment.

A forming method of the undercoating layer is not particularly limited and a known forming method is used. For example, a coating film of an undercoating layer forming coating liquid obtained by adding the above components to a solvent is formed, and the coating film may be dried and, as needed, heated to form the undercoating layer.

Examples of the dispersing method of the charge transporting material (in a case of further including the inorganic particles, the charge transporting material and the inorganic particles) when preparing the undercoating layer forming coating liquid include known methods such as a roll mill, a ball mill, a vibration ball mill, an attritor, a sand mill, a colloid mill, and a paint shaker.

Examples of a method for applying the undercoating layer forming coating liquid onto the conductive substrate include normal methods such as a blade coating method, a wire bar coating method, a spray coating method, a dipping coating method, a bead coating method, an air knife coating method, and a curtain coating method.

[Conductive Substrate]

Hereinafter, a conductive substrate in each of the first to third photoreceptors is described.

Examples of the conductive substrate include a metal plate including a metal (such as aluminum, copper, zinc, chromium, nickel, molybdenum, vanadium, indium, gold, and platinum) or an alloy (such as stainless steel), a metal drum, and a metal belt. In addition, examples of the conductive substrate also include paper, a resin film, and a belt which are obtained by applying, vapor-depositing, or laminating a conductive compound (for example, a conductive polymer, indium oxide, or the like), metal (for example, aluminum, palladium, gold, or the like), or an alloy. Here, "conductive" means that the volume resistivity is less than $1\times10^{13}\Omega\cdot m$.

In a case where the electrophotographic photoreceptor is used in a laser printer, the surface of the conductive substrate preferably roughened to have a center line average roughness Ra of 0.04 μm to 0.5 μm in order to prevent interference fringes when emitting laser light. In a case of using non-interference light as a light source, although roughening for prevention of interference fringes is not particularly necessary, since the roughening prevents defects due to irregularities on the surface of the conductive substrate, it is suitable for longer life.

Examples of a surface-roughening method include wet honing performed by suspending an abrasive in water and blowing suspension on the conductive substrate, centerless grinding performed by pressing the conductive substrate against a rotating grindstone and performing continuous grinding processing, and anodic oxidation.

Examples of the surface-roughening method also include a method in which a conductive or semi-conductive powder is dispersed in resin without roughening the surface of the conductive substrate to form a layer on the surface of the conductive substrate and surface-roughening is performed by particles dispersed in the layer.

The surface roughening treatment by anodic oxidation is to form an oxide film on the surface of the conductive substrate by anodizing in an electrolyte solution using a conductive substrate made of metal (for example, aluminum) as an anode. Examples of the electrolyte solution include a sulfuric acid solution and an oxalic acid solution. However, a porous anodic oxide film formed by the anodic oxidation is chemically active in the state as it is, is likely to be stained, and has a large change in resistance depending on the environment. Therefore, the porous anodic oxide film is preferably subjected to a sealing treatment that fine pores of the oxide film are blocked by volume expansion due to hydration reaction in pressurized water vapor or boiling water (a metal salt such as nickel may be added) to be changed to a more stable hydrated oxide.

A thickness of the anodic oxide film is preferably, for example, from 0.3 μm to 15 μm. When the film thickness is within the above range, there is tendency that barrier properties against injection is exhibited, and there is tendency that residual potential is prevented from rising due to repeated use.

The conductive substrate may also be subjected to a treatment with an acidic treatment solution or a boehmite treatment.

The treatment with the acidic treatment solution is carried out, for example, as follows. First, an acidic treatment liquid containing phosphoric acid, chromic acid, and hydrofluoric acid is prepared. A mixing ratio of the phosphoric acid, the chromic acid, and the hydrofluoric acid in the acidic treatment solution is, for example, from 10% by weight to 11% by weight of phosphoric acid, 3% by weight to and 5% by weight of chromic acid, and 0.5% by weight to 2% by weight, and a concentration of these whole acids may be from 13.5% by weight to 18% by weight. A treatment temperature is preferably, for example, from 42° C. to 48° C. A film thickness of the film to be coated is preferably from 0.3 μm to 15 μm.

The boehmite treatment is carried out by, for example, immersing the conductive substrate in deionized water having a temperature of 90° C. to 100° C. for 5 minutes to 60 minutes, or contacting the conductive substrate to heated steam having a temperature of 90° C. to 120° C. for 5 minutes to 60 minutes. A film thickness of the film to be coated is preferably from 0.1 μm to 5 μm. The anodic oxidation may be further performed using an electrolyte solution having low film solubility such as adipic acid, boric acid, borate, phosphate, phthalate, maleate, benzoate, tartrate, and citrate.

Hereinafter, each layer other than the undercoating layer in the first to third photoreceptors is described in detail.

[Intermediate Layer]

Although not shown, an intermediate layer may further be provided between the undercoating layer and the photosensitive layer.

The intermediate layer is, for example, a layer containing a resin. Examples of the resin used for the intermediate layer include polymer compounds such as acetal resin (such as polyvinyl butyral), polyvinyl alcohol resin, polyvinyl acetal resin, casein resin, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin, and melamin resin.

The intermediate layer may be a layer containing an organometallic compound. Examples of the organometallic compound used for the intermediate layer include an organometallic compound containing a metal atom such as zirconium, titanium, aluminum, manganese, and silicon.

These compounds used for the intermediate layer may be used alone, or as a mixture or polycondensate of plural compounds.

Among these, the intermediate layer is preferably a layer containing the organometallic compound having a zirconium atom or a silicon atom.

Formation of the intermediate layer is not particularly limited and a known forming method is used. For example, a coating film of an intermediate layer forming coating liquid obtained by adding the above components to a solvent is formed, and the coating film is dried to form the intermediate layer by heating as needed.

As a coating method by which the intermediate layer is formed, normal methods such as a dipping coating method, an extrusion coating method, a wire bar coating method, a spray coating method, a blade coating method, a knife coating method, and a curtain coating method are used.

A film thickness of the intermediate layer is set, for example, preferably within a range of 0.1 μm to 3 μm.

[Function-Separated Photosensitive Layer]

[Charge Generation Layer]

The charge generation layer is, for example, a layer containing a charge generation material and binder resin. Further, the charge generation layer may be a deposition layer of a charge generation material. The deposition layer of the charge generation material is suitable for a case of using an incoherent light source such as a light emitting diode (LED) or an organic electro-luminescence (EL) image array.

Examples of the charge generation material include azo pigments such as bisazo and trisazo; a condensed ring aromatic pigment such as dibromoanthanthrone; a perylene pigment; a pyrrolopyrrole pigment; a phthalocyanine pigment; zinc oxide; and trigonal selenium.

Among these materials, in order to cope with laser exposure in the near infrared region, it is preferable to use a metal phthalocyanine pigment or a metal-free phthalocyanine pigment, as the charge generation material. Specifically, for example, hydroxygallium phthalocyanine; chlorogallium phthalocyanine; dichlorotin phthalocyanine; and titanyl phthalocyanine are more preferable.

On the other hand, in order to cope with laser exposure in the near ultraviolet region, as the charge generation material, a condensed aromatic pigment such as dibromoanthanthrone; a thioindigo pigment; a porphyrazine compound; zinc oxide; trigonal selenium; and a bisazo pigment are preferable.

Also in a case of using an incoherent light source having an emission center wavelength of 450 nm to 780 nm, such as an LED or an organic EL image array, the above charge generation material may be used. However, from the viewpoint of resolution, when using a thin film of 20 μm or less as the photosensitive layer, the electric field intensity in the photosensitive layer increases, and charge reduction due to charge injection from the substrate and image defect referred to as a so-called black spot tend to occur. The tendency is remarkable when using a charge generation material which is likely to cause dark current in a p-type semiconductor such as trigonal selenium or a phthalocyanine pigment.

On the contrary, when using a n-type semiconductor such as a condensed ring aromatic pigment, a perylene pigment, and an azo pigment, as the charge generation material, it is unlikely to generate a dark current and, even in a thin film, the image defect called a black spot is prevented.

n-Type is determined depending on a polarity of flowing photocurrent by using a normally used time-of-flight method, and a type in which the photocurrent is easy to flow using electrons rather than holes as carriers is determined as the n-type.

The binder resin used for the charge generation layer is selected from a wide range of insulating resins. In addition, the binder resin may be selected from organic photoconductive polymers such as poly-N-vinylcarbazole, polyvinylanthracene, polyvinylpyrene, and polysilane.

Examples of the binder resin include polyvinyl butyral resin, polyarylate resin (such as polycondensate of bisphenols and aromatic dicarboxylic acid), polycarbonate resin, polyester resin, phenoxy resin, vinyl chloride-vinyl acetate copolymer, polyamide resin, acrylic resin, polyacrylamide resin, polyvinyl pyridine resin, cellulose resin, urethane resin, epoxy resin, casein, polyvinyl alcohol resin, and polyvinyl pyrrolidone resin. Here, "conductive" means that the volume resistivity is $1\times10^{13}\Omega\cdot$cm or more.

One kind of these binder resins is used alone or two or more kinds thereof are used by being mixed.

A mixing ratio of the charge generation material and the binder resin is preferably from 10:1 to 1:10 in terms of weight ratio.

The charge generation layer may also contain other known additives.

Formation of the charge generation layer is not particularly limited and a known forming method is used. For example, a coating film of a charge generation layer forming coating liquid obtained by adding the above components to a solvent is formed, and the coating film is dried to form the charge generation layer by heating as needed. The formation of the charge generation layer may be carried out by vapor deposition of the charge generation material. Formation of the charge generation layer by the vapor deposition is particularly suitable for a case of using a condensed ring aromatic pigment or a perylene pigment as the charge generation material.

Examples of a solvent for preparing the charge generation layer forming coating liquid include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. One kind of the solvents is used alone and two or more kinds thereof are used by being mixed.

In a method for dispersing particles (for example, charge generation material) in the charge generation layer forming coating liquid, for example, a media dispersing machine such as a ball mill, a vibration ball mill, an attritor, a sand mill, and a horizontal sand mill or a medialess dispersing machine such as a stirrer, an ultrasonic dispersing machine, a roll mill, and a high-pressure homogenizer is used. Examples of the high-pressure homogenizer include a collision type in which dispersing is performed by a liquid-liquid collision or a liquid-wall collision in a high pressure state, or a penetration type in which dispersing is performed by penetrating a fine flow path in a high pressure state.

When dispersing is performed, it is effective to set the average particle diameter of the charge generation material in the charge generation layer forming coating liquid to 0.5 μm or less, preferably 0.3 μm or less, and more preferably 0.15 μm or less.

Examples of a method for coating the undercoating layer (or an intermediate layer) with the charge generation layer forming coating liquid include normal methods such as a blade coating method, a wire bar coating method, a spray coating method, a dipping coating method, a bead coating method, an air knife coating method, and a curtain coating method.

A film thickness of the charge generation layer is set preferably from 0.1 μm to 5.0 μm, and more preferably from 0.2 μm to 2.0 μm.

[Charge Transport Layer]

The charge transport layer is, for example, a layer containing a charge transporting material and the binder resin. The charge transport layer may be a layer containing a polymeric charge transporting material.

Examples of the charge transporting material include electron transport compounds such as: quinone compounds such as p-benzoquinone, chloranil, bromanil, and anthraquinone; a tetracyanoquinodimethane compound; a fluorenone compound such as 2,4,7-trinitrofluorenone; a xanthone compound; a benzophenone compound; a cyanovinyl compound; and an ethylene compound. Examples of the charge transporting material also include hole transporting compounds such as a triarylamine compound, a benzidine compound, an arylalkane compound, an aryl-substituted ethylene compound, a stilbene compound, an anthracene compound, and a hydrazone compound. These charge transporting materials may be used alone or in combination of two or more thereof, but are not limited thereto.

As the charge transporting material, from the viewpoint of charge mobility, a triarylamine derivative represented by the following Formula (a-1) and a benzidine derivative represented by the following Formula (a-2) are preferable.

(a-1)

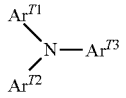

In Formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent of each of the above groups include a halogen atom, an alkyl group having 1 to 5 carbon atoms, and an alkoxy group having 1 to 5 carbon atoms. Examples of the substituent of each of the above groups also include a substituted amino group substituted with an alkyl group having 1 to 3 carbon atoms.

(a-2)

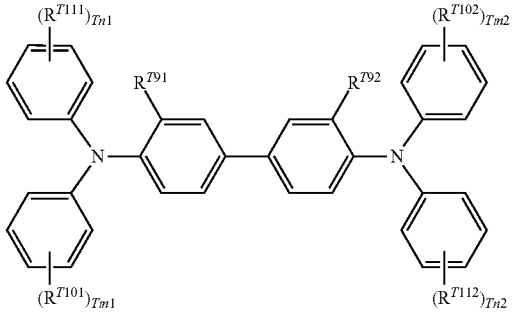

In Formula (a-2), $R^{T91}$, and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group having 1 or 2 carbon atoms substituted with an alkyl group, a substituted or unsubstituted aryl group, $—C(R^{T12})=C(R^{T13})(R^{T14})$, or $—CH=CH—CH=C(R^{T15})(R^{T16})$. $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 to 2.

Examples of the substituent of each of the above groups include a halogen atom, an alkyl group having 1 to 5 carbon atoms, and an alkoxy group having 1 to 5 carbon atoms. Examples of the substituent of each of the above groups also include a substituted amino group substituted with an alkyl group having 1 to 3 carbon atoms.

Among the triarylamine derivative represented by Formula (a-1) and the benzidine derivative represented by Formula (a-2), from the viewpoint of charge mobility, a triarylamine derivative having "$—C_6H_4—CH=CH—CH=C(R^{T7})(R^{T8})$" and a benzidine derivative having "$—CH=CH—CH=C(R^{T15})(R^{T16})$" are particularly preferable.

As the polymeric charge transporting material, known materials having charge transporting ability, such as poly-N-vinylcarbazole and polysilane are used. In particular, polyester polymeric charge transporting materials are particularly preferable. The polymer charge transporting material may be used alone or may be used in combination with the binder resin.

Examples of the binder resin used for the charge transport layer include polycarbonate resin, polyester resin, polyarylate resin, methacrylic resin, acrylic resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone alkyd resin, phenol-formaldehyde resin, styrene-alkyd resin, poly-N-vinylcarbazole, and polysilane. Among these resins, as the binder resin, the polycarbonate resin or the polyarylate resin is preferable. One kind of these binder resins is used alone or two or more kinds thereof are used.

A mixing ratio of the charge transporting material and the binder resin is preferably from 10:1 to 1:5 in terms of weight ratio.

The charge transport layer may also contain other known additives.

Formation of the charge generation layer is not particularly limited and a known forming method is used. For example, a coating film of a charge generation layer forming coating liquid obtained by adding the above components to a solvent is formed, and the coating film is dried to charge generation layer by heating as needed.

Examples of a solvent for preparing the charge transport layer forming coating liquid include ordinary organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. One kind of the solvents is used alone and two or more kinds thereof are used by being mixed.

Examples of an applying method used when applying the charge transport layer forming coating liquid onto the charge generation layer include normal methods such as a blade coating method, a wire bar coating method, a spray coating method, a dipping coating method, a bead coating method, an air knife coating method, and a curtain coating method.

A film thickness of the charge transport layer is set preferably from 5 μm to 50 μm, and more preferably from 10 μm to 30 μm.

[Protective Layer]

The protective layer is provided on the photosensitive layer as needed. The protective layer is provided, for example, to prevent the photosensitive layer from chemically changing at the time of charging and to further improve the mechanical strength of the photosensitive layer.

Therefore, a layer configured by a cured film (crosslinked film) may be applied to the protective layer. Examples of the layer include a layer shown in the following 1) or 2).

1) A layer configured by a cured film of a composition containing a reactive group-containing charge transporting material having a reactive group and a charge transporting skeleton in the same molecule (that is, a layer containing a polymer or crosslinked member of the reactive group-containing charge transporting material)

2) A layer configured by a cured film of a composition containing a non-reactive charge transporting material and a reactive group-containing non-charge transporting material having a reactive group without having a charge transporting skeleton (that is, a layer containing a non-reactive charge transporting material and a polymer or a crosslinked member of the reactive group-containing non-charge transporting material)

Examples of the reactive group of the reactive group-containing charge transporting material include known reactive groups such as a chain polymerizable group, an epoxy group, —OH, —OR [where R represents an alkyl group], —$NH_2$, —SH, —COOH, and —$SiR^{Q1}{}_{3-Qn}(OR^{Q2})_{Qn}$ [where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3].

The chain polymerizable group is not particularly limited as long as it is a functional group capable of radical polymerization, and is, for example, a functional group having a group containing at least a carbon double bond. Specific examples thereof include a group containing at least one selected from a vinyl group, a vinyl ether group, a vinyl thioether group, a styryl group (vinyl phenyl group), an acryloyl group, a methacryloyl group, and derivatives thereof. Among these, from the viewpoint of excellent reactivity, as the chain polymerizable group, a group containing at least one selected from the vinyl group, the styryl group (vinylphenyl group), the acryloyl group, the methacryloyl group, and derivatives thereof is preferable.

The charge transporting skeleton of the reactive group-containing charge transporting material is not particularly limited as long as it is a known structure in an electrophotographic photoreceptor, and examples thereof include skeleton derived from a nitrogen-containing hole transport compound such as a triarylamine compound, a benzidine compound, and a hydrazone compound, in which the skeleton has a structure conjugated with a nitrogen atom. Among these, a triarylamine skeleton is preferable.

The reactive group-containing charge transporting material having a reactive group and a charge transporting skeleton, the non-reactive charge transporting material, and the reactive group-containing non-charge transporting material may be selected from known materials.

The protective layer may also contain other known additives.

Formation of the protective layer is not particularly limited and a known forming method is used. For example, a coating film of a protective layer forming coating liquid obtained by adding the above components to a solvent is formed, and the coating film is dried to form the protective layer by heating as needed.

Examples of the solvent for preparing the protective layer forming coating liquid include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. One kind of the solvents is used alone and two or more kinds thereof are used by being mixed.

The protective layer forming coating liquid may be a solventless coating liquid.

Examples of a method of applying the protective layer forming coating liquid onto photosensitive layer (for example, charge transport layer) include normal methods such as a dipping coating method, an extrusion coating method, a wire bar coating method, a spray coating method, a blade coating method, a knife coating method, and a curtain coating method.

A film thickness of the protective layer is set, for example, preferably from 1 μm to 20 μm, and more preferably from 2 μm to 10 μm.

[Singlelayer Type Photosensitive Layer]

The singlelayer type photosensitive layer (charge generation/transport layer) is, for example, a layer containing a charge generation material and a charge transporting material, and further contains binder resin and other known additives, as needed. These materials are the same as those described for the charge generation layer and the charge transport layer.

Then, a content of the charge generation material in the singlelayer type photosensitive layer may be from 0.1% by weight to 10% by weight, and is preferably from 0.8% by weight to 5% by weight, based on the total solid content in the first to third photoreceptors. In addition, a content of the charge transporting material in the singlelayer type photosensitive layer may be from 5% by weight to 50% by weight, based on the total solid content.

The method of forming the singlelayer type photosensitive layer is the same as the method of forming the charge generation layer and the charge transport layer.

A film thickness of the singlelayer type photosensitive layer may be from 5 μm to 50 μm, and is preferably from 10 μm to 40 μm.

[Image Forming Apparatus and Process Cartridge]

An image forming apparatus, in which the first to third photoreceptors are used, according to the exemplary embodiment includes: an electrophotographic photoreceptor; a charging unit that charges a surface of the electrophotographic photoreceptor; an electrostatic latent image forming unit that forms an electrostatic latent image on the charged surface of the electrophotographic photoreceptor; a developing unit that develops the electrostatic latent image formed on the surface of the electrophotographic photoreceptor with a developer including toner to form a toner image; and a transfer unit that transfers the toner image onto a surface of a recording medium. As the electrophotographic photoreceptor, the electrophotographic photoreceptor according to the exemplary embodiment is adopted.

As the image forming apparatus according to the exemplary embodiment, known image forming apparatuses are adopted. Examples thereof include an apparatus including fixing unit that fixes a transferred toner image to a surface of a recording medium; a direct transfer type apparatus that directly transfers a toner image formed on a surface of an electrophotographic photoreceptor to a recording medium; an intermediate transfer type apparatus that primarily transfers a toner image formed on a surface of an electrophotographic photoreceptor to a surface of an intermediate transfer member and secondarily transfers the toner image transferred to the surface of the intermediate transfer member onto a surface of a recording medium; an apparatus including a cleaning unit that cleans a surface of the electrophotographic photoreceptor after the transfer of the toner image and before charging; an apparatus including an erasing unit that irradiates a surface of the electrophotographic photoreceptor after the transfer of a toner image and before charging, with antistatic electricity to erase electricity; and an apparatus including an electrophotographic photoreceptor heating unit that raise a temperature of an electrophotographic photoreceptor and reduces a relative temperature.

In a case of the intermediate transfer type apparatus, the transfer unit adopts, for example, a configuration including an intermediate transfer member in which a toner image is transferred on a surface thereof, a first transfer unit that firstly transfers the toner image formed on the surface of the electrophotographic photoreceptor to a surface of the intermediate transfer member, and a second transfer unit that secondarily transfers the toner image transferred to the surface of the intermediate transfer member to a surface of a recording medium.

The image forming apparatus according to the exemplary embodiment may be any of a dry developing type image forming apparatus or a wet developing type (a developing type using a liquid developer) image forming apparatus.

In the image forming apparatus according to the exemplary embodiment, for example, a portion having an electrophotographic photoreceptor may have a cartridge structure (process cartridge) which is detachable from the image forming apparatus. As the process cartridge, for example, a process cartridge including the electrophotographic photoreceptor according to the exemplary embodiment is suitably used. In the process cartridge may further include, for example, at least one selected from the group consisting of a charging unit, an electrostatic latent image forming unit, a developing unit, and a transfer unit, in addition to the electrophotographic photoreceptor.

Hereinafter, an example of the image forming apparatus according to the exemplary embodiment is shown, but the image forming apparatus is not limited thereto. A major part shown in the figure is described, and descriptions for the other parts are omitted.

Figure 2:
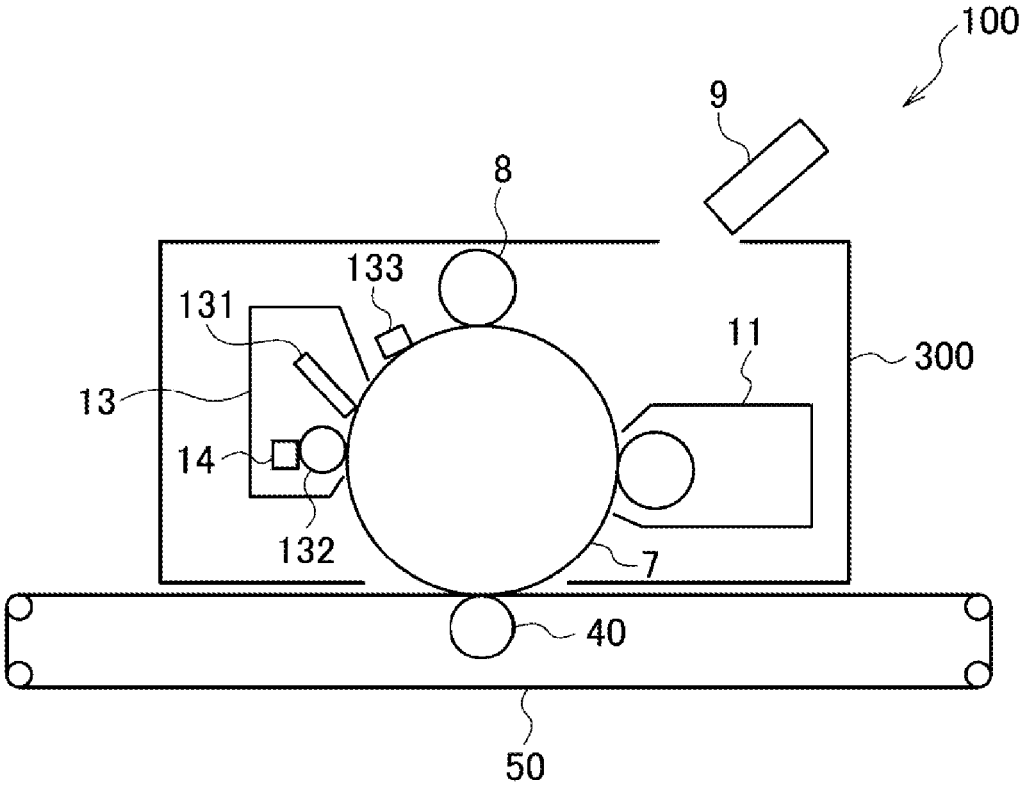
FIG. 2 is a schematic configuration diagram illustrating an example of an image forming apparatus according to the exemplary embodiment.

FIG. 2 is a configuration diagram illustrating an example of the image forming apparatus according to the exemplary embodiment.

As shown in FIG. 2, the image forming apparatus 100 according to the exemplary embodiment includes a process cartridge 300 having an electrophotographic photoreceptor 7, an exposure device 9 (an example of an electrostatic latent image forming unit), a transfer device 40 (first transfer device), and an intermediate transfer member 50. In the image forming apparatus 100, the exposure device 9 is disposed at a position at which the electrophotographic photoreceptor 7 may be exposed from an opening of the process cartridge 300, the transfer device 40 is disposed at a position facing the electrophotographic photoreceptor 7 via the intermediate transfer member 50, and the intermediate transfer member 50 is disposed so that a part thereof is in contact with the electrophotographic photoreceptor 7. Although not shown, the image forming apparatus 100 further includes a second transfer device that transfers the toner image transferred to the intermediate transfer member 50 to a recording medium (for example, paper). The intermediate transfer member 50, the transfer device 40 (first transfer device), and the second transfer device (not shown) correspond to examples of the transfer unit.

The process cartridge 300 in FIG. 2 includes the electrophotographic photoreceptor 7, a charging device 8 (an example of the charging unit), a developing device 11 (an example of the developing unit), and a cleaning device 13 (an example of the cleaning unit), which are in a housing and are integrally supported. The cleaning device 13 has a cleaning blade (an example of a cleaning member) 131. The cleaning blade 131 is disposed so as to contact with a surface of the electrophotographic photoreceptor 7. The cleaning member may be a conductive or insulating fibrous member, instead of an aspect of the cleaning blade 131. The conductive or insulating fibrous member may be used alone or in combination with the cleaning blade 131.

In FIG. 2, as the image forming apparatus, an example of including a fibrous member 132 (roll-shaped) that supplies a lubricant 14 to the surface of the electrophotographic photoreceptor 7 and a fibrous member 133 (flat brush shaped) that assists cleaning is shown, but these are disposed as needed.

Hereinafter, a configuration of the image forming apparatus according to the exemplary embodiment is described.

Charging Device

As the charging device 8, for example, a contact type charger using a conductive or semiconductive charging roller, a charging brush, a charging film, a charging rubber blade, a charging tube, or the like is used. In addition, a non-contact type roller charger, a charger known as it is such as a scorotron charger or a corotron charger using corona discharge, or the like is also used.

Exposure Device

Examples of the exposure device 9 include an optical system device the exposes the surface of the electrophotographic photoreceptor 7 to light such as semiconductor laser light, LED light, liquid crystal shutter light according to an image data. A wavelength of the light source is within a spectral sensitivity range of the electrophotographic photoreceptor. As a wavelength of the semiconductor laser, near infrared having an emission wavelength near 780 nm is mostly used. However, the wavelength is not limited thereto, and an emission wavelength laser of 600 nm band or a laser having an emission wavelength of 400 nm to 450 nm as blue laser may also be used. In addition, a surface emitting type laser light source capable of outputting multiple beams is also effective for forming a color image.

Developing Device

Examples of the developing device 11 include a general developing device that develops an image by contacting or non-contacting with a developer. The developing device 11 is not particularly limited as long as it has the above-described function, and is selected according to the purpose. Examples thereof include a known developing machine having a function of attaching a single-component developer or a two-component developer to the electrophotographic photoreceptor 7 using a brush, a roller, or the like.

Among the examples, it is preferable to use a developing roller holding developer on a surface thereof.

The developer used for the developing device 11 may be a single-component developer of toner alone or a two-component developer including toner and a carrier. In addition, the developer may be magnetic or nonmagnetic. Known developers are adopted to these developers.

Cleaning Device

As the cleaning device 13, a cleaning blade type device including a cleaning blade 131 is used.

In addition to the cleaning blade type, a fur brush cleaning type and a development simultaneous cleaning type may be adopted.

Transfer Device

Examples of the transfer device 40 include a contact type transfer charger using a belt, a roller, a film, a rubber blade, or the like and a transfer charger known as it is such as a scorotron transfer charger or a corotron transfer charger using corona discharge.

Intermediate Transfer Member

As the intermediate transfer member 50, a belt-shaped member (intermediate transfer belt) containing polyimide, polyamideimide, polycarbonate, polyarylate, polyester, rubber, or the like to which semiconductivity is imparted is used. In addition, as a form of the intermediate transfer member, a drum-shaped member may be used in addition to the belt shape.

Figure 3:
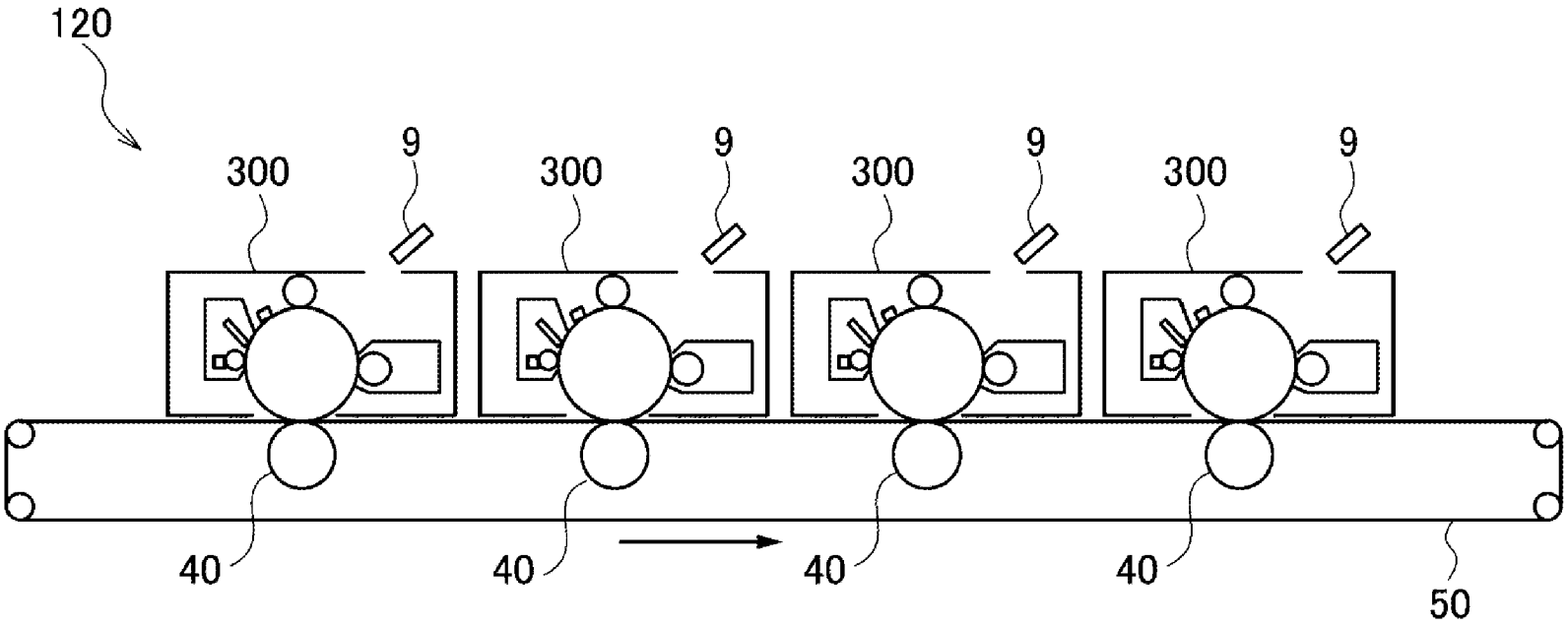
FIG. 3 is a schematic configuration diagram illustrating another example of the image forming apparatus according to the exemplary embodiment.

FIG. 3 is a configuration diagram illustrating another example of the image forming apparatus according to the exemplary embodiment.

An image forming apparatus 120 shown in FIG. 3 is a tandem multicolor image forming apparatus on which four process cartridges 300 are mounted. The image forming apparatus 120 has a configuration in which four process cartridges 300 are arranged in parallel on the intermediate transfer member 50 and one electrophotographic photoreceptor is used for each color. The image forming apparatus 120 has the same configuration as that of the image forming apparatus 100 except for the tandem type.

EXAMPLES

Hereinafter, the electrophotographic photoreceptor of the present disclosure will be described more specifically by giving Examples. Materials, using amounts, ratios, processing procedures, and the like shown in the following examples may be appropriately changed without departing from the gist of the present disclosure. Accordingly, the scope of the electrophotographic photoreceptor of the present disclosure should not be interpreted restrictively by the following specific examples.

<Preparation of Photoreceptor>

Example 1

(Formation of Undercoating Layer)

20 parts by weight of blocked isocyanate (SUMIDUR BL 3175, manufactured by Sumitomo Bayer Urethane Co, Ltd., solid content of 75% by weight) and 7.5 parts by weight of butyral resin (S-LEC BL-1, manufactured by Sekisui Chemical Co., Ltd.) are dissolved in 150 parts by weight of methyl ethyl ketone. 34 parts by weight of a mixture (weight ratio 1:1) of the perinone compound (1-1) and the perinone compound (2-1) is mixed to the solution and dispersed for 10 hours with a sand mill using glass beads having a diameter of 1 mm to obtain a dispersion. 0.005 parts by weight of bismuth carboxylate (K-KAT XK-640, manufactured by King Industries, Inc.) and 2 parts by weight of silicone resin particles (TOSPEARL 145, manufactured by Momentive) are added to the dispersion, thereby obtaining a coating liquid for forming an undercoating layer. Dipping coating is performed on a cylindrical aluminum substrate with the coating liquid, and drying and curing are performed at 160° C. for 60 minutes to form an undercoating layer having a thickness of 7 μm. Volume resistivity of the undercoating layer is measured using a ferroelectric evaluation system (QV & IV converter Model 6252C type, manufactured by TOYO Corporation).

(Formation of Charge Generation Layer)

As the charge generation material, hydroxygallium phthalocyanine having diffraction peaks on positions at Bragg angles (2θ±0.2°) of at least 7.3°, 16.0°, 24.9°, and 28.0° in an X-ray diffraction spectrum using a CuKα characteristic X-ray is prepared. A mixture obtained by mixing 15 parts by weight of the hydroxygallium phthalocyanine, 10 parts by weight of vinyl chloride-vinyl acetate copolymer binder resin (VMCH, manufactured by Nippon Unicar Company Limited), and 200 parts by weight of n-butyl acetate is dispersed for 4 hours with a sand mill using glass beads having a diameter of 1 mm. 175 parts by weight of n-butyl acetate and 180 parts by weight of methyl ethyl ketone are added to the obtained dispersion and stirred to obtain a charge generation layer forming coating liquid. Dipping coating is performed on an undercoating layer with the coating liquid, and drying is performed at 150° C. for 15 minutes to form a charge generation layer having a thickness of 0.2 μm.

(Formation of Charge Transport Layer)

38 parts by weight of charge transporting agent (HT-1), 10 parts by weight of charge transporting agent (HT-2), and 52 parts by weight of polycarbonate (A) (viscosity average molecular weight: 46,000) are added to 800 parts by weight of tetrahydrofuran, and dissolved therein. 8 parts by weight of tetrafluoroethylene resin (LUBRON L5, manufactured by Daikin Industries Ltd., average particle diameter of 300 nm) is added thereto and dispersed at 5,500 rpm for 2 hours using a homogenizer (ULTRA-TURRAX manufactured by IKA) to obtain a coating liquid for forming a charge transport layer. Dipping coating is performed on the charge generation layer with the coating liquid, and drying is performed at 140° C. for 40 minutes to form a charge transport layer having a thickness of 29 μm. A photoreceptor of Example 1 is obtained by the above processing.

(HT-1)

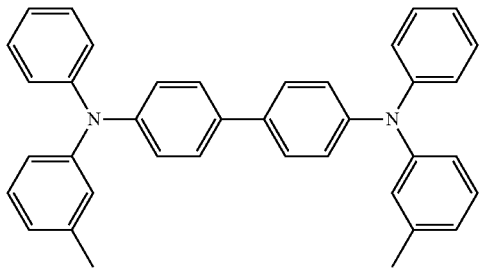

Charge transporting agent

-continued (HT-2)

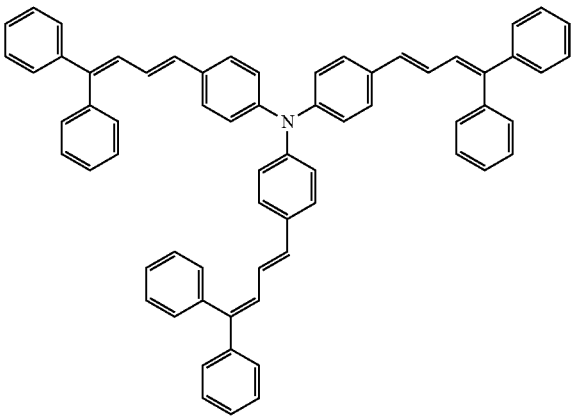

Charge transporting agent

Polycarbonate (A)

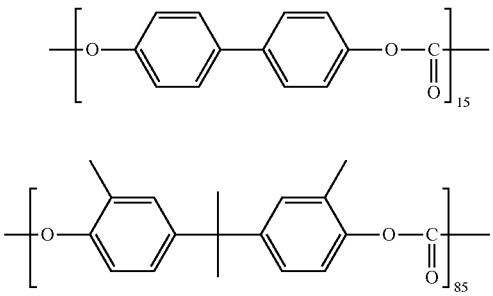

Comparative Examples 1 to 3

Except that, in formation of the undercoating layer, the perinone compounds are changed to imide compounds shown in Table 1, photoreceptors are prepared in the same manner as in Example 1. A chemical structure of an imide compound (A), an imide compound (B), or an imide compound (C) used in Comparative Examples 1 to 3 is shown below.

Imide compound (A)

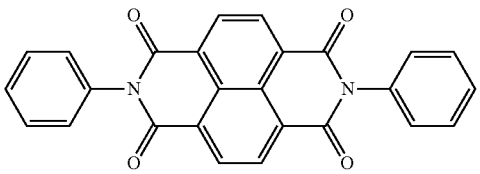

Imide compound (B)

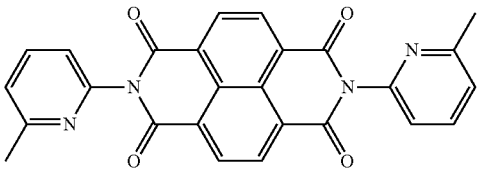

-continued

Imide compound (C)

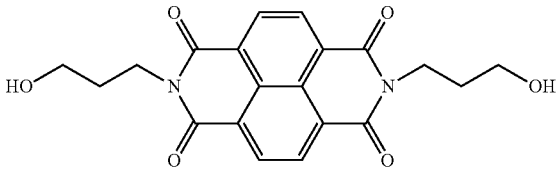

Comparative Example 4

Except that, in formation of the undercoating layer, the binder resin is changed from the polyurethane to polyamide and the procedure of forming the undercoating layer is changed as described below, a photoreceptor is prepared in the same manner as in Example 1.

(Formation of Undercoating Layer)

22.5 parts by weight of polyamide resin CM 8000 (manufactured by Toray Industries, Inc.) is dissolved in 120 parts by weight of methanol and 60 parts by weight of isopropanol. 34 parts by weight of a mixture (weight ratio 1:1) of the perinone compound (1-1) and the perinone compound (2-1) is mixed to the solution and dispersed for 10 hours with a sand mill using glass beads having a diameter of 1 mm to obtain a dispersion. 2 parts by weight of silicone resin particles (TOSPEARL 145, manufactured by Momentive) are added to the dispersion, thereby obtaining a coating liquid for forming an undercoating layer. Dipping coating is performed on a cylindrical aluminum substrate with the coating liquid, and drying and curing are performed at 110° C. for 40 minutes to form an undercoating layer having a thickness of 7 μm.

Comparative Example 5

Except that, in formation of the undercoating layer, the binder resin is changed from the polyurethane to polycarbonate and the procedure of forming the undercoating layer is changed as described below, a photoreceptor is prepared in the same manner as in Example 1.

(Formation of Undercoating Layer)

22.5 parts by weight of polycarbonate resin PANLITE TS-2050 (manufactured by Teijin Limited) is dissolved in 160 parts by weight of tetrahydrofuran. 34 parts by weight of a mixture (weight ratio 1:1) of the perinone compound (1-1) and the perinone compound (2-1) is mixed to the solution and dispersed for 10 hours with a sand mill using glass beads having a diameter of 1 mm to obtain a dispersion. 2 parts by weight of silicone resin particles (TOSPEARL 145, manufactured by Momentive) are added to the dispersion, thereby obtaining a coating liquid for forming an undercoating layer. Dipping coating is performed on a cylindrical aluminum substrate with the coating liquid, and drying and curing are performed at 135° C. for 50 minutes to form an undercoating layer having a thickness of 7 μm.

(Formation of Charge Transport Layer)

Except that the dipping coating is changed to spray coating, a charge transport layer is formed in the same forming procedure of the charge transport layer in Example 1.

Examples 2 and 3

Except that, in formation of the undercoating layer, an adding amount of bismuth carboxylate (K-KAT and XK-640, manufactured by King Industries, Inc.) is changed as described in Table 1, photoreceptors are prepared in the same manner as in Example 1.

Examples 4 to 9

Except that, in formation of the undercoating layer, the perinone compounds are changed as described in Table 1, photoreceptors are prepared in the same manner as in Example 1.

Examples 10 and 12

Except that, in formation of the undercoating layer, the bismuth carboxylate (K-KAT and XK-640, manufactured by King Industries, Inc.) is changed to an organic acid metal salt or a metal complex described in Table 1, photoreceptors are prepared in the same manner as in Example 1.

The aluminum complex used in Example 10 is K-KAT 5218 (manufactured by King Industries, Inc.).

The zirconium complex used in Example 11 is K-KAT 4205 (manufactured by King Industries, Inc.).

Examples 13 to 15

Except that the metal oxide particles described in Table 1 is added to the coating liquid for forming the undercoating layer, photoreceptors are prepared in the same manner as in Example 1.

The zinc oxide particles used in Example 13 are particles prepared by surface treating zinc oxide particles (volume average particle diameter of 70 nm, specific surface area of 15 $m^2/g$, and MZ-150 manufactured by Tayca Corporation), which is not surface-treated, with a silane coupling agent (3-methacryloxypropylmethyl diethoxysilane, KBE-502 manufactured by Shin-Etsu Chemical Co., Ltd.).

The titanium oxide particles used in Example 14 have a volume average particle diameter of 30 nm (TAF-1500) manufactured by Fuji Titanium Industry Co., Ltd.).

The tin oxide particles used in Example 15 have volume average particle diameter of 20 nm (S1 manufactured by Mitsubishi Materials Corporation).

<Photoreceptor Performance Evaluation>

The photoreceptors of the foregoing Examples and Comparative Examples each is mounted on an image forming apparatus DOCU CENTRE C5570 (manufactured by Fuji Xerox Co., Ltd.), and the following performance evaluation is performed in an environment at a temperature of 30° C. and a relative humidity of 85%. Evaluation results are shown in Table 1.

[Leak Resistance]

Leak resistance is evaluated based on a phenomenon that a spotted image defect occurs when current leaks in the photoreceptor.

An image with a density of 20% is continuously output on 20,000 sheets of A4 paper and 10 hours later, an image with a density of 20% is output on 10 sheets of A4 paper under the environment at a temperature of 28° C. and a relative humidity of 80%. In all 10 sheets, the presence or absence of the spotted image defect is visually observed, and a degree of the image defects is classified as A to C below.

A: There is no spotted image defect.

B: The number of spotted image defects is less than 10, which may be acceptable for practical use.

C: There are 10 or more spotted image defects, which becomes a problem in practical use.

[Charge Retention Characteristic]

A surface potential probe of an electrostatic voltmeter (TREK 334 manufactured by Trek, Inc.) is installed at a position 1 mm away from the surface of the photoreceptor.

After charging the surface of the photoreceptor to −700 V, a potential dropped amount (dark attenuation amount) after 0.1 seconds is measured and the potential dropped amount is classified as A to C below.

A: Potential dropped amount is less than 25 V

B: Potential dropped amount is 25 V or more and less than 50 V

C: Potential dropped amount is 50 V or more

[Prevention from Rise in Residual Potential]

A surface potential probe of an electrostatic voltmeter (TREK 334 manufactured by Trek, Inc.) is installed at a position 1 mm away from the surface of the photoreceptor.

The surface of the photoreceptor is charged to −700 V, and then, is exposed to monochromatic light (half width 20 nm, light amount of 1.5 $\mu J/cm^2$) having a wavelength of 780 mu (irradiation time: 80 msec). The surface potential (residual potential) is measured at the time when 330 milliseconds elapse from the start of exposure.

Before and after an image with a density of 20% is continuously output on 20,000 sheets of A4 paper, the above measurements are performed. A residual potential difference is calculated by subtracting residual potential before the output from residual potential after the output. The residual potential difference is classified as A to C below.

A: Residual potential difference is less than 100 V, which is no problem in practical use.

B: Residual potential difference is 100 V or more and less than 150 V, which may be acceptable for practical use.

C: Residual potential difference is 150 V or more, which becomes a problem in practical use.

[Prevention from Sticking of Foreign Matter]

When a carbon fiber penetrates the photosensitive layer and the undercoating layer and reaches the aluminum substrate, prevention from sticking of foreign matters is evaluated by using a phenomenon that a spotted image defect due to current flow.

A certain amount of the carbon fibers (average diameter of 7 μm and average length of 30 μm) is mixed in a developer so as to be a concentration of 0.1% by weight, and an image with a density of 20% is continuously output on 20,000 sheets of A4 paper. Next, an image with a density of 20% is output on 10 sheets of A4 paper. In an image in 10th sheet, the presence or absence of the spotted image defect is visually observed, and a degree of the image defects is classified as A to C below.

A: There is no spotted image defect.

B: The number of spotted image defects is less than 10, which may be acceptable for practical use.

C: There are 10 or more spotted image defects, which becomes a problem in practical use.

TABLE 1

| | Materials and solid contents of undercoating layer (parts by weight) | | | | | | | | |
|---|---|---|---|---|---|---|---|---|---|
| | Electron transporting compound | | Binder resin | | Organic acid metal salt or metal complex | | Silicone resin particles | Metal oxide particles | |
| | Kinds | Parts | Kinds | Parts | Kinds | Parts | Parts | Kinds | Parts |
| Comparative Example 1 | Imide compound (A) | 34 | Polyurethane | 22.5 | Bismuth carboxylate | 0.005 | 2 | — | 0 |
| Comparative Example 2 | Imide compound (B) | 34 | Polyurethane | 22.5 | Bismuth carboxylate | 0.005 | 2 | — | 0 |
| Comparative Example 3 | Imide compound (C) | 34 | Polyurethane | 22.5 | Bismuth carboxylate | 0.005 | 2 | — | 0 |
| Comparative Example 4 | Perinone compounds (1-1) and (2-1) | 34 | Polyamide | 22.5 | — | 0 | 2 | — | 0 |
| Comparative Example 5 | Perinone compounds (1-1) and (2-1) | 34 | Polycarbonate | 22.5 | — | 0 | 2 | — | 0 |
| Example 1 | Perinone compounds (1-1) and (2-1) | 34 | Polyurethane | 22.5 | Bismuth carboxylate | 0.005 | 2 | — | 0 |
| Example 2 | Perinone compounds (1-1) and (2-1) | 34 | Polyurethane | 22.5 | Bismuth carboxylate | 0.002 | 2 | — | 0 |
| Example 3 | Perinone compounds (1-1) and (2-1) | 34 | Polyurethane | 22.5 | Bismuth carboxylate | 1.8 | 2 | — | 0 |
| Example 4 | Perinone compounds (1-2) and (2-2) | 34 | Polyurethane | 22.5 | Bismuth carboxylate | 0.005 | 2 | — | 0 |
| Example 5 | Perinone compounds (1-3) and (2-3) | 34 | Polyurethane | 22.5 | Bismuth carboxylate | 0.005 | 2 | — | 0 |
| Example 6 | Perinone compounds (1-6) and (2-6) | 34 | Polyurethane | 22.5 | Bismuth carboxylate | 0.005 | 2 | — | 0 |
| Example 7 | Perinone compounds (1-7) and (2-7) | 34 | Polyurethane | 22.5 | Bismuth carboxylate | 0.005 | 2 | — | 0 |
| Example 8 | Perinone compound (1-1) | 34 | Polyurethane | 22.5 | Bismuth carboxylate | 0.005 | 2 | — | 0 |
| Example 9 | Perinone compound (2-1) | 34 | Polyurethane | 22.5 | Bismuth carboxylate | 0.005 | 2 | — | 0 |
| Example 10 | Perinone compounds (1-1) and (2-1) | 34 | Polyurethane | 22.5 | Aluminum complex | 0.005 | 2 | — | 0 |
| Example 11 | Perinone compounds (1-1) and (2-1) | 34 | Polyurethane | 22.5 | Zirconium complex | 0.005 | 2 | — | 0 |
| Example 12 | Perinone compounds (1-1) and (2-1) | 34 | Polyurethane | 22.5 | Dibutyltin laurate | 0.005 | 2 | — | 0 |
| Example 13 | Perinone compounds (1-1) and (2-1) | 34 | Polyurethane | 22.5 | Bismuth carboxylate | 0.005 | 2 | Zinc oxide particles | 15 |
| Example 14 | Perinone compounds (1-1) and (2-1) | 34 | Polyurethane | 22.5 | Bismuth carboxylate | 0.005 | 2 | Titanium oxide particles | 15 |
| Example 15 | Perinone compounds (1-1) and (2-1) | 34 | Polyurethane | 22.5 | Bismuth carboxylate | 0.005 | 2 | Tin oxide particles | 15 |

| | | | Performance evaluation | | | |
|---|---|---|---|---|---|---|
| | Thickness of undercoating layer [μm] | Volume resistivity of undercoating layer [Ω · cm] | Leak resistance | Charge retention characteristic | Prevention from Rise in Residual Potential | Prevention from sticking of foreign matters |
| Comparative Example 1 | 7 | $8 \times 10^{11}$ | B | B | C | B |
| Comparative Example 2 | 7 | $8 \times 10^{11}$ | B | B | C | B |
| Comparative Example 3 | 7 | $9 \times 10^{11}$ | B | B | C | B |
| Comparative Example 4 | 7 | $2 \times 10^{10}$ | C | C | C | C |
| Comparative Example 5 | 7 | $9 \times 10^{11}$ | A | B | C | C |
| Example 1 | 7 | $7 \times 10^{10}$ | A | A | A | A |
| Example 2 | 7 | $6 \times 10^{10}$ | B | A | A | B |
| Example 3 | 7 | $8 \times 10^{10}$ | A | A | A | B |
| Example 4 | 7 | $6 \times 10^{10}$ | A | A | A | A |
| Example 5 | 7 | $9 \times 10^{10}$ | A | A | A | A |
| Example 6 | 7 | $2 \times 10^{11}$ | A | A | A | A |
| Example 7 | 7 | $1 \times 10^{11}$ | A | A | A | A |
| Example 8 | 7 | $5 \times 10^{10}$ | A | A | A | A |
| Example 9 | 7 | $5 \times 10^{10}$ | A | A | A | A |

TABLE 1-continued

| | | | | | | |
|---|---|---|---|---|---|---|
| Example 10 | 7 | $5 \times 10^{11}$ | A | B | B | B |
| Example 11 | 7 | $4 \times 10^{11}$ | A | B | B | B |
| Example 12 | 7 | $7 \times 10^{10}$ | A | B | B | B |
| Example 13 | 10 | $3 \times 10^{10}$ | A | A | A | A |
| Example 14 | 10 | $3 \times 10^{10}$ | A | A | A | A |
| Example 15 | 10 | $1 \times 10^{10}$ | A | A | A | A |

<Preparation of Photoreceptor>

Example 1A (Formation of Undercoating Layer)

20 parts by weight of blocked isocyanate (SUMIDUR BL 3175, manufactured by Sumitomo Bayer Urethane Co, Ltd., solid content of 75% by weight), 7.5 parts by weight of butyral resin (S-LEC BL-1, manufactured by Sekisui Chemical Co., Ltd.), and 0.005 parts by weight of catalyst dioctyltin dilaurate are dissolved in 143 parts by weight of methyl ethyl ketone. 50 parts by weight of a mixture (weight ratio 1:1) of the perinone compound (1-1) and the perinone compound (2-1) and 10 parts by weight of the acceptor compound (6-5) are mixed to the solution and dispersed for 120 minutes with a sand mill using glass beads having a diameter of 1 mm to obtain a coating liquid for forming an undercoating layer. Dipping coating is performed on a cylindrical aluminum substrate with the coating liquid by a dipping coating method, and drying and curing are performed at 160° C. for 60 minutes to form an undercoating layer 1 having a thickness of 18.7 μm.

(Formation of Charge Generation Layer)

As the charge generation material, hydroxygallium phthalocyanine having diffraction peaks on positions at Bragg angles (θ±0.2°) of at least 7.3°, 16.0°, 24.9°, and 28.0° in an X-ray diffraction spectrum using a CuKα characteristic X-ray is prepared. A mixture including 15 parts by weight of the hydroxygallium phthalocyanine, 10 parts by weight of vinyl chloride-vinyl acetate copolymer binder resin (VMCH, manufactured by Nippon Unicar Company Limited) as the binder resin, and 200 parts by weight of n-butyl acetate is dispersed for 4 hours with a sand mill using glass beads having a diameter of 1 mm. 175 parts by weight of n-butyl acetate and 180 parts by weight of methyl ethyl ketone are added to the obtained dispersion and stirred to obtain a coating liquid for forming a charge generation layer. Dipping coating is performed on an undercoating layer on the cylindrical aluminum substrate with the coating liquid for forming a charge generation layer, and drying is performed at a room temperature (25° C.) to form a charge generation layer having a thickness of 0.2 μm.

(Formation of Charge Transport Layer)

First, a polycarbonate copolymer (1) is obtained as follows.

In a flask includes a phosgene blowing tube, a thermometer, and a stirrer, 106.9 g (0.398 mol) of 1,1-bis(4-hydroxyphenyl) cyclohexane (hereinafter, referred to as Z), 24.7 g (0.133 mol) of 4,4'-dihydroxybiphenyl (hereinafter, referred to as BP), 0.41 g of hydrosulfite, 825 mL (sodium hydroxide 2.018 mol) of 9.1% sodium hydroxide aqueous solution, and 500 mL of methylene chloride are charged, dissolved, and maintained in 18° C. to 21° C. while stirring, and 76.2 g (0.770 mol) of phosgene is blown over 75 minutes to perform a phosgene reaction. After completion of the phosgenation reaction, 1.11 g (0.0075 mol) of p-tert-butylphenol and 54 mL (sodium hydroxide of 0.266 mol) of a 25% sodium hydroxide aqueous solution are added and stirred, 0.18 mL (0.0013 mol) of triethylamine is added in the stirring, and reaction is performed at a temperature of 30° C. to 35° C. for 2.5 hours. The separated methylene chloride phase is washed with an acid and washed with water until there is no inorganic salt and amines, and then methylene chloride is removed to obtain the polycarbonate copolymer (1). With respect to this polycarbonate, a ratio of components of Z and BP is 75:25.

Next, 25 parts by weight of N,N'-diphenyl-N,N-bis(3-methylphenyl)-[1,1']biphenyl-4,4'-diamine (TPD), 20 parts by weight of a compound represented by Formula (A) shown below, and 55 parts by weight of the polycarbonate copolymer (1) (viscosity average molecular weight 50,000) as a binder resin are added to 560 parts by weight of tetrahydrofuran and 240 parts by weight of toluene and dissolved to obtain a coating liquid for forming a charge transport layer. Dipping coating is performed on the charge generation layer with the coating liquid, and the resultant is dried at 135° C. for 45 minutes to form a charge transport layer having a thickness of 22 μm. Through the above processing, a photoreceptor is prepared.

Formula (A)

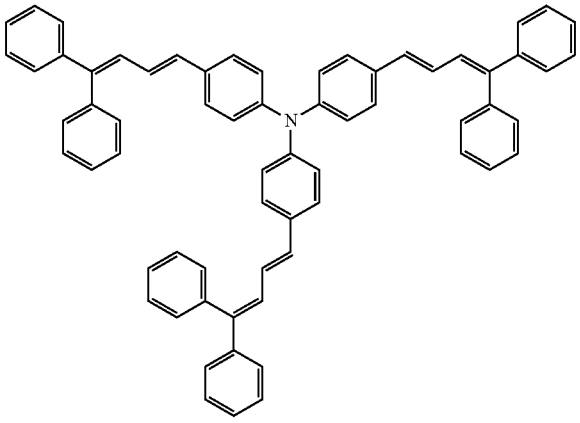

Examples 2A to 22A

Except that materials for the undercoating layer are changed as described in Table 2, the respective photoreceptors are prepared in the same manner as in Example 1.

Comparative Examples 1A to 3A

Except that materials for the undercoating layer are changed as described in Table 2, the respective photoreceptors are prepared in the same manner as in Example 1. The chemical structures of acceptor compounds (18-1) and (18-2) used in Comparative Examples 2A and 3A are shown below.

Acceptor compound (18-1)

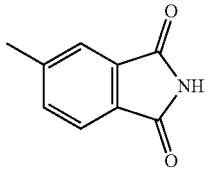

Acceptor compound (18-2)

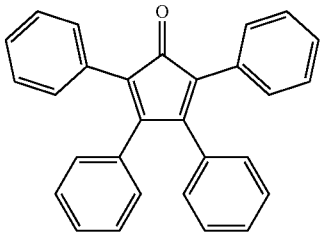

Comparative Examples 4A to 6A

Except that materials for the undercoating layer are changed as described in Table 2, the respective photoreceptors are prepared in the same manner as in Example 1. Chemical structures of the imide compounds (17-1) to (17-3) used in Comparative Examples 4A and 6A are shown below.

Imide compound (17-1)

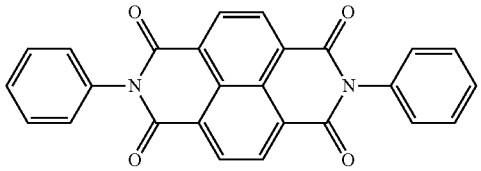

Imide compound (17-2)

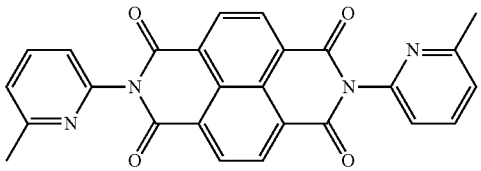

Imide compound (17-3)

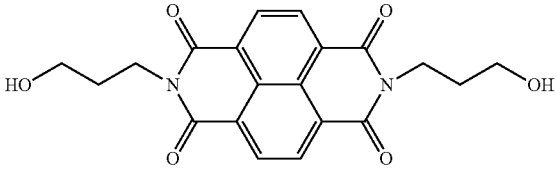

<Photoreceptor Performance Evaluation>

The photoreceptors of the foregoing Examples and Comparative Examples each is mounted on an image forming apparatus DOCU CENTRE-V C7775 (manufactured by Fuji Xerox Co., Ltd.), and the following performance evaluation is performed in an environment at a temperature of 30° C. and a relative humidity of 90%. Evaluation results are shown in Table 2.

[Evaluation of Photosensitivity]

A surface potential probe of an electrostatic voltmeter (TREK 334 manufactured by Trek, Inc.) is installed at a position 1 mm away from the surface of the photoreceptor.

The surface of the photoreceptor is charged to −700 V, and then, is exposed to monochromatic light (half width 20 nm, light amount of 1.5 μJ/cm$^2$) having a wavelength of 780 nm (irradiation time: 80 msec). The surface potential is measured at the time when 330 milliseconds elapse from the start of exposure.

Before and after an image with a density of 20% are output on 70,000 sheets of A4 paper, the above measurements are performed. A surface potential difference is calculated by subtracting the surface potential before the output from the surface potential after the output. The surface potential difference between before and after the output is classified as A$^+$ to C below.

A$^+$: Surface potential difference before and after output is less than 10 V.

A: Surface potential difference before and after output is 10 V or more and less than 30 V.

B: Surface potential difference before and after the output is 30 V or more and less than 50 V.

C: Surface potential difference before and after the output is 50 V or more.

[Residual Potential Evaluation]

A surface potential probe of an electrostatic voltmeter (TREK 334 manufactured by Trek, Inc.) is installed at a position 1 mm away from the surface of the photoreceptor.

The surface of the photoreceptor is charged to −700 V, and the residual potential after erasing is measured.

Before and after an image with a density of 20% are output on 70,000 sheets of A4 paper, the above measurements are performed. A residual potential difference is calculated by subtracting residual potential before the output from residual potential after the output. The residual potential difference between before and after the output is classified as A$^+$to C below.

A$^+$: Residual potential difference before and after the output is less than 20 V.

A: Residual potential difference before and after the output is 20 V or more and less than 50 V.

B: Residual potential difference before and after the output is 50 V or more and less than 100 V.

C: Residual potential difference before and after the output is 100 V or more.

TABLE 2

| | Materials for undercoating layer | | | | | |
|---|---|---|---|---|---|---|
| | Electron transport pigment compound | | Acceptor compound | | | |
| No. | Kinds | Used amount in total [parts by weight] | Kinds | Used amount [parts by weight] | Evaluation Photosensitivity | Residual potential |
| Example 1A | 1-1, 2-1 | 50 | 6-5 | 10 | $A^+$ | $A^+$ |
| Example 2A | 1-1, 2-1 | 50 | 6-5 | 3 | $A^+$ | A |
| Example 3A | 1-1, 2-1 | 50 | 6-5 | 12 | $A^+$ | $A^+$ |
| Example 4A | 1-3, 2-3 | 50 | 6-5 | 10 | $A^+$ | $A^+$ |
| Example 5A | 1-5, 2-5 | 50 | 6-5 | 10 | $A^+$ | $A^+$ |
| Example 6A | 1-6, 2-6 | 50 | 6-5 | 10 | A | $A^+$ |
| Example 7A | 1-7, 2-7 | 50 | 6-5 | 10 | $A^+$ | A |
| Example 8A | 1-1, 2-1 | 50 | 3-10 | 10 | $A^+$ | $A^+$ |
| Example 9A | 1-1, 2-1 | 50 | 4-2 | 10 | $A^+$ | $A^+$ |
| Example 10A | 1-1, 2-1 | 50 | 5-4 | 10 | $A^+$ | $A^+$ |
| Example 11A | 1-1, 2-1 | 50 | 6-6 | 10 | $A^+$ | $A^+$ |
| Example 12A | 1-1, 2-1 | 50 | 7-8 | 10 | A | A |
| Example 13A | 1-1, 2-1 | 50 | 8-2 | 10 | $A^+$ | $A^+$ |
| Example 14A | 1-1, 2-1 | 50 | 8-3 | 10 | $A^+$ | $A^+$ |
| Example 15A | 1-1, 2-1 | 50 | 9-5 | 10 | A | A |
| Example 16A | 1-1, 2-1 | 50 | 10-1 | 10 | $A^+$ | $A^+$ |
| Example 17A | 1-1, 2-1 | 50 | 10-8 | 10 | $A^+$ | A |
| Example 18A | 1-1, 2-1 | 50 | 11-1 | 10 | $A^+$ | $A^+$ |
| Example 19A | 1-1, 2-1 | 50 | 12-8 | 10 | A | A |
| Example 20A | 1-1, 2-1 | 50 | 13-4 | 10 | A | A |
| Example 21A | 1-1, 2-1 | 50 | 14-7 | 10 | A | A |
| Example 22A | 1-1, 2-1 | 50 | 15-9 | 10 | A | A |
| Comparative Example 1A | 1-1, 2-1 | 50 | — | 0 | C | B |
| Comparative Example 2A | 1-1, 2-1 | 50 | 18-1 | 10 | C | C |
| Comparative Example 3A | 1-1, 2-1 | 50 | 18-2 | 10 | C | C |
| Comparative Example 4A | 17-1 | 50 | 6-5 | 10 | B | C |
| Comparative Example 5A | 17-2 | 50 | 6-5 | 10 | B | C |
| Comparative Examnle 6A | 17-3 | 50 | 6-5 | 10 | C | C |

Example 1B (Formation of Undercoating Layer)

60 parts by weight of the charge transporting material 1-1, 20 parts by weight of monomer which is the diallyl phthalate compound (M-DAP-A, DAISO DAP 100 monomer, manufactured by Osaka Soda Co., Ltd.), and 20 parts by weight of prepolymer which is a diallyl phthalate compound (P-DAP-A, DAISO ISO DAP, manufactured by Osaka Soda Co., Ltd.) are mixed to each other, and dispersed for 120 minutes with a sand mill using 1 mmϕ of glass beads to obtain a dispersion.

0.8 parts by weight of t-butyl peroxybenzoate (PERBUTYL Z, manufactured by NOF CORPORATION) as a polymerization initiator is added to the obtained dispersion to obtain a coating liquid for forming an undercoating layer. Dipping coating is performed on the aluminum substrate with the coating liquid by a dipping coating method, and drying is performed at 160° C. for 60 minutes under a nitrogen atmosphere. Thereafter, drying and curing are further performed at 100° C. for 12 hours in a chamber to obtain an undercoating layer having a thickness of 3 μm.

(Formation of Charge Generation Layer)

A mixture including 15 parts by weight of hydroxygallium phthalocyanine having diffraction peaks at Bragg angles (2θ±0.2°) of at least 7.3°, 16.0°, 24.9°, and 28.0° in an X-ray diffraction spectrum using a CuKα characteristic X-ray as the charge generation substance, 10 parts by weight of vinyl chloride-vinyl acetate copolymer binder resin (VMCH, manufactured by Nippon Unicar Company Limited) as binder resin, and 200 parts by weight of n-butyl acetate are dispersed by stirring for 4 hours with a sand mill using glass beads having a diameter of 1 mmϕ. 175 parts by weight of n-butyl acetate and 180 parts by weight of methyl ethyl ketone are added to the obtained dispersion and stirred to obtain a charge generation layer forming coating liquid. This charge generation layer forming coating liquid is dipping-applied undercoating layer. Thereafter, drying is performed at 140° C. for 10 minutes to form a charge generation layer having a film thickness of 0.2 μm.

(Formation of Charge Transport Layer)

40 parts by weight of charge transporting agent (HT-1), 8 parts by weight of charge transporting agent (HT-2), and 52 parts by weight of polycarbonate binder resin (A) (viscosity average molecular weight: 50,000) are added to 800 parts by weight of tetrahydrofuran, and dissolved therein. 8 parts by weight of tetrafluoroethylene binder resin (manufactured by Daikin Industries Ltd., LUBRON L5, average particle diameter of 300 nm) is added thereto and dispersed at 5,500 rpm for 2 hours using a homogenizer (ULTRA-TURRAX manufactured by IKA) to obtain a charge transport layer forming coating liquid. This coating liquid is applied onto the above-described charge generation layer. Thereafter, drying is performed at 140° C. for 40 minutes to form a charge transport layer having a film thickness of 27 μm. In this manner, an electrophotographic photoreceptor 1 is obtained.

Polycarbonate resin (A)

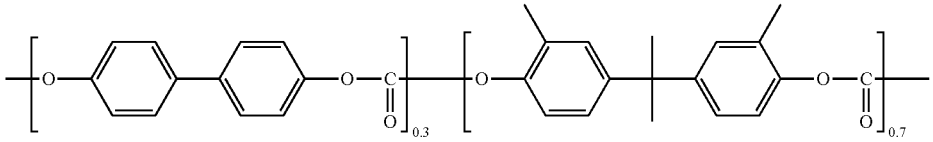

(HT-1)

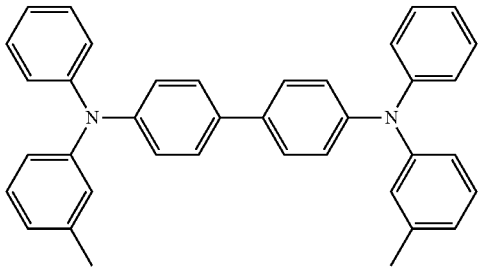

(HT-2)

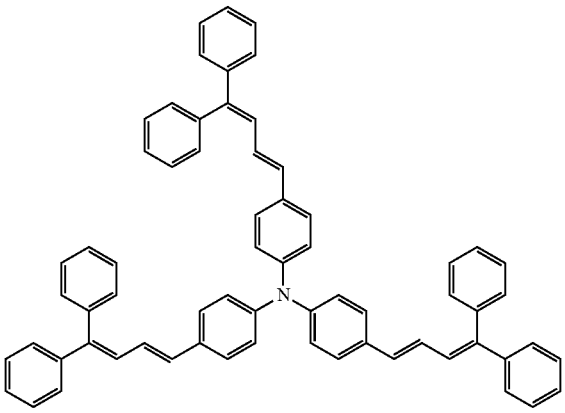

Examples 2B to 16B

In preparation of the undercoating layer, except that kinds and contents of the charge transporting material, and kinds and content ratios of the binder resin are set as shown in Table 3, the same operations as those of Example 1B are performed to obtain electrophotographic photoreceptors. Specific structure of the charge transporting material are described next.

In a charge transporting material 1-3 in Example 2B, the methyl groups are located at $R^{14}$ and $R^{18}$.

In a charge transporting material 1-6 in Example 3B, the methoxycarbonyl groups are located at $R^{12}$ and $R^{16}$.

In a charge transporting material 1-7 in Example 4B, the ethoxycarbonyl groups are located at $R^{13}$ and $R^{17}$.

In a charge transporting material 2-3 in Example 6B, the methyl groups are located at $R^{21}$ and $R^{28}$.

In a charge transporting material 2-8 in Example 7B, the octaoxycarbonyl groups are located at $R^{23}$ and $R^{27}$.

In addition, in Example 12B, a charge transporting material 3-1 having the following structure is used instead of the charge transporting material 1-1.

3-1

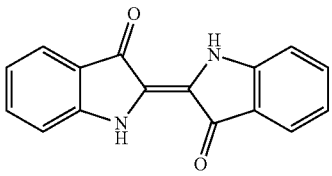

Example 17B

Except that a thickness of the undercoating layer is set to 10 μm, the same operations as those of Example 1B are performed to obtain an electrophotographic photoreceptor.

Example 18B

The undercoating layer in Example 1B is set to further include inorganic particles. In addition, except that preparation steps of the undercoating layer in Example 1B are changed to the following steps, the same operations as those of Example 1B are performed to obtain an electrophotographic photoreceptor.

100 parts by weight of zinc oxide (manufactured by Tayca Corporation, average particle diameter: 70 nm, specific surface area value: 15 $m^2/g$) is mixed to 600 parts by weight of toluene by stirring, and 1.2 parts by weight of silane coupling agent (vinyltrimethoxysilane, manufactured by Shin-Etsu Silicone Co., Ltd.) is added thereto and stirred for 2 hours. Thereafter, toluene is distilled off by distillation under reduced pressure and baked at 125° C. for 2 hours to obtain zinc oxide surface-treated with a silane coupling agent.

30 parts by weight of the surface treated zinc oxide, 40 parts by weight of the charge transporting material 1-1, 15 parts by weight of monomer which is the diallyl phthalate compound (M-DAP-A, DAISO DAP 100 monomer, manufactured by Osaka Soda Co., Ltd.), and 15 parts by weight of prepolymer which is a diallyl phthalate compound (P-DAP-A, DAISO ISO DAP, manufactured by Osaka Soda Co., Ltd.) are mixed to each other, and dispersed for 120 minutes with a sand mill using 1 mmϕ of glass beads to obtain a dispersion.

0.8 parts by weight of t-butyl peroxybenzoate (PERBUTYL Z, manufactured by NOF CORPORATION) as a polymerization initiator is added to the obtained dispersion to obtain a coating liquid for forming an undercoating layer. Dipping coating is performed on an aluminum substrate with the coating liquid by a dipping coating method, drying and curing are performed at 160° C. for 60 minutes under a nitrogen atmosphere, and then drying and curing are further performed at 100° C. for 12 hours to form an undercoating layer having a thickness of 10 μm.

Regarding amounts of monomer and prepolymer of the diallyl phthalate compound in the electrophotographic photoreceptors of Examples 2B to 17B, a total amount of 40 parts by weight (20 parts of the monomer and 20 parts of the prepolymer) in Example 1B are set to be changed to amounts to have a weight ratio of the monomer and the prepolymer shown in Table 3.

Comparative Example 1B

In preparation of the undercoating layer, except that kinds of the binder resin is set as shown in Table 4 and the following raw material and solvent are used instead of the diallyl phthalate compound, the same operations as those in Example 1B are performed to obtain an electrophotographic photoreceptor.

Material used to form polyamide resin as binder resin: Copolyamide (product number CM8000, manufactured by TORAY INDUSTRIES, INC.)

Solvent: methanol, 60 parts by weight

Comparative Example 2B

In preparation of the undercoating layer, except that kinds of the binder resin are set as shown in Table 4 and the following raw materials and solvent are used instead of the diallyl phthalate compound, the same operations as those in Example 1B are performed to obtain an electrophotographic photoreceptor.

Material used to form melamine resin as binder resin: Melamine resin (MX-730, manufactured by Sanwa Chemical Co., Ltd.)

Solvent: 2-propanol, 60 parts by weight

Comparative Example 3B

In preparation of the undercoating layer, except that kinds of the binder resin are set as shown in Table 4 and the following raw material and solvent are used instead of the diallyl phthalate compound. In addition, except that the charge transporting material is not contained, the same operations as those of Example 1B are performed to obtain an electrophotographic photoreceptor.

Material used to form polyamide resin as binder resin: Copolyamide (product number CM8000, manufactured by TORAY INDUSTRIES, INC.)

Solvent: methanol, 60 parts by weight

Comparative Example 4B

In preparation of the undercoating layer, except that kinds of the binder resin are set as shown in Table 4 and the following raw material and solvent are used instead of the diallyl phthalate compound, the same operations as those in Example 1B are performed to obtain an electrophotographic photoreceptor.

Material used to form (meth)acrylic resin as binder resin: Methacrylate polymer (manufactured by FUJIFILM Wako Pure Chemical Corporation)

Solvent: methyl ethyl ketone, 60 parts by weight

Evaluation of Charging Potential and Residual Potential

As the electrophotographic properties of the obtained electrophotographic photoreceptor, potentials of each part are measured using a laser printer remodeled scanner (XP-15 remodeled machine, manufactured by Fuji Xerox Co., Ltd.) by processes of (A) performing charging with a scorotron charger of a grid applied voltage of −700 V under a normal temperature and normal humidity (20° C., 40%) environment, and (B) after one second, performing irradiation with light of 10.0 erg/cm$^2$ by a semiconductor laser of 780 nm to perform discharge, and after 3 seconds, performing irradiation with red LED light of 50.0 erg/cm$^2$ to perform erasing. Evaluation results are shown in Tables 3 and 4.

(A) Charging potential evaluation criteria (acceptable ranges are A and B)

A: Difference from the grid applied voltage is less than 10 V

B: Difference from the grid applied voltage is less than 20 V

C: Difference from the grid applied voltage is 20 V or more (B) Residual potential evaluation criteria (acceptable ranges are A and B)

A: Less than 20 V

B: From 20 V or more and less than 40 V

C: From 40 V or more and less than 80 V

D: 80 V or more

Image Quality Evaluation

The obtained photoreceptor is mounted on a copying machine "DOCU CENTRE COLOR 500" (manufactured by Fuji Xerox Co., Ltd.), and 10 consecutive charts are output under conditions of 20° C. and 40% RH. The chart is a chart on which a region having a white letter "G" in a black solid image having an image density of 100% and a region of a halftone image having an image density of 40% are printed. Evaluation results are shown in Tables 3 and 4.

(Ghost Evaluation)

Regarding the image output at the first sheet (initial image) and the image after 10 sheets output (image after 10 sheets output), the density change of the character G is visually confirmed. Evaluation criteria are as follows. A and B fall within the acceptable range.

A: No change in density

B: Slight change in density, which is no problem in practical use

C: Density changes, which is not acceptable for actual use (Halftone Image Density Unevenness Evaluation)

Evaluation of the halftone image density unevenness is performed by visually viewing a random density change in a half tone image with density of 40%, in an image firstly output sheet (initial image) and the image after 10 sheets output (image after 10 sheets output). Evaluation criteria are as follows. A and B fall within the acceptable range.

A: No change in density

B: Slight change in density, which is no problem in practical use

C: Density changes, which is not acceptable for actual use

Leakage Current Evaluation A photoreceptor through which pinhole with a diameter of 0.1 mm penetrates to the substrate is mounted on a drum cartridge, 50% halftone images are printed under a low temperature and low humidity (10° C., 15% RH) environment and a high temperature and high humidity (28° C., 85% RH) environment, and with respect to these printed images, belt-shaped image defects corresponding to the photoreceptor pinhole portion are determined in accordance with the following criteria. Evaluation results are shown in Tables 3 and 4. A to C fall within the acceptable range.

A: Color point with a diameter of 1.0 mm or less

B: Belt-shaped image defects of 10 mm or less occur

C: Belt-shaped image defects longer than 10 mm and 30 mm or less occur

D: Belt-shaped image defects longer than 30 mm and 35 mm or less

E: Belt-shaped image defects of 35 mm or longer occur

TABLE 3

| | Charge transporting material | | Resin | | | |
|---|---|---|---|---|---|---|
| | | | Diallyl phthalate compound | | | |
| Class | Kinds | Content [parts by weight] | Monomer | Prepolymer | Weight ratio of Monomer/Prepolymer | Other monomers Kinds |
| Example 1B | 1-1 | 60 | M-DAP-A | P-DAP-A | 50/50 | — |
| Example 2B | 1-3 | 60 | M-DAP-A | P-DAP-A | 20/80 | — |
| Example 3B | 1-6 | 60 | M-DAP-A | P-DAP-A | 35/65 | — |
| Example 4B | 1-7 | 60 | M-DAP-A | P-DAP-A | 80/20 | — |
| Example 5B | 2-1 | 60 | M-DAP-A | P-DAP-A | 65/35 | — |
| Example 6B | 2-3 | 60 | M-DAP-A | P-DAP-A | 35/65 | — |
| Example 7B | 2-8 | 60 | M-DAP-A | P-DAP-A | 35/65 | — |
| Example 8B | 1-1 | 60 | M-DAP-B | P-DAP-B | 50/50 | — |
| Example 9B | 1-1 | 60 | M-DAP-C | P-DAP-B | 50/50 | — |
| Example 10B | 1-1 | 60 | M-DAP-A | P-DAP-B | 50/50 | — |
| Example 11B | 1-1 | 60 | M-DAP-A | — | — | — |
| Example 12B | 3-1 | 60 | M-DAP-A | P-DAP-A | 35/65 | — |
| Example 13B | 1-1 | 60 | M-DAP-A | P-DAP-A | 50/40 | Methyl methacrylate |
| Example 14B | 1-1 | 60 | — | P-DAP-A | — | Methyl methacrylate |
| Example 15B | 1-1 | 40 | M-DAP-A | P-DAP-A | 50/50 | — |
| Example 16B | 1-1 | 80 | M-DAP-A | P-DAP-A | 50/50 | — |
| Example 17B | 1-1 | 60 | M-DAP-A | P-DAP-A | 50/50 | — |
| Example 18B*1 | 1-1 | 40 | M-DAP-A | P-DAP-A | 50/50 | — |

| | Resin Other monomers Content | Evaluation results | | | | |
|---|---|---|---|---|---|---|
| Class | [parts by weight] | Charging Potential | Residual Potential | Ghost | Density unevenness | Leakage current |
| Example 1B | — | A | A | A | A | B |
| Example 2B | — | A | A | A | A | B |
| Example 3B | — | A | A | A | A | B |
| Example 4B | — | A | A | A | A | B |
| Example 5B | — | A | A | A | A | B |
| Example 6B | — | A | A | A | A | B |
| Example 7B | — | A | A | A | A | B |
| Example 8B | — | A | B | B | A | B |
| Example 9B | — | B | B | B | B | B |
| Example 10B | — | B | B | B | B | B |
| Example 11B | — | B | B | B | B | C |
| Example 12B | — | B | B | B | B | B |
| Example 13B | 5 | B | B | B | B | A |
| Example 14B | 15 | B | B | B | B | A |
| Example 15B | — | A | B | B | B | A |
| Example 16B | — | B | B | B | B | C |
| Example 17B | — | A | B | B | B | A |
| Example 18B*1 | — | B | B | B | B | B |

*1Zinc oxide as metal oxide particles further contained

TABLE 4

| | Charge transporting material | | | Evaluation results | | | | |
|---|---|---|---|---|---|---|---|---|
| Class | Kinds | Content [parts by weight] | Resin | Charging Potential | Residual Potential | Ghost | Density unevenness | Leakage current |
| Comparative Example 1B | 1-1 | 60 | Polyamide resin | C | C | C | C | D |
| Comparative Example 2B | 1-1 | 60 | Melamine resin | C | D | C | C | D |
| Comparative Example 3B | — | — | Polyamide resin | C | D | C | C | E |
| Comparative Example 4B | 1-1 | 60 | (Meth)acrylic resin | C | C | C | C | A |

From the above results, it is found that, in the electrophotographic photoreceptors according to Examples, the residual potential is prevented from rising when repeated images are formed, as compared with the electrophotographic photoreceptors according to Comparative Examples. In addition, it is found that, in the electrophotographic photoreceptors of Examples 13B and 14B using the binder resin obtained by polymerizing the diallyl phthalate compound and a (meth)acrylic monomer for the undercoating layer, leakage current is prevented, as compared with the electrophotographic photoreceptor of Example 1B using the binder resin obtained by polymerizing only the diallyl phthalate compound for the undercoating layer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an undercoating layer that is provided on the conductive substrate and contains a binder resin and a charge transporting material, the binder resin containing a resin obtained by polymerizing a diallyl isophthalate compound alone, or a diallyl phthalate compound and a (meth)acrylic monomer; and a photosensitive layer that is provided on the undercoating layer.

2. The electrophotographic photoreceptor according to claim 1, wherein the diallyl isophthalate compound includes a monomer and a prepolymer of the diallyl isophthalate compound.

3. The electrophotographic photoreceptor according to claim 2, wherein a weight ratio of the monomer to the prepolymer is from 1/99 to 99/1.

4. The electrophotographic photoreceptor according to claim 3, wherein the weight ratio of the monomer to the prepolymer is from 20/80 to 80/20.

5. The electrophotographic photoreceptor according to claim 2, wherein a weight average molecular weight of the prepolymer is 200,000 or less.

6. The electrophotographic photoreceptor according to claim 1, wherein the charge transporting material includes at least one kind of perinone compounds represented by Formula (1) or (2):

Formula (1)

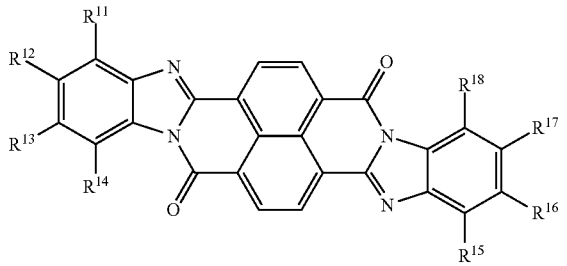

Formula (2)

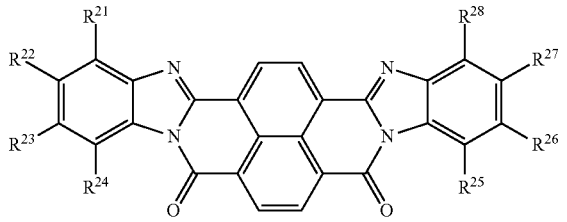

in Formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom, $R^{11}$ and $R^{12}$ may be linked to each other to form a ring, $R^{12}$ and $R^{13}$ may be linked to each other to form a ring, $R^{13}$ and $R^{14}$ may be linked to each other to form a ring, $R^{15}$ and $R^{16}$ may be linked to each other to form a ring, $R^{16}$ and $R^{17}$ may be linked to each other to form a ring, and $R^{17}$ and $R^{18}$ may be linked to each other to form a ring; and in Formula (2), $R^{21}$, $R^{22}$, $R^{23}$, $R^{24}$, $R^{25}$, $R^{26}$, $R^{27}$, $R^{28}$ each independently represent a hydrogen atom, an alkyl group, an alkoxy group, an aralkyl group, an aryl group, an aryloxy group, an alkoxycarbonyl group, an aryloxycarbonyl group, an alkoxycarbonylalkyl group, an aryloxycarbonylalkyl group, or a halogen atom, $R^{21}$ and $R^{22}$ may be linked to each other to form a ring, $R^{22}$ and $R^{23}$ may be linked to each other to form a ring, $R^{23}$ and $R^{24}$ may be linked to each other to form a ring, $R^{25}$ and $R^{26}$ may be linked to each other to form a ring, $R^{26}$ and $R^{27}$ may be linked to each other to form a ring, and $R^{27}$ and $R^{28}$ may be linked to each other to form a ring.

7. The electrophotographic photoreceptor according to claim 6, wherein, in Formula (1), $R^{11}$, $R^{12}$, $R^{13}$, $R^{14}$, $R^{15}$, $R^{16}$, $R^{17}$, and $R^{18}$ each independently represent a hydrogen atom, an alkyl group, an alkoxycarbonyl group, an aryloxycarbonyl group, an alkoxycarbonylalkyl group or an aryloxycarbonylalkyl group, and in Formula (2), $R^{21}$, $R^{22}$, $R^{23}$, $R^{24}$, $R^{25}$, $R^{26}$, $R^{27}$, $R^{28}$ each independently represent a hydrogen atom, an alkyl group, an alkoxycarbonyl group, an aryloxycarbonyl group, an alkoxycarbonylalkyl group, or an aryloxycarbonylalkyl group.

8. The electrophotographic photoreceptor according to claim 6, wherein the perinone compound represented by Formulas (1) and (2) constitutes from 90% by weight to 100% by weight of the charge transporting material.

9. The electrophotographic photoreceptor according to claim 1, wherein a content of the diallyl phthalate compound is from 50 part by weight to 99.5 parts by weight with respect to 100 parts by weight of a total solid content of the binder resin.

10. The electrophotographic photoreceptor according to claim 1, wherein a content of the charge transporting material with respect to a total solid content of the undercoating layer is from 40% by weight to 80% by weight.

11. The electrophotographic photoreceptor according to claim 1, wherein a content of the resin obtained by polymerizing the diallyl isophthalate compound alone, or a diallyl phthalate compound and a (meth)acrylic monomer is 90% by weight or more with respect to a total amount of the binder resin.

12. The electrophotographic photoreceptor according to claim 1, wherein the undercoating layer further comprises metal oxide particles selected from the group consisting of zinc oxide, titanium oxide, tin oxide, aluminum oxide, indium oxide, silicon oxide, magnesium oxide, barium oxide, molybdenum oxide, or a combination thereof.

13. A process cartridge that is detachable from an image forming apparatus, the process cartridge comprising:

the electrophotographic photoreceptor according to claim 1.

14. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor with a developer including toner to form a toner image; and a transfer unit that transfers the toner image onto a surface of a recording medium.

* * * * *